US012599200B2

(12) United States Patent
Cheng

(10) Patent No.: US 12,599,200 B2
(45) Date of Patent: Apr. 14, 2026

(54) MAGNETIC BUCKLE ASSEMBLY

(71) Applicant: Wonderland Switzerland AG, Steinhausen (CH)

(72) Inventor: Manqun Cheng, Dongguan (CN)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 18/764,790

(22) Filed: Jul. 5, 2024

(65) Prior Publication Data

US 2024/0358124 A1 Oct. 31, 2024

Related U.S. Application Data

(63) Continuation of application No. 18/114,854, filed on Feb. 27, 2023, now Pat. No. 12,053,062, which is a (Continued)

(30) Foreign Application Priority Data

Jun. 6, 2019 (CN) ..... 201910492826.7

(51) Int. Cl.
*A44B 11/25* (2006.01)

(52) U.S. Cl.
CPC ..... *A44B 11/2592* (2013.01); *A44D 2203/00* (2013.01)

(58) Field of Classification Search
CPC ..... A44B 11/2592; A44B 11/2503; A44B 11/2546; A44B 11/2515; A44B 11/2549; A44D 2203/00; B60R 22/105
See application file for complete search history.

(56) References Cited

U.S. PATENT DOCUMENTS 1,271,650 A 7/1918 Arkin
5,199,138 A 4/1993 Morita
(Continued)

FOREIGN PATENT DOCUMENTS

CN 2865373 Y 2/2007
CN 200994477 Y 12/2007
(Continued)

OTHER PUBLICATIONS

First Office Action for Chinese Application No. 202310028229.5 dated May 28, 2025, 14 pages.
(Continued)

*Primary Examiner* — David M Upchurch
(74) *Attorney, Agent, or Firm* — Volpe Koenig

(57) ABSTRACT

A magnetic buckle assembly includes first buckle component, a second buckle component for mating with the first buckle component, a switch movably disposed on the second buckle component, an operating component slidably disposed on the second buckle component and for driving the switch to move. The first magnetic component, a first magnetic component disposed on the first buckle component, a second magnetic component disposed on the switch and for magnetically attracting or repelling the first magnetic component, and a latch movably disposed on the second buckle component and for engaging with the first buckle component. The latch moves along with sliding movement of the operating component. The operating component drives the switch to move to change a direction of a magnetic force of the second magnetic component acting on the first magnetic component when the operating component is operated to slide to disengage the latch from the first buckle component.

15 Claims, 75 Drawing Sheets

Related U.S. Application Data continuation of application No. 17/475,362, filed on Sep. 15, 2021, now Pat. No. 11,712,090, which is a continuation of application No. 16/893,451, filed on Jun. 5, 2020, now Pat. No. 11,140,946.

(56) References Cited

U.S. PATENT DOCUMENTS

| | | | | |
|---|---|---|---|---|
| 5,253,394 | A | 10/1993 | Mortia | |
| 5,311,647 | A | 5/1994 | Levy | |
| 5,937,487 | A | 8/1999 | Bauer | |
| 6,131,247 | A | 10/2000 | Morita | |
| 6,182,336 | B1 | 2/2001 | Bauer | |
| 6,295,702 | B1 | 10/2001 | Bauer | |
| 6,564,434 | B1 | 5/2003 | Mortia | |
| 8,359,716 | B2 * | 1/2013 | Fiedler | A44B 11/266 24/652 |
| 8,430,434 | B2 | 4/2013 | Fiedler | |
| 8,850,670 | B2 | 10/2014 | Fiedler | |
| 8,851,534 | B2 | 10/2014 | Fiedler | |
| 8,914,951 | B2 * | 12/2014 | Gaudillere | A44B 11/266 24/303 |
| 9,555,935 | B2 * | 1/2017 | Fiedler | A44B 11/258 |
| 9,572,410 | B2 | 2/2017 | Fiedler | |
| 10,143,270 | B2 * | 12/2018 | Fiedler | A44B 11/2588 |
| 10,470,529 | B2 * | 11/2019 | Chan | A44B 11/2592 |
| 10,874,178 | B2 * | 12/2020 | Cheng | A44B 11/2511 |
| 2003/0131452 | A1 | 7/2003 | Revel | |
| 2003/0150283 | A1 | 8/2003 | Stanley et al. | |
| 2005/0000069 | A1 | 1/2005 | Park | |
| 2006/0096070 | A1 | 5/2006 | Ishida | |
| 2010/0283269 | A1 | 11/2010 | Fiedler | |
| 2010/0308605 | A1 | 12/2010 | Fiedler | |
| 2012/0216373 | A1 | 8/2012 | Fiedler | |
| 2012/0248793 | A1 | 10/2012 | Fiedler | |
| 2014/0082894 | A1 | 3/2014 | Walker et al. | |
| 2014/0317890 | A1 * | 10/2014 | Koons | A44B 11/00 24/303 |
| 2014/0339232 | A1 | 11/2014 | Fiedler | |
| 2016/0010371 | A1 | 1/2016 | Fiedler | |
| 2016/0068117 | A1 | 3/2016 | Huelke et al. | |
| 2018/0078001 | A1 | 3/2018 | Babin et al. | |
| 2018/0236968 | A1 | 8/2018 | Kang et al. | |
| 2020/0036761 | A1 | 1/2020 | Weinwurm et al. | |
| 2020/0121032 | A1 | 4/2020 | Vaccari | |
| 2020/0383432 | A1 | 12/2020 | Cheng | |
| 2023/0202358 | A1 * | 6/2023 | Longenecker | B60N 2/265 24/303 |

FOREIGN PATENT DOCUMENTS

| | | | |
|---|---|---|---|
| CN | 101657120 | | 2/2010 |
| CN | 101925313 | A | 12/2010 |
| CN | 102036578 | A | 4/2011 |
| CN | 102292006 | A | 12/2011 |
| CN | 102481035 | A | 5/2012 |
| CN | 102596654 | A | 7/2012 |
| CN | 102726891 | A | 10/2012 |
| CN | 104000351 | A | 8/2014 |
| CN | 204070830 | U | 1/2015 |
| CN | 104856373 | | 8/2015 |
| CN | 104856373 | A | 8/2015 |
| CN | 205273582 | | 6/2016 |
| CN | 205661412 | | 10/2016 |
| CN | 106740651 | A | 5/2017 |
| CN | 108669712 | A | 10/2018 |
| CN | 208259204 | U | 12/2018 |
| CN | 109339585 | A | 2/2019 |
| CN | 109662399 | A | 4/2019 |
| CN | 209498785 | U | 10/2019 |
| CN | 113796628 | A | 12/2021 |
| DE | 102017208310 | B4 | 2/2023 |
| EP | 1547484 | A1 | 6/2005 |
| EP | 1737310 | B1 | 10/2007 |
| EP | 2508095 | A1 | 10/2012 |
| EP | 3165117 | A1 | 5/2017 |
| EP | 3165118 | A1 | 5/2017 |
| EP | 3183986 | A1 | 6/2017 |
| EP | 3616552 | A1 | 3/2020 |
| JP | 63150516 | U | 10/1988 |
| JP | 9047306 | A | 2/1997 |
| JP | H09056425 | A | 3/1997 |
| JP | 2001137013 | A | 5/2001 |
| JP | 2004135776 | A | 5/2004 |
| JP | 2005178513 | A | 7/2005 |
| JP | 2006130182 | A | 5/2006 |
| JP | 2006204691 | A | 8/2006 |
| JP | 2007244543 | A | 9/2007 |
| JP | 2009542380 | A | 12/2009 |
| JP | 4604482 | B2 | 1/2011 |
| JP | 2014150941 | A | 8/2014 |
| JP | 2015198855 | A | 11/2015 |
| JP | 2017012498 | A | 1/2017 |
| JP | 2020117205 | A | 8/2020 |
| JP | 2020175881 | A | 10/2020 |
| KR | 20060084205 | A | 7/2006 |
| TW | M532188 | U | 11/2016 |
| TW | I584755 | B | 6/2017 |
| TW | M578102 | U | 5/2019 |
| WO | 2008006356 | A2 | 1/2008 |
| WO | 2009092368 | A2 | 7/2009 |
| WO | 2009103279 | A2 | 8/2009 |
| WO | 2010059370 | A2 | 5/2010 |
| WO | 2013075851 | A1 | 5/2013 |
| WO | 2014090926 | A1 | 6/2014 |
| WO | 2014102905 | A1 | 1/2017 |
| WO | 2018169147 | A1 | 9/2018 |
| WO | 2020244627 | A1 | 12/2020 |

OTHER PUBLICATIONS

First Office Action for Chinese Application No. 202310028233.1 dated May 27, 2025, 14 pages.

First Office Action for Chinese Application No. 202310028249.2 dated May 23, 2025, 15 pages.

First Office Action for Chinese Application No. 202310028266.6 dated May 28, 2025, 13 pages.

First Office Action for Chinese Application No. 202310028275.5 dated May 23, 2025, 14 pages.

Chinese Office Action for Application No. 202010506958.3 dated Apr. 2, 2022.

Guide for College Student in Extra-Curicular Science and Technology, Oct. 21, 2014.

New Senior Turner Concise Reader, Apr. 30, 2006.

Decision to Grant a Patent for Japanese Patent Application No. 2020-098897 dated Jun. 2022.

International Search Report mailed on Sep. 10, 2020 for International application No. PCT/CN2020/094657, International filing date Jun. 5, 2020.

Taiwanese Office Action for corresponding Taiwan Application No. 109125258 dated Sep. 22, 2021.

Taiwanese Office Action for corresponding Taiwan Application No. 111134394 dated Jul. 20, 2023.

Notice of Allowance for corresponding German Application No. 102020207107.1 dated Nov. 7, 2022.

First Office Action for corresponding Taiwan Application No. 113126206 dated Oct. 4, 2024, 4 pages long.

International Search Report for corresponding International Application No. PCT/EP2024/058332 dated Jun. 21, 2024, 68 pages.

First Office Action for corresponding Taiwan Application No. 113111413 dated Oct. 21, 2024, 9 pages.

First Office Action for corresponding Taiwan Application No. 114137158 dated Dec. 12, 2025, 11 pages.

* cited by examiner

100i

MAGNETIC BUCKLE ASSEMBLY

CROSS REFERENCE TO RELATED APPLICATIONS

This application is a continuation of U.S. patent application Ser. No. 18/114,854, filed on Feb. 27, 2023, which is a continuation of U.S. patent application Ser. No. 17/475,362, filed on Sep. 15, 2021, which issued as U.S. Pat. No. 11,712,090 on Aug. 1, 2023, which is a continuation of U.S. patent application Ser. No. 16/893,451, filed on Jun. 5, 2020, which issued as U.S. Pat. No. 11,140,946 on Oct. 12, 2021, and claims the benefit of Chinese Patent Application No. 201910492826.7, filed Jun. 6, 2019, all of which are incorporated by reference as if fully set forth.

BACKGROUND OF INVENTION

1. Field of the Invention

The present disclosure relates to an accessory for a child carrier, and more particularly, to a magnetic buckle assembly.

2. Description of the Prior Art

With development of the economy and advancement of the technology, there are more and more consumer goods available in the market for bringing convenience in people's life. A child carrier is one of the consumer goods.

It is well-known that a harness system including at least one strap is indispensable for the child carrier to secure a child. The harness system usually includes straps and a buckle assembly. The buckle assembly facilitates a user to attach the straps to each other or detach the straps from each other easily.

Currently, the conventional buckle assembly usually includes a male buckle, a female buckle, a latch and an operating component. The female buckle is for mating with the male buckle. The latch is for restraining separation of the male buckle and the female buckle when the male buckle is mated with the female buckle. The operating component is for driving the latch to allow the separation of the male buckle and the female buckle. However, the male buckle cannot be mated with or separated from the female buckle quickly.

In order to accelerate a mating process of the male buckle and the female buckle, there is a magnetic buckle assembly including two magnetic components for magnetically attracting each other. The two magnetic components are respectively installed on the male buckle and the female buckle, so that the magnetic attracting force generated by the two magnetic components can accelerate a mating process of the male buckle and the female buckle. However, the magnetic attracting force interferes with a separating process of the male buckle and the female buckle.

In order to accelerate the separating process of the male buckle and the female buckle, there is another magnetic buckle assembly including two magnetic components magnetically repelling each other. The two magnetic components are respectively installed on the male buckle and the female buckles, so that a magnetic repelling force generated by the two magnetic components can accelerate the separating process of the male buckle and the female buckle. However, the magnetic repelling force interferes with the mating process of the male buckle and the female buckle.

Therefore, there is a need to provide an improved magnetic buckle assembly which can facilitate not only a mating operation thereof but also a separating process thereof.

SUMMARY OF THE INVENTION

The present disclosure provides a magnetic buckle assembly which can change a direction of a magnetic force of a magnetic component for facilitating not only a mating operation thereof but also a separating operation thereof.

The present disclosure discloses a magnetic buckle assembly. The magnetic buckle assembly includes a first buckle component, a second buckle component, a switch, an operating component, a first magnetic component, a second magnetic component and a latch. The second buckle component is for mating with the first buckle component. The switch is movably disposed on the second buckle component. The operating component is slidably disposed on the second buckle component. The first magnetic component is disposed on the first buckle component. The second magnetic component is disposed on the switch and for magnetically attracting or repelling the first magnetic component. The latch is movably disposed on the second buckle component and for engaging with the first buckle component. The operating component drives the switch to change a direction of a magnetic force of the second magnetic component acting on the first magnetic component when the operating component is operated to disengage the latch from the first buckle component.

In summary, the magnetic buckle assembly of the present disclosure utilizes cooperation of the operating component, the switch, the latch, the first magnetic component and the second magnetic component to change the direction of the magnetic force of the second magnetic component acting on the first magnetic component by moving the switch when the operating component is operated to disengage the at least one latch from the first buckle component. Therefore, the first magnetic component and the second magnetic component can be configured to magnetically attract each other when the first buckle component is mated with the second buckle component. The first magnetic component and the second magnetic component can magnetically repel each other when the operating component is operated to disengage the at least one latch from the first buckle component for allowing separation of the first buckle component and the second buckle component, which facilitates not only a mating operation of the magnetic buckle assembly but also a separating operation of the magnetic buckle assembly. Understandably, the first magnetic component and the second magnetic component also can be configured to magnetically repel each other when the first buckle component is mated with the second buckle component, and the first magnetic component and the second magnetic component can magnetically attract each other when the operating component is operated to disengage the at least one latch from the first buckle component, which prevents an unintentional separation of first buckle component and the second buckle component.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the disclosure may be practiced. In this regard, directional terminology, such as "top," "bottom," "front," "back," etc., is used with reference to the orientation of the Figure(s) being described. The components of the present disclosure can be positioned in a number of different orientations. As such, the directional terminology is used for purposes of illustration and is in no way limiting. Accordingly, the drawings and descriptions will be regarded as illustrative in nature and not as restrictive.

Figure 1:
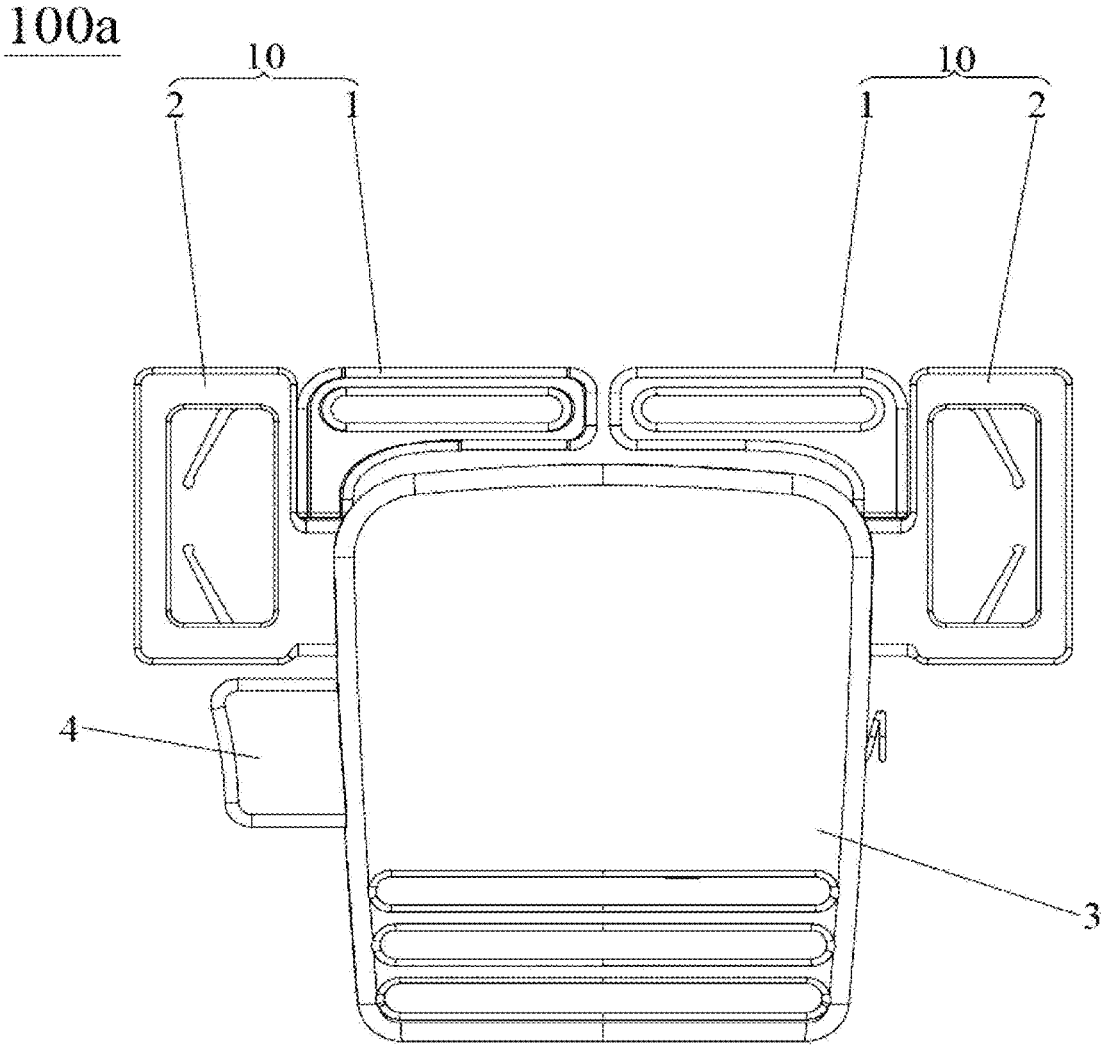
FIG. 1 is a front view diagram of a magnetic buckle assembly according to some embodiments of the present disclosure.
Figure 2:
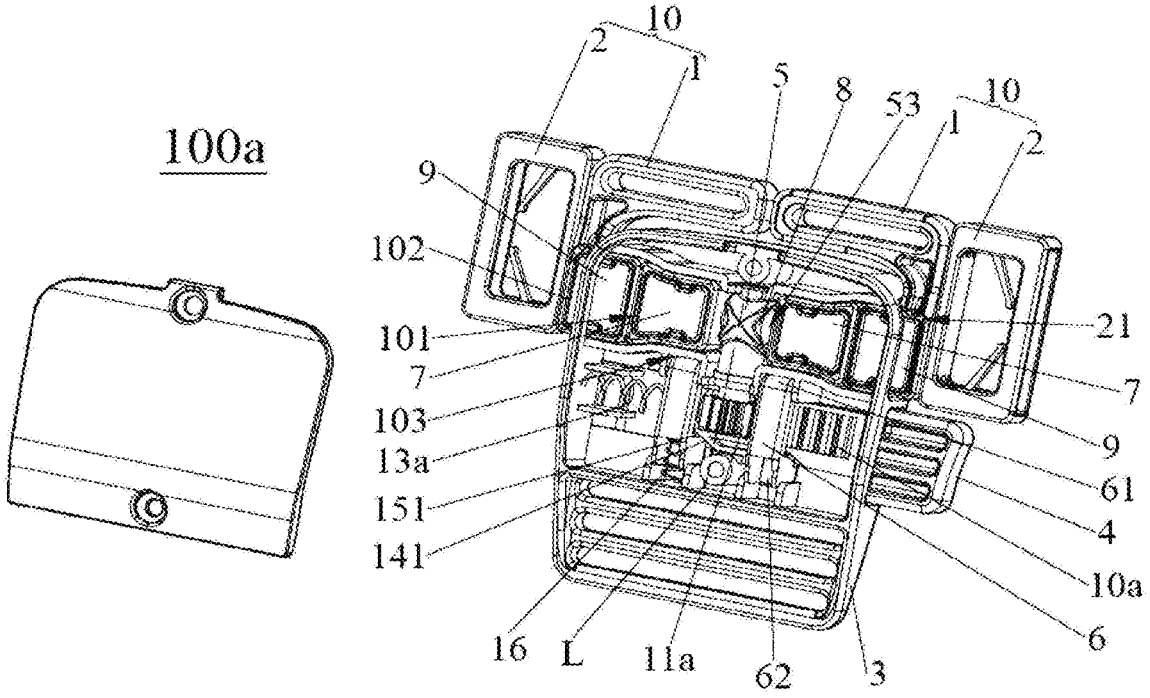
FIG. 2 is a diagram of the magnetic buckle assembly as a cover of a second buckle component is detached according to some embodiments of the present disclosure.
Figure 3:
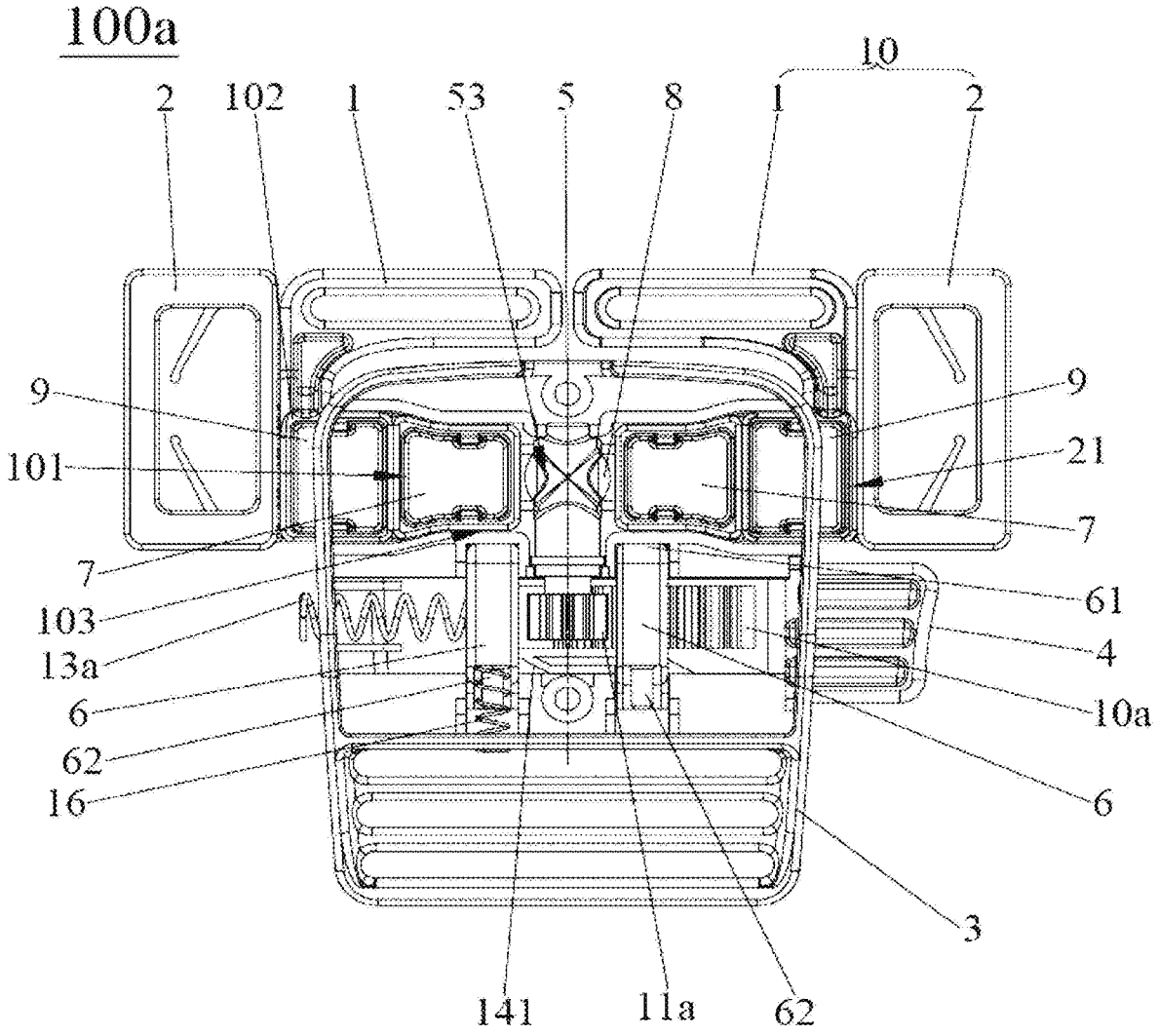
FIG. 3 is an internal structural diagram of the magnetic buckle assembly according to some embodiments of the present disclosure.
Figure 4:
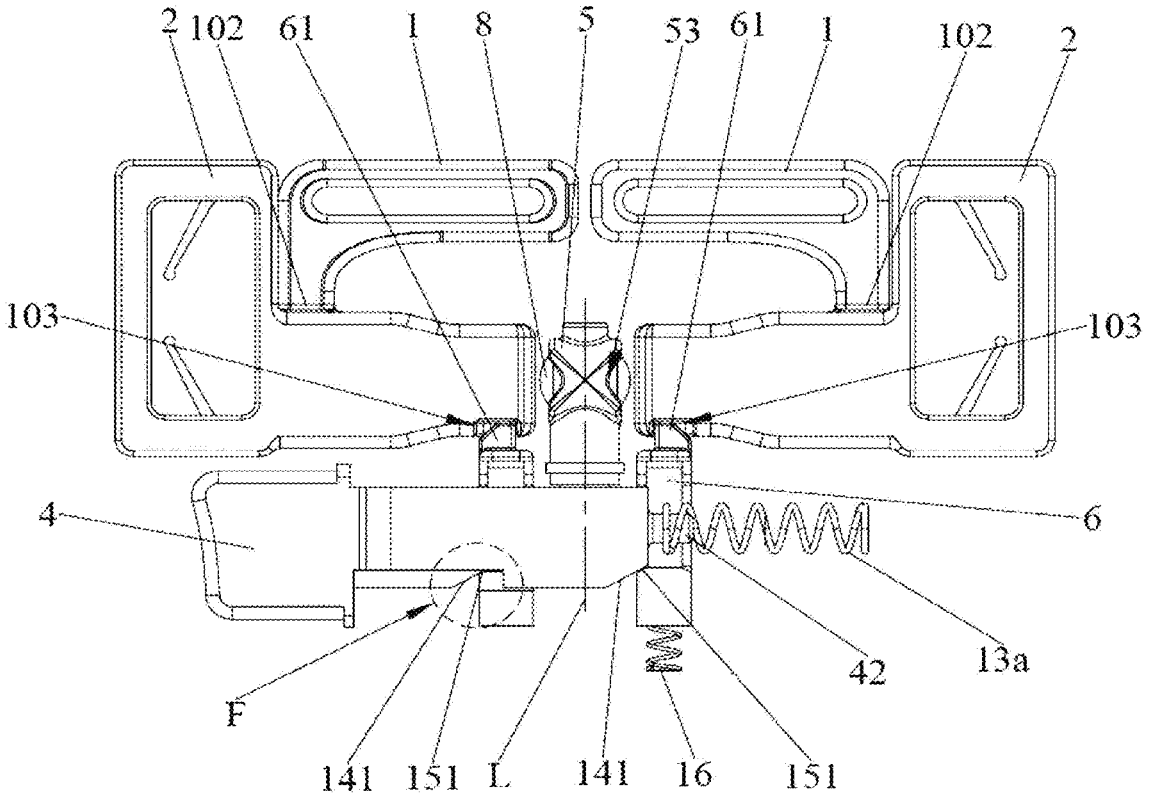
FIG. 4 is a partial diagram of the magnetic buckle assembly according to some embodiments of the present disclosure.
Figure 5:
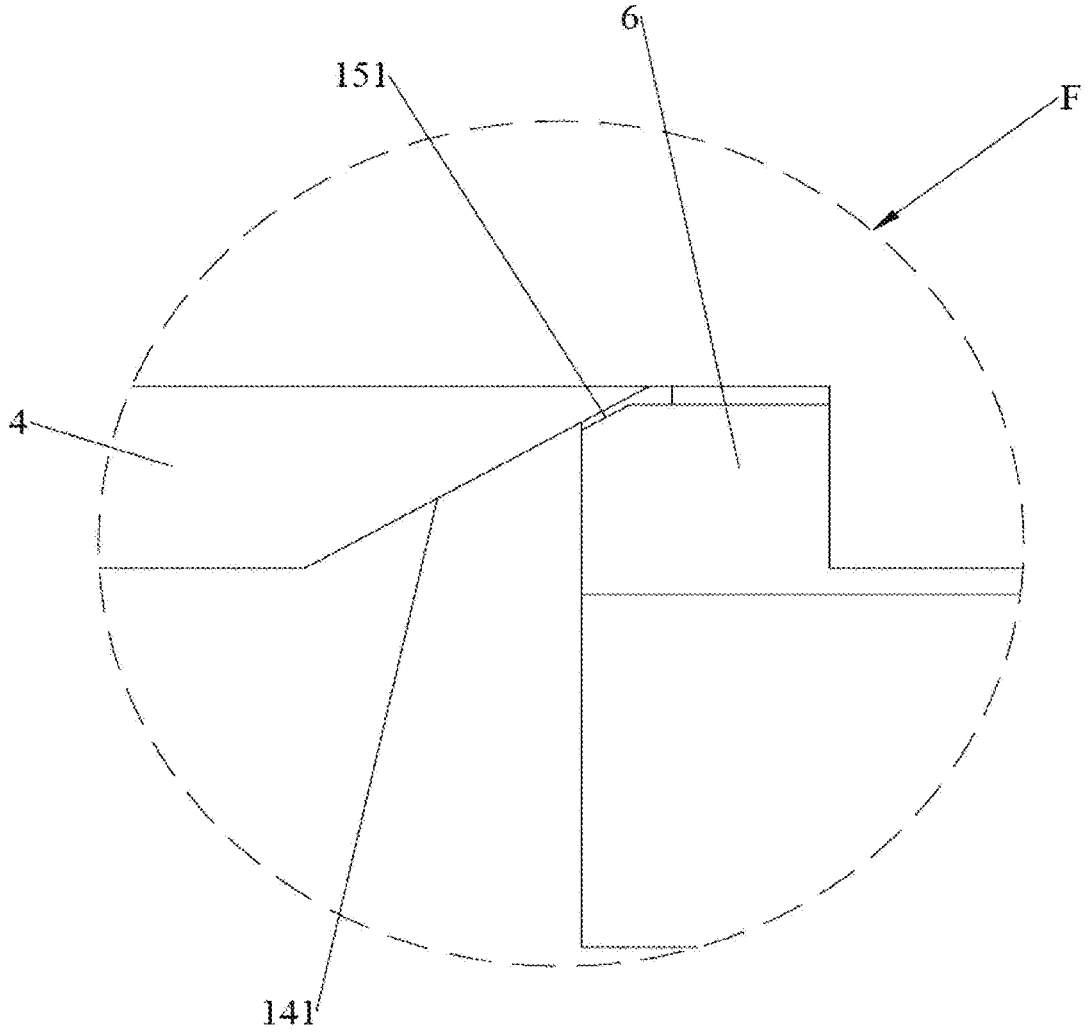
FIG. 5 is an enlarged diagram of an F portion of the magnetic buckle assembly shown in FIG. 4 according to some embodiments of the present disclosure.
Figure 6:
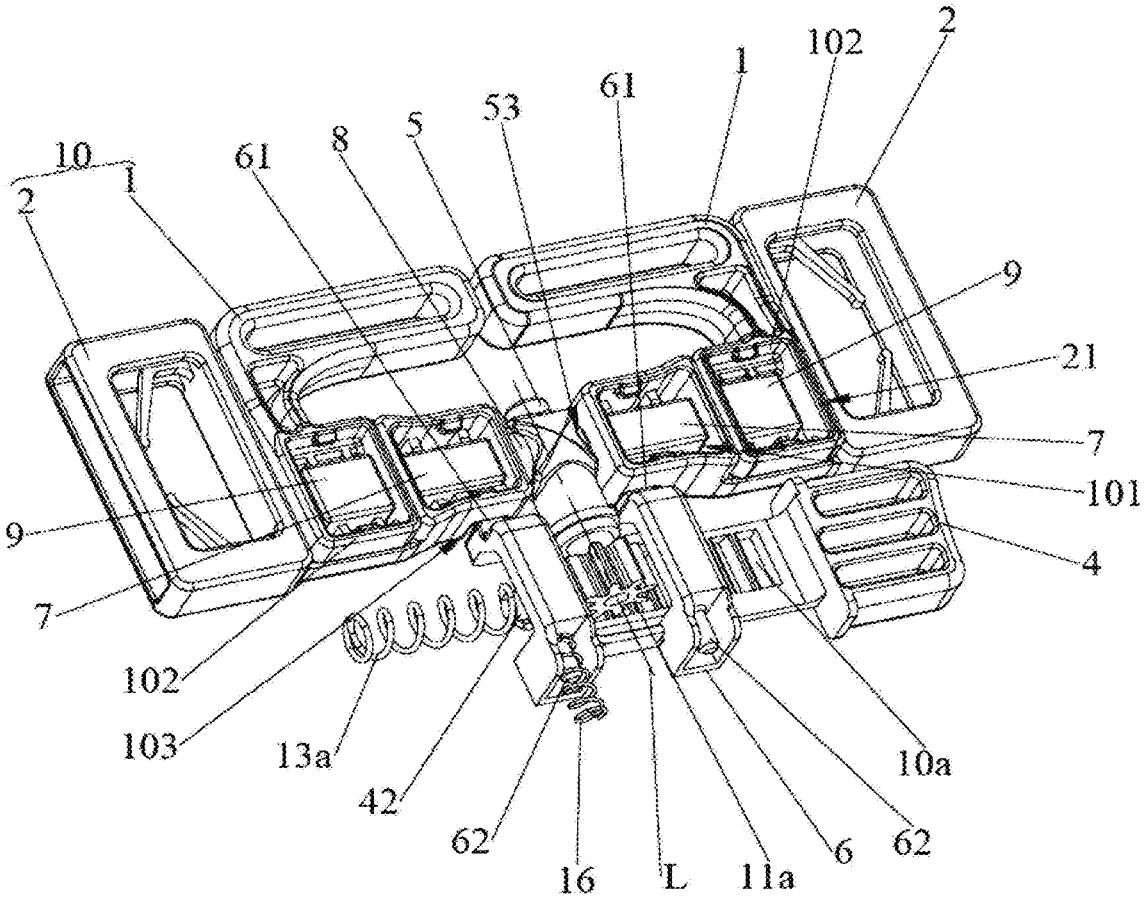
FIG. 6 is a partial diagram of the magnetic buckle assembly at another view according to some embodiments of the present disclosure.
Figure 7:
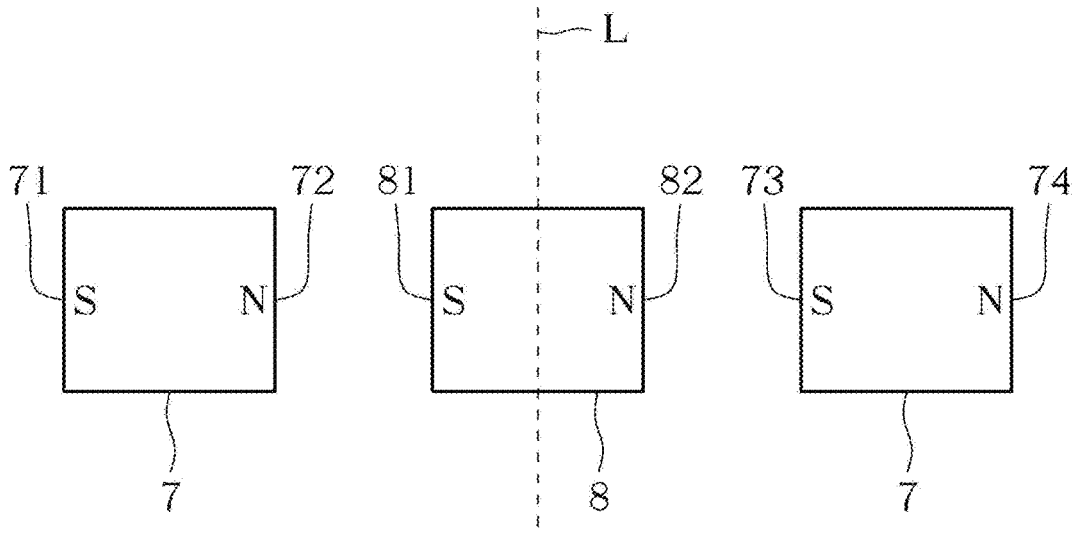
FIG. 7 and FIG. 8 are diagrams of the two first magnetic components and the second magnetic component in different states according to some embodiments of the present disclosure.
Figure 8:
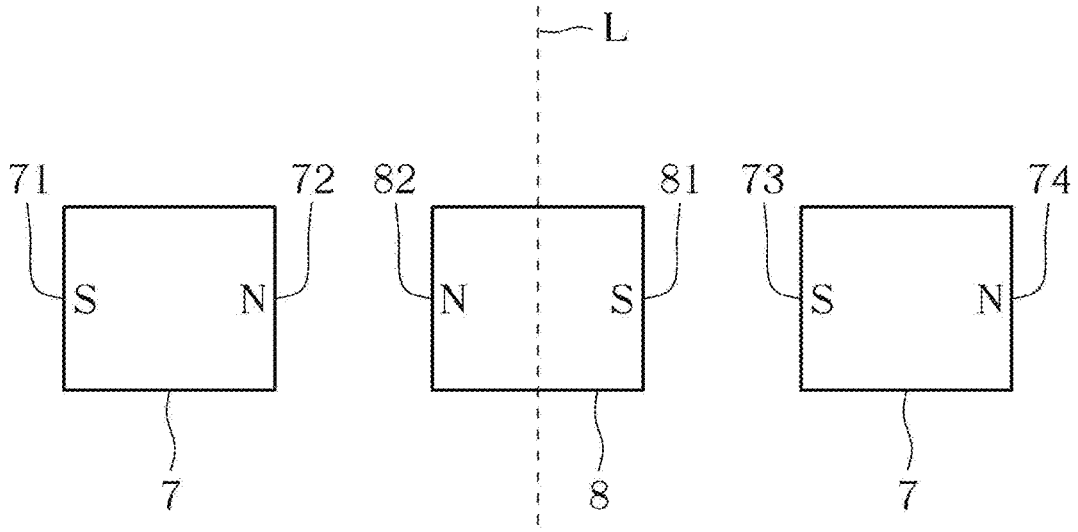

Please refer to FIG. 1 to FIG. 8. FIG. 1 is a front view diagram of a magnetic buckle assembly 100 a according to some embodiments of the present disclosure. FIG. 2 is a diagram of the magnetic buckle assembly 100 a as a cover of a second buckle component 3 is detached according to some embodiments of the present disclosure. FIG. 3 is an internal structural diagram of the magnetic buckle assembly 100 a according to some embodiments of the present disclosure. FIG. 4 is a partial diagram of the magnetic buckle assembly 100 a according to some embodiments of the present disclosure. FIG. 5 is an enlarged diagram of an F portion of the magnetic buckle assembly 100 a shown in FIG. 4 according to some embodiments of the present disclosure. FIG. 6 is a partial diagram of the magnetic buckle assembly 100 a at another view according to some embodiments of the present disclosure. FIG. 7 and FIG. 8 are diagrams of the two first magnetic components 7 and the second magnetic component 8 in different states according to some embodiments of the present disclosure. As shown in FIG. 1 to FIG. 6, the magnetic buckle assembly 100 a includes two first buckle components 10, the second buckle component 3, two latches 6, a switch 5, an operating component 4, two first magnetic components 7 and a second magnetic component 8.

The second buckle component 3 is for mating with the two first buckle components 10. The switch 5 is rotatably disposed on the second buckle component 3 around a rotating axis L and linked to the operating component 4. The second magnetic component 8 is disposed on the switch 5. Each first magnetic component 7 is disposed on the corresponding first buckle component 10 for magnetically attracting or repelling the second magnetic component 8. Each latch 6 is movably disposed on the second buckle component 3 and linked to the operating component 4 for engaging with the first buckle component 10 to prevent separation of the corresponding first buckle component 10 and the second buckle component 3 when the corresponding first buckle component 10 is mated with the second buckle component 3. The operating component 4 is movably disposed on the second buckle component 3 for driving the switch 5 and the two latches 6 to move at the same time. In detail, the operating component 4 drives the two latches 6 to move to allow the separation of the two first buckle components 10 and the second buckle component 3 when the operating component 4 is operated to drive the switch 5 to rotate around the rotating axis L to reverse a direction of a magnetic field of the second magnetic component 8.

Specifically, the two first buckle components 10 are arranged symmetrically along the rotating axis L, and each first buckle component 10 can include a shoulder strap buckle 1 and a waist strap buckle 2. Each shoulder strap buckle 1 is assembled with the corresponding waist strap buckle 2 to form a male buckle. The second buckle component 3 can be a crotch strap buckle which is a female buckle for mating with the each male buckle formed by the corresponding shoulder strap buckle 1 and the corresponding waist strap buckle 2 along a lateral direction of the magnetic buckle assembly 100*a*. The switch 5 is rotatably disposed on the second buckle component 3, i.e., the crotch strap buckle, around the rotating axis L. Each latch 6 and the operating component 4 can be movably disposed on the second buckle component 3, i.e., the crotch strap buckle, and linked to the each other. The two first magnetic components 7 are respectively embedded into the two waist strap buckles 2 and are arranged symmetrically along the rotating axis L. The second magnetic component 8 can magnetically attract or repel each first magnetic component 7 to facilitate a mating operation or a separating operation of the corresponding male buckle, which is formed by the corresponding waist strap buckle 1 and the corresponding shoulder strap buckle 2, and the female buckle, which is the crotch strap buckle, i.e., a mating operation or a separating operation of the corresponding first buckle component 10 and the second buckle component 3.

However, the present disclosure is not limited to the aforementioned embodiments. For example, in another embodiment, each shoulder strap buckle can be integrated with the corresponding waist strap buckle to forma one-piece male buckle, and the two first magnetic components can be respectively embedded into on the two one-piece male buckles.

Alternatively, in another embodiment, the crotch strap buckle can be a male buckle, and the two shoulder strap buckles and the two waist strap buckles can be integrally formed with each other to form a one-piece female buckle for mating with the crotch strap buckle, i.e., there can be only one first buckle component which is the one-piece female buckle. Furthermore, the switch can be rotatably disposed on the one-piece female buckle, and the operating component and the latch can be movably disposed on the one-piece female buckle. Besides, there can be only one first magnetic component embedded into the crotch strap buckle and one second magnetic component embedded into the switch for magnetically attracting or repelling the first magnetic component.

In some embodiments, the two first magnetic components 7 and the second magnetic component 8 can be permanent magnets. However, the present disclosure is not limited to the aforementioned embodiments. For example, in another embodiment, the first magnetic component or the second magnetic component can be electromagnets.

In some embodiments, the switch 5 can be a rotator, or any other similar switching component conceivable by those skilled in the art. In some embodiments, the latch 6 can be a lock, or any other similar latching component conceivable by those skilled in the art.

As shown in FIG. 2, FIG. 3 and FIG. 6, the magnetic buckle assembly 100 a further includes two third magnetic components 9. Each third magnetic component 9 is embedded into the corresponding shoulder strap buckle 1 and for magnetically attracting the corresponding first magnetic component 7 embedded into the corresponding waist strap buckle 2 to secure a connection of the corresponding shoulder strap buckle 1 and the corresponding waist strap buckle 2, which makes the connection of the corresponding shoulder strap buckle 1 and the corresponding waist strap buckle 2 more reliable. In some embodiments, the two third magnetic components 9 can be permanent magnets. However, the present disclosure is not limited the aforementioned embodiments. For example, in another embodiment, the third magnetic component can be replaced by a magnetic conductive component, which can be made of iron, cobalt, nickel, gadolinium or alloy thereof, or any other magnetic conductive material. Furthermore, in another embodiment, there can be only one third magnetic component.

Furthermore, in some embodiments, each first magnetic component 7 can be aligned with the corresponding third magnetic component 9 along the lateral direction of the magnetic buckle assembly 100 a when the corresponding shoulder strap buckle 1 is assembled with the corresponding waist strap buckle 2, which ensures a secured connection of the corresponding shoulder strap buckle 1 and the corresponding waist strap buckle 2. However, the present disclosure is not limited to the aforementioned embodiments. For example, in another embodiment, each first magnetic component can be aligned with the corresponding third magnetic component along a front-rear direction of the magnetic buckle assembly.

As shown in FIG. 3, FIG. 4 and FIG. 6, each shoulder strap buckle 1 is stacked above the corresponding waist strap buckle 2 along the front-rear direction of the magnetic buckle assembly 100*a*. When each shoulder strap buckle 1 is stacked above the corresponding waist strap buckle 2, each shoulder strap buckle 1 can be aligned with the waist strap buckle 2 along the lateral direction of the magnetic buckle assembly 100*a*, so that the two first buckle components 10 can be mated with the second buckle component 3 more easily without any interference. Specifically, an engaging portion 21 is formed on each waist strap buckle 2. An engaging arm 102 protrudes from each shoulder strap buckle 1 for engaging with the engaging portion 21, and an outline of each engaging arm 102 matches with an outline of the corresponding engaging portion 21. Each shoulder strap buckle 1 can be aligned with the corresponding waist strap buckle 2 along the lateral direction of the magnetic buckle assembly 100*a* by embedding the corresponding engaging arm 102 into the corresponding engaging portion 21. In some embodiments, the engaging portion 21 can be a recess structure formed on a rear surface of each waist strap buckle 2. However, the present disclosure is not limited to the aforementioned embodiments.

As shown in FIG. 2 and FIG. 3, each first magnetic component 7 can be configured to magnetically attract the second magnetic component 8 during the mating process of the corresponding first buckle component 10 and the second buckle component 3. The operating component 4 can drive the switch 5 to rotate to reverse orientation of the second magnetic component 8 so as to reverse the direction of the magnetic field of the second magnetic component 8 when the operating component 4 is operated to slide, which enables the reversed second magnetic component 8 to magnetically repel the two first magnetic components 7.

Besides, the operating component 4 drives the each latch 6 to disengage from the corresponding first buckle component 10 to allow the separation of the corresponding first buckle component 10 and the second buckle component 3 when the operating component 4 is operated. Therefore, a magnetic repelling force generated by each first magnetic component 7 and the second magnetic component 8 can facilitate each first buckle component 10 to be separated from the second buckle component 3 once the separation of each first buckle component 10 and the second buckle component 3 is allowed, which achieves a purpose of quick mating and separation of each first buckle component 10 and the second buckle component 3.

As shown in FIG. 7 and FIG. 8, specifically, in some embodiments, a first end 71 and a second end 72 of the left first magnetic component 7 can be respectively a south pole (S) and a north pole (N), a first end 73 and a second end 74 of a right one of the right first magnetic component 7 can be respectively a south pole (S) and a north pole (N), and a first end 81 and a second end 82 of the second magnetic component 8 can be respectively be a south pole (S) and a north pole (N). When the operating component 4 is released, the two first magnetic components 7 and the second magnetic component 8 are located at positions as shown in FIG. 7, so that the first end 81 and the second end 82 of the second magnetic component 8 can respectively magnetically attract the second end 72 of the left first magnetic component 7 and the first end 73 of the right first magnetic component 7. When the operating component is operated to slide, the second magnetic component 8 can be driven to rotated by 180 degrees to be located at a position as shown in FIG. 8 around the rotating axis L, so that magnetic poles of the second magnetic component 8 is reversed, i.e., a direction of a magnetic field of the second magnetic component 8 is reversed. At this moment, the first end 81 and the second end 82 of the second magnetic component 8 can respectively magnetically repel the first end 73 of the right first magnetic component 7 and the second end 72 of the left first magnetic component 7. In detailed, during the rotation of the second magnetic component 8 around the rotating axis L, a magnetic attracting force of the second magnetic component 8 acting on the two first magnetic components 7 decreases, and a magnetic repelling force of the second magnetic component 8 acting on the two first magnetic components 7 increases. A resultant magnetic force of the second magnetic component 8 acting on the two first magnetic components 7 is changed from the magnetic attracting force to the magnetic repelling force when the second magnetic component 8 or the switch 5 is rotated over 90 degrees around the rotating axis L.

However, the configurations of the first magnetic component and the second magnetic component are not limited to the aforementioned embodiments. In another embodiment, the first magnetic component can be configured to magnetically repel the second magnetic component during the mating process of the first buckle component and the second buckle component. The operating component can drive the switch to rotate to reverse orientation of the second magnetic component so as to enable the reversed second magnetic component to magnetically attract the first magnetic component when the operating component is operated to slide, which prevents an unintentional separation of first buckle component and the second buckle component. A resultant magnetic force of the second magnetic component acting on the first magnetic component is changed from a magnetic repelling force to a magnetic attracting force when the second magnetic component or the switch is rotated over 90 degrees around the rotating axis L.

As shown in FIG. 2 to FIG. 6, the operating component 4 is movably connected to the switch 5. Specifically, the operating component 4 is slidably disposed on the second buckle component 3. The operating component 4 drives the switch 5 to rotate around the rotating axis L when the operating component 4 is operated to slide relative to the second buckle component 3. In some embodiments, a sliding direction of the operating component 4 can be parallel to the lateral direction of the magnetic buckle assembly 100*a*, and the rotating axis L can be perpendicular to the lateral direction and the front-rear direction of the magnetic buckle assembly 100*a*. In some embodiments, the operating component 4 can be a push button slidably disposed on a lateral wall of the second buckle component 3, so that the operating component 4 is hardly visible for preventing an unintentional touch of a child to enhance safety.

Specifically, a driving structure 10*a* is formed on the operating component 4. A driven structure 11*a* is formed on the switch 5 for cooperating with the driving structure 10*a*, and the operating component 4 drives the switch 5 to rotate around the rotating axis L by cooperation of the driving structure 10*a* and the driven structure 11*a*. In some embodiments, the driving structure 10*a* can be a gear rack structure arranged along the sliding direction of the operating component 4, and the driven structure 11*a* can be a gear wheel structure for rotatably engaging with the gear rack structure. The rotating axis L can coincide with a central axis of the gear wheel structure, and the gearwheel structure is located at an end portion of the switch 5. Therefore, when the operating component 4 is operated to slide, the operating component 4 drives the switch 5 to rotate around the rotating axis L by cooperation of the gear rack structure and the gear wheel structure to reverse the direction of the magnetic field of the second magnetic component 8 to change the direction of the magnetic force of the second magnetic component 8 acting on the two first magnetic components 7.

As shown in FIG. 2, FIG. 3 and FIG. 6, a hollow structure 53 is formed on the switch 5, and the second magnetic component 8 is embedded into the hollow structure 53. Similarly, an embedding chamber 101 is formed on each first buckle component 10. Each first magnetic component 7 is embedded into the corresponding embedding chamber 101. Specifically, each embedding chamber 101 is formed on the corresponding waist strap buckle 2, and each embedding chamber 101 is aligned with the hollow structure 53 along a mating direction of the corresponding first buckle component 10 and the second buckle component 3, so that a magnetic force can be substantially parallel to the mating direction or a separation direction of the corresponding first buckle component 10 and the second buckle component 3 for facilitating the mating or the separation of the corresponding first buckle component 10 and the second buckle component 3.

As shown in FIG. 2, FIG. 3 and FIG. 6, the magnetic buckle assembly 100*a* further includes a first resilient component 13*a* for driving the operating component 4 to recover. Specifically, the first resilient component 13*a* is disposed between the operating component 4 and the second buckle component 3. In some embodiments, the first resilient component 13*a* can be an elastic spring. However, the present disclosure is not limited thereto. Furthermore, a guiding portion 42 is formed on the operating component 4 for resiliently deforming the first resilient component 13*a*, and the first resilient component 13*a* is sheathed on the guiding portion 42, which makes deformation and recovery of the first resilient component 13 a more stable and accelerates the recovery of the first resilient component 13*a*.

As shown in FIG. 3 to FIG. 6, a locking structure 61 is formed on each latch 6, and a locked structure 103 is formed on each first buckle component 10 and for cooperating with the corresponding locking structure 61. Since each latch 6 is slidably disposed on the second buckle component 3, each locking structure 61 engages with or disengages from the corresponding locked structure 103 in a slidable manner. Specifically, the locked structure 103 is formed on each waist strap buckle 2. However, the present disclosure is not limited to the aforementioned embodiments. For example, the locked structure can be formed on the shoulder strap buckle. Alternatively, there can be only one locking structure.

Specifically, a driven cooperating structure 151 is formed on each latch 6, and two driving cooperating structures 141 are formed on the operating component 4 for cooperating with the driven cooperating structures 151 of the two latches 6. The operating component 4 drives each latch 6 to slide by cooperation of the corresponding driving cooperating structure 141 and the corresponding driven cooperating structure 151 to disengage the corresponding locking structure 61 from the corresponding locked structure 103 when the operating component 4 is operated to slide. In some embodiments, each driving cooperating structure 141 can be a first inclined surface structure formed on the operating component 4 and inclined relative to a sliding direction of the corresponding latch 6, and each driven cooperating structure 151 can be a second inclined surface structure. The operating component 4 drives each latch 6 to slide by cooperation of the corresponding first inclined surface structure and the corresponding second inclined surface structure to disengage the corresponding locking structure 61 from the corresponding locked structure 103 when the operating component 4 is operated to slide. However, the numbers of the driving cooperating structure and the driven cooperating structure are not limited to the aforementioned embodiments. It depends on practical demands. For example, in another embodiment, if there is only one latch with one driven cooperating structure, there can be only one driving cooperating structure formed on the operating component accordingly.

As shown in FIG. 3 to FIG. 6, the magnetic buckle assembly 100 a further includes two second resilient components 16 for driving the two latches 6 to recover. Specifically, each second resilient component 16 is disposed between the corresponding latch 6 and the second buckle component 3 to bias the locking structure 61 to engage with the locked structure 103. In some embodiments, the second resilient component 16 can be an elastic spring. However, the number and the configuration of the second resilient component 16 are not limited to the aforementioned embodiments. For example, in another embodiment, if there is only one latch, there can be only one second resilient component 16 accordingly.

Furthermore, a guiding structure 62 is formed on each latch for resiliently deforming the corresponding second resilient component 16, and each second resilient component 16 is sheathed on the corresponding guiding structure 62, which makes deformation and recovery of each second resilient component 16 more stable.

Figure 9:
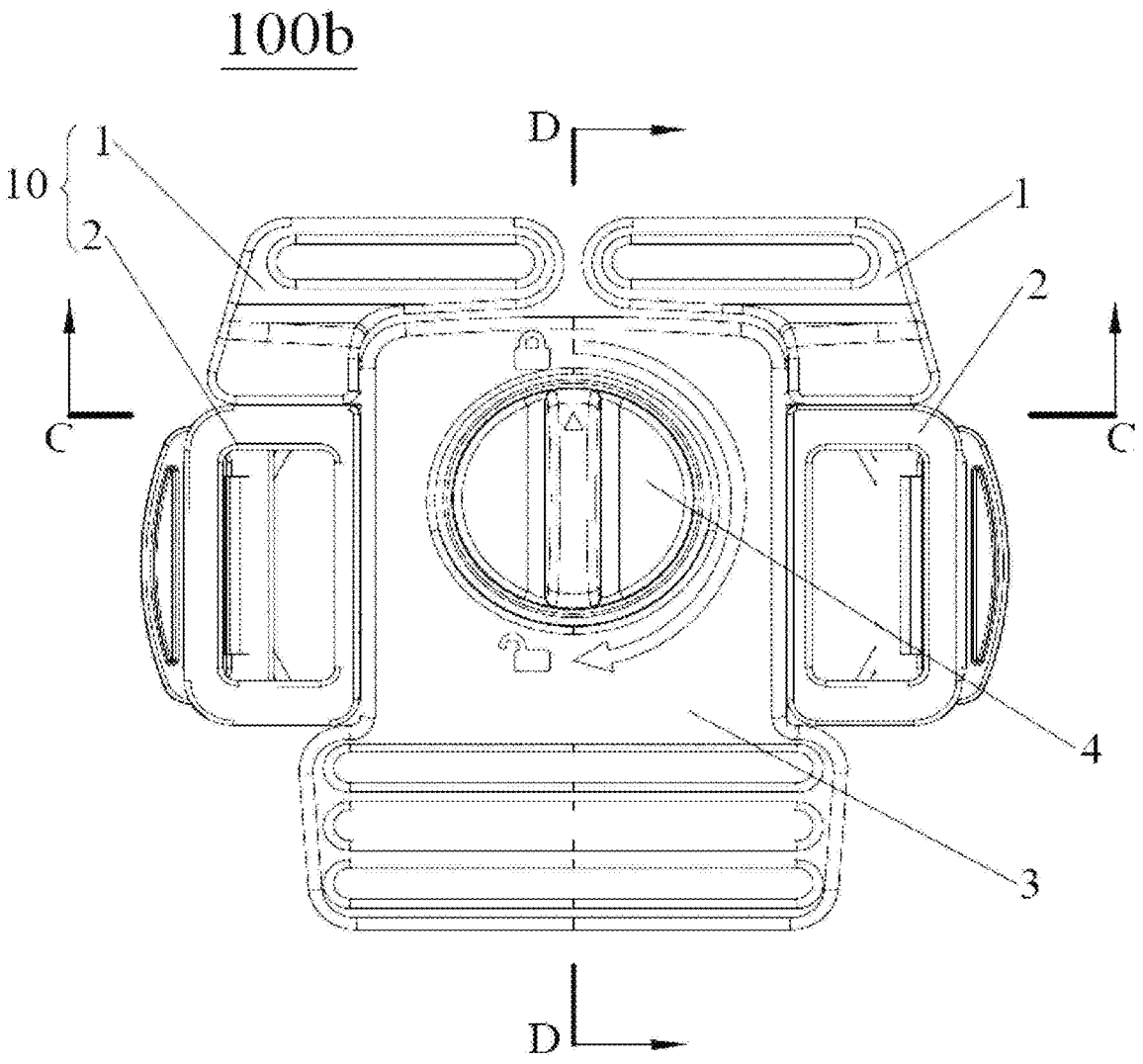
FIG. 9 is a front view diagram of a magnetic buckle assembly according to some embodiments of the present disclosure.
Figure 10:
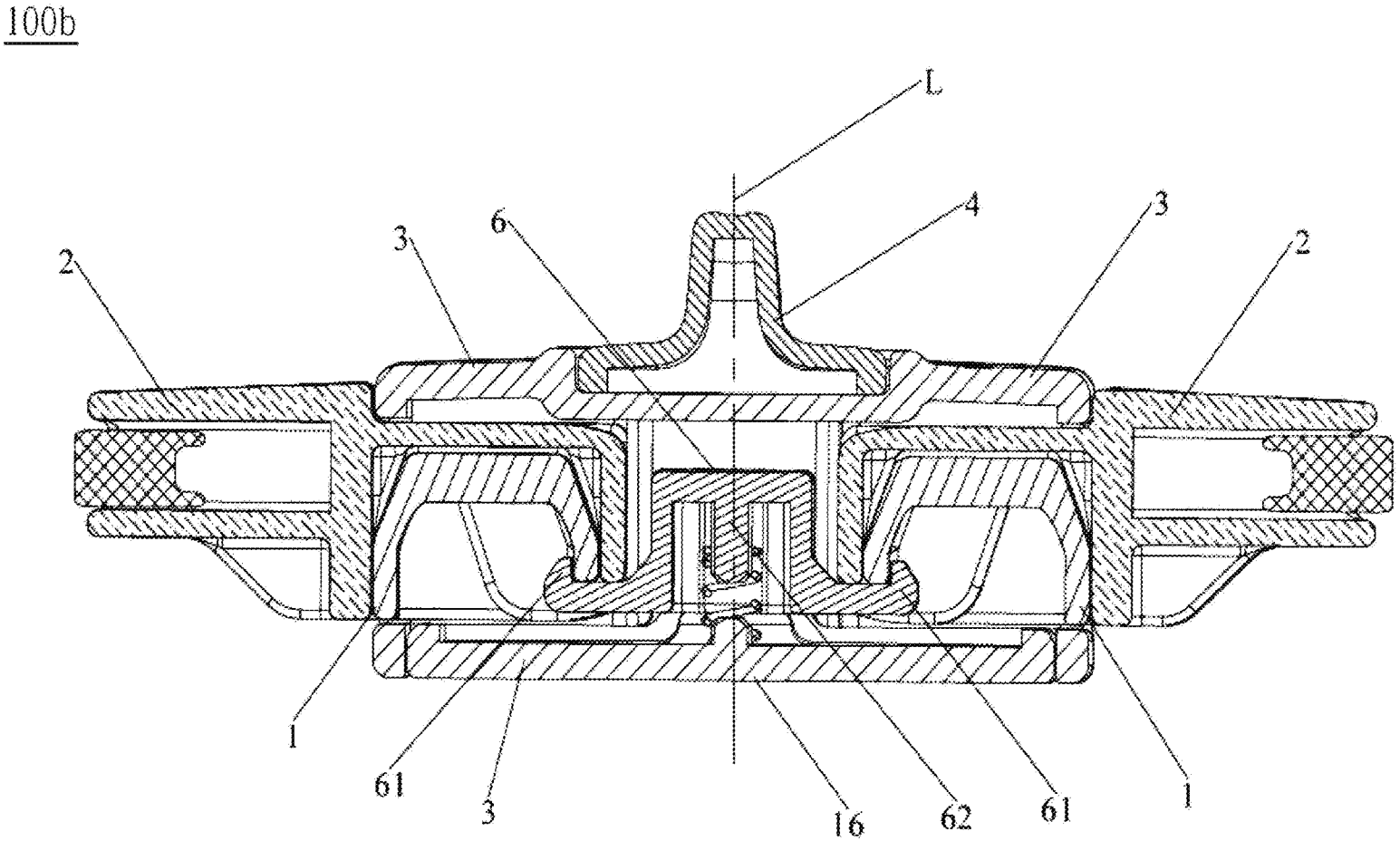
FIG. 10 is a sectional diagram of the magnetic buckle assembly along a C-C line shown in FIG. 9 according to some embodiments of the present disclosure.
Figure 11:
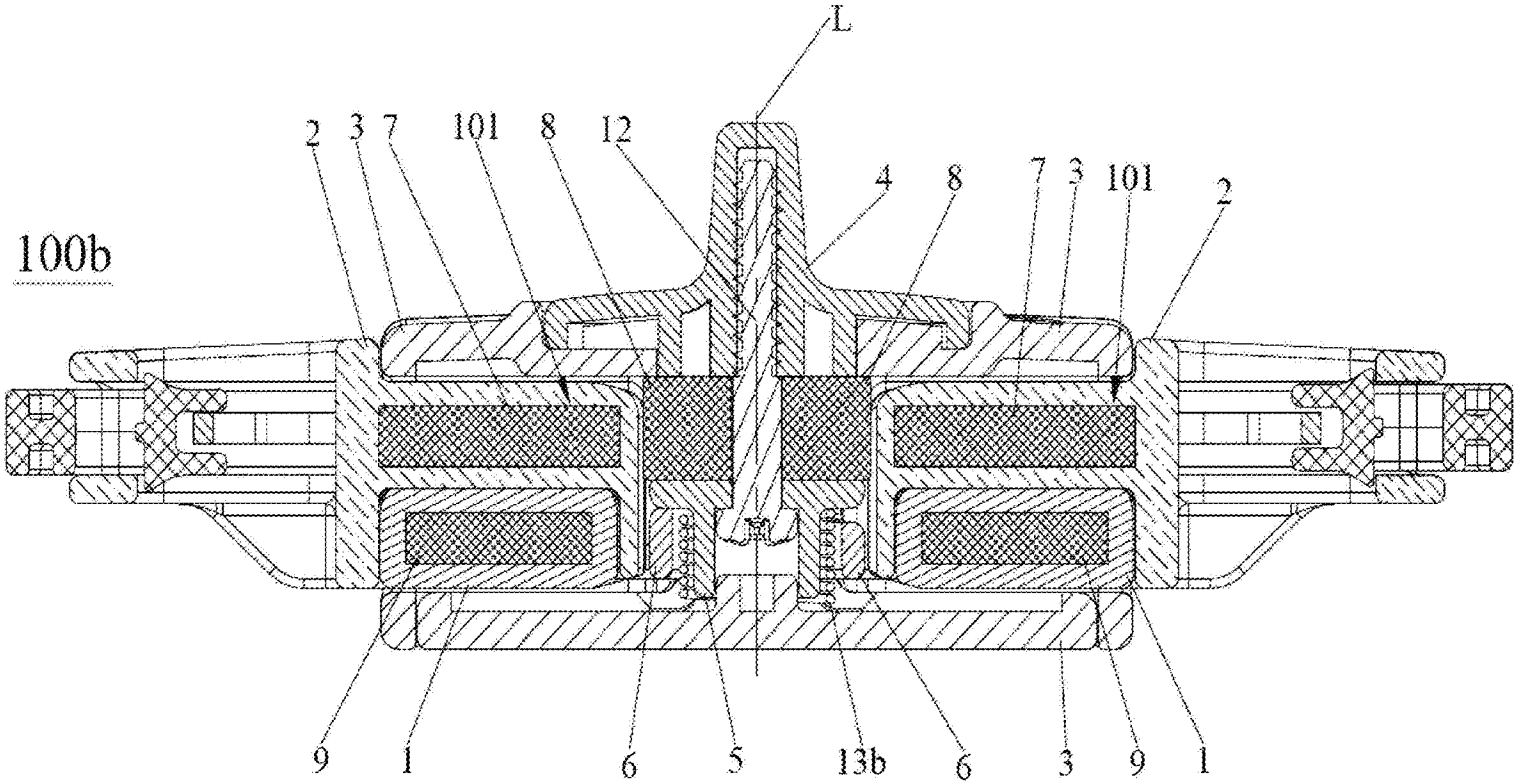
FIG. 11 is a sectional diagram of the magnetic buckle assembly along a D-D line shown in FIG. 9 according to some embodiments of the present disclosure.
Figure 12:
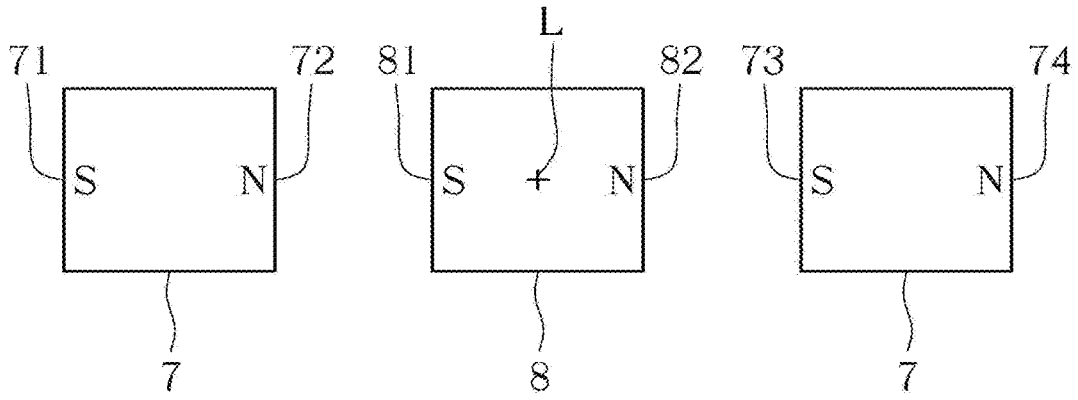
FIG. 12 to FIG. 14 are diagrams of the two first magnetic components and the second magnetic component in different states according to some embodiments of the present disclosure.
Figure 13:
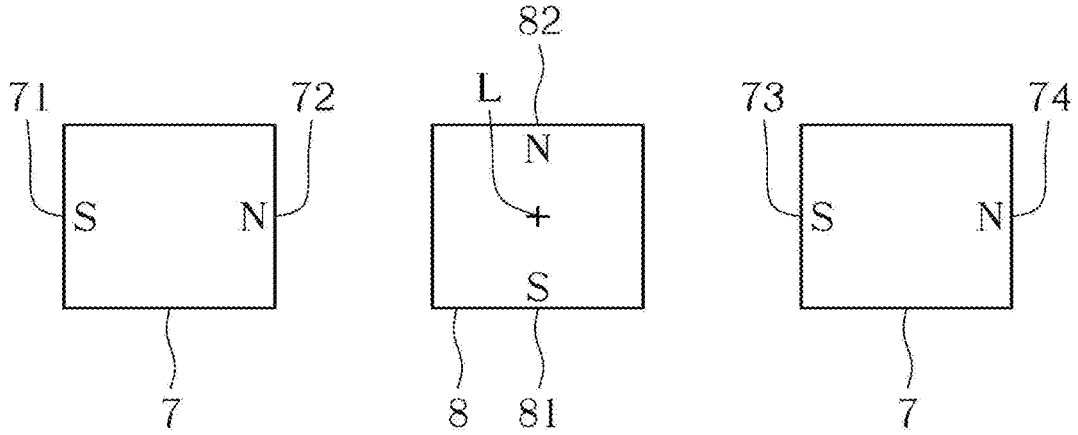
Figure 14:
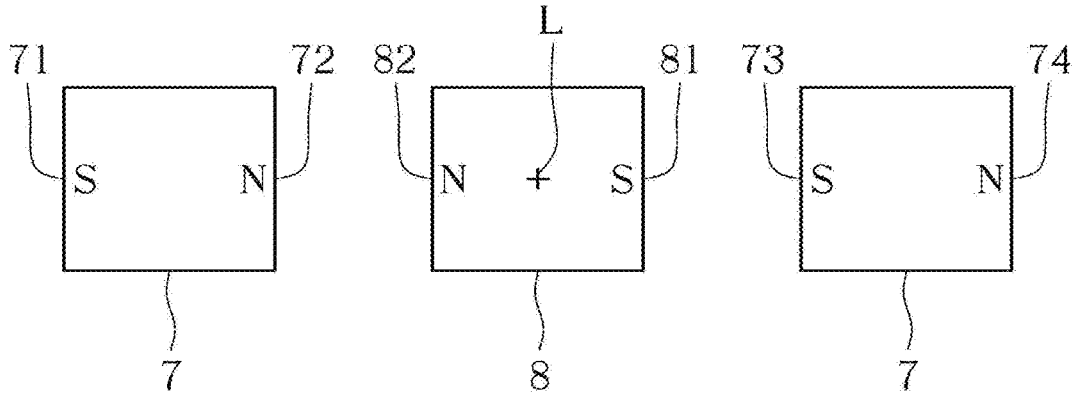
Figure 15:
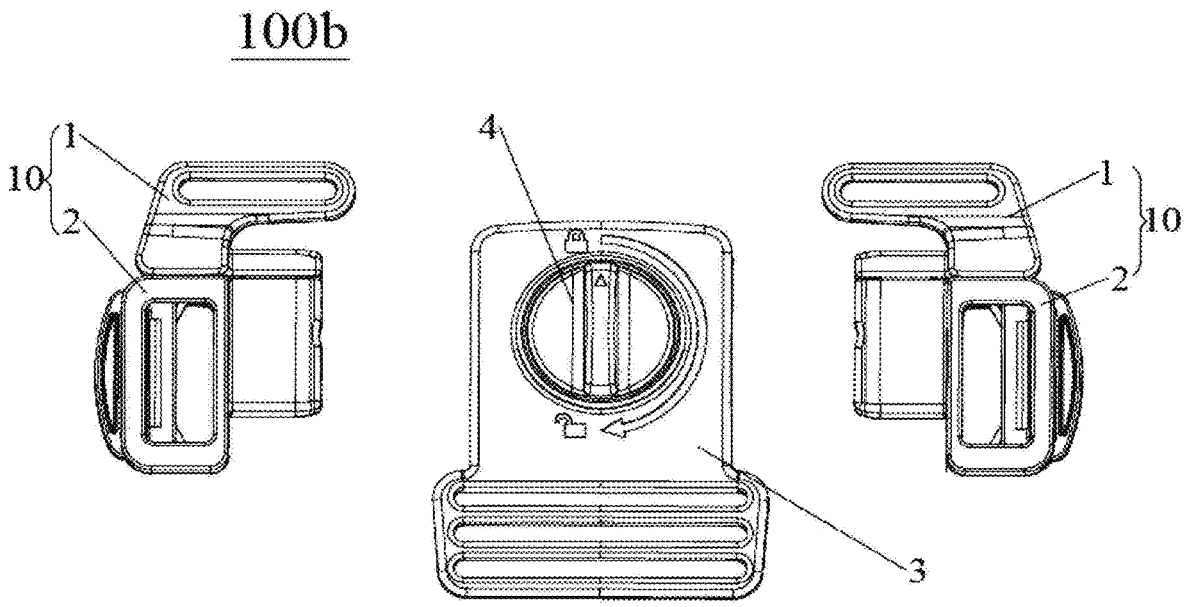
FIG. 15 is a diagram of the magnetic buckle assembly as two first buckle components are detached according to some embodiments of the present disclosure.
Figure 16:
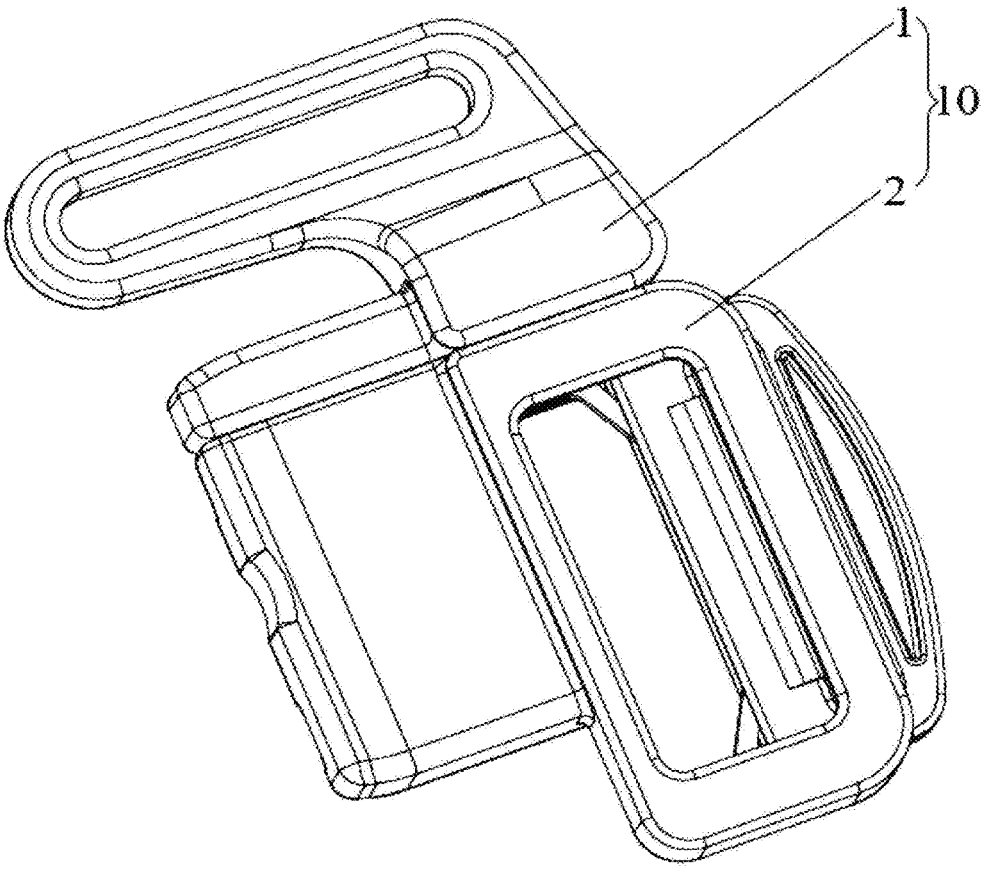
FIG. 16 and FIG. 17 are diagrams of the first buckle component at different views according to some embodiments of the present disclosure.
Figure 17:
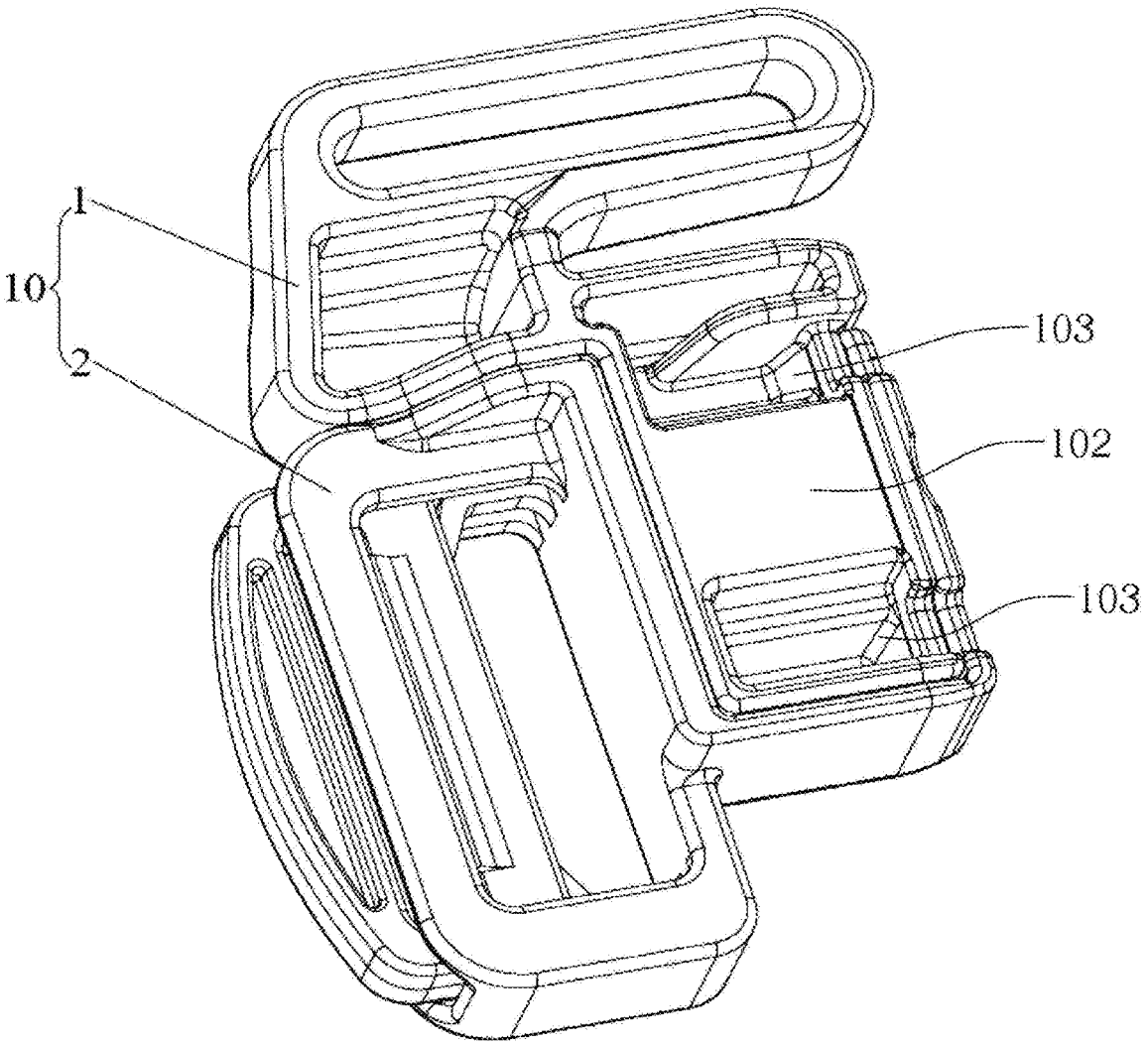
Figure 18:
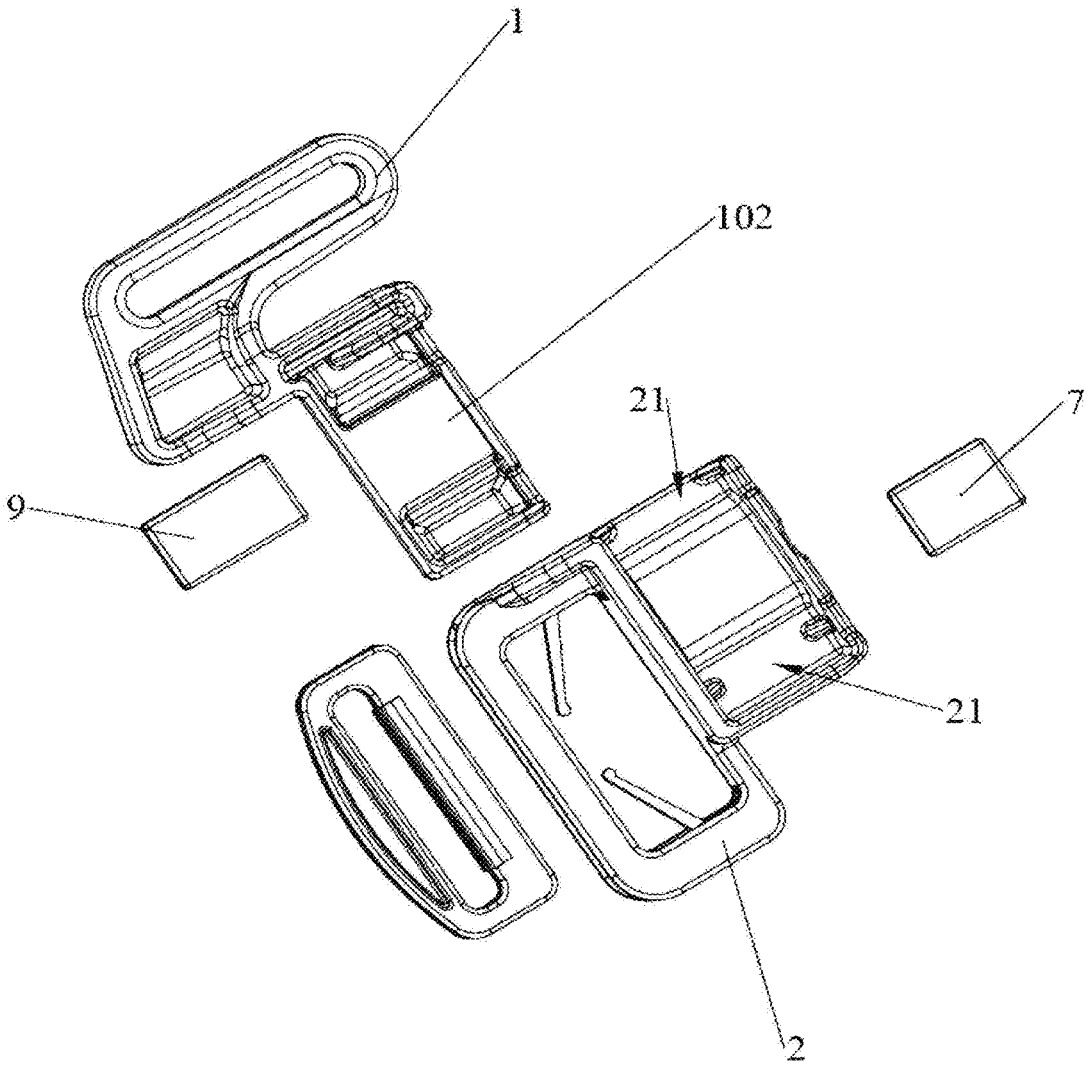
FIG. 18 is an exploded diagram of the first buckle component according to some embodiments of the present disclosure.
Figure 19:
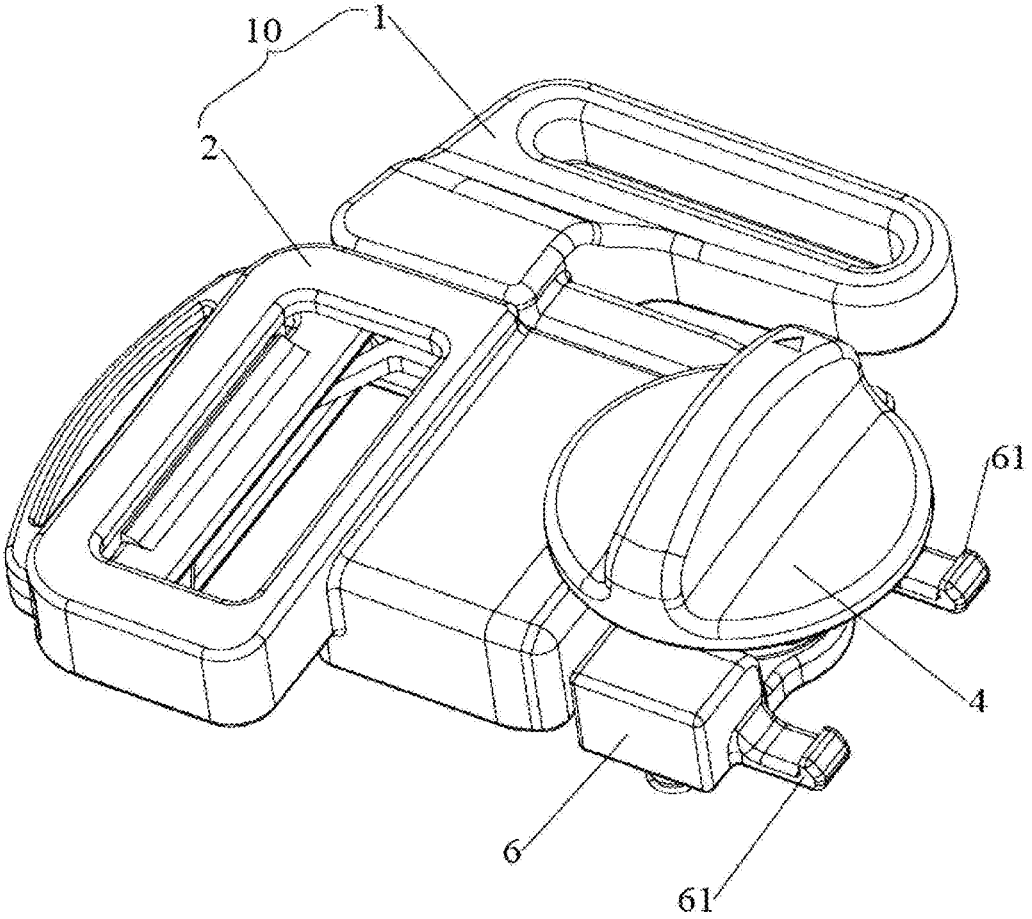
FIG. 19 and FIG. 20 are partial diagrams of the magnetic buckle assembly according to some embodiments of the present disclosure.
Figure 20:
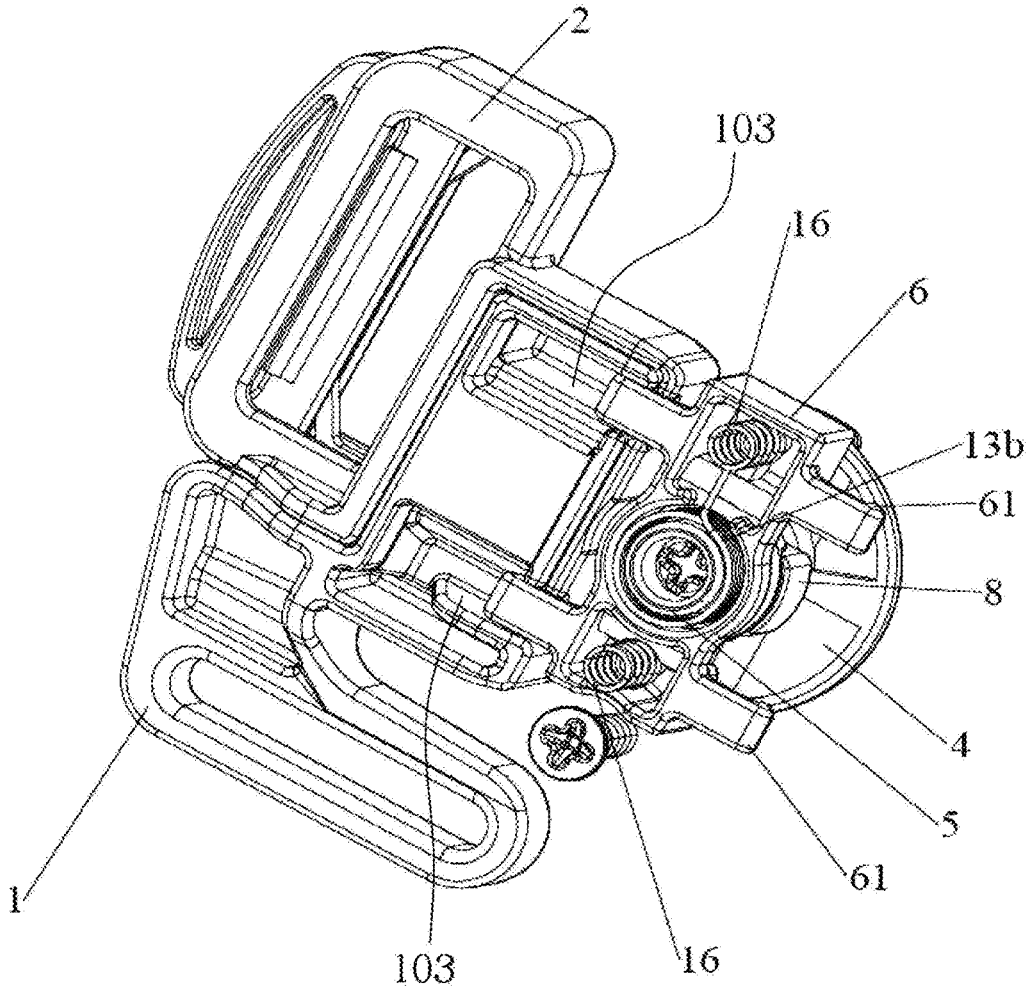
Figure 21:
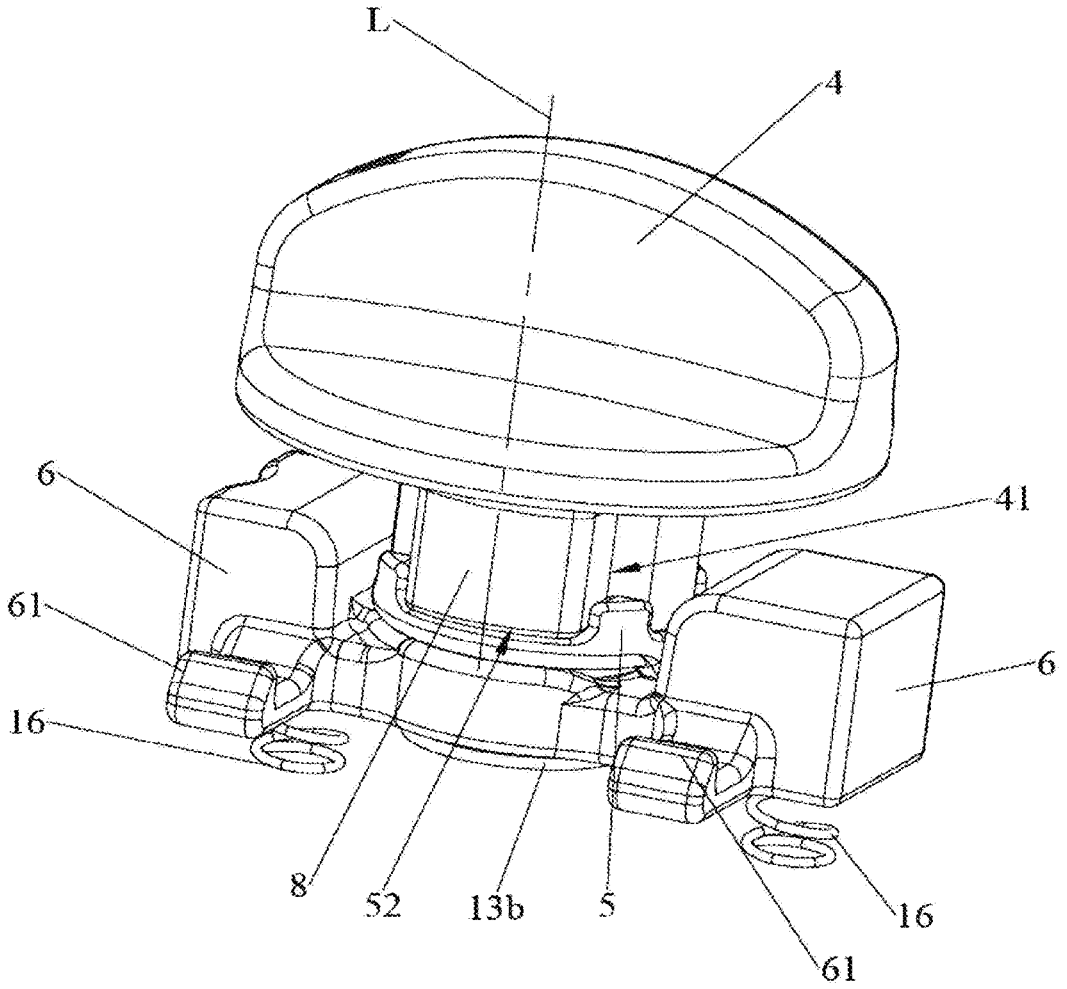
FIG. 21 is another partial diagram of the magnetic buckle assembly according to some embodiments of the present disclosure.
Figure 22:
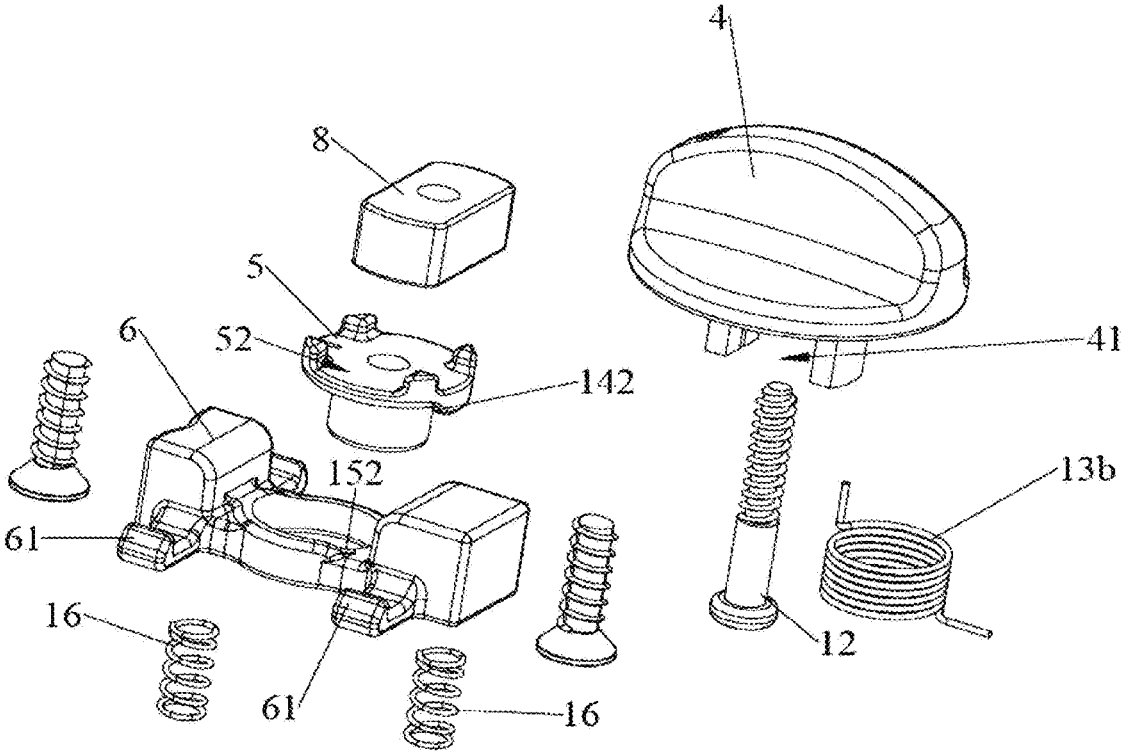
FIG. 22 is a partial exploded diagram of the magnetic buckle assembly according to some embodiments of the present disclosure.

Please refer to FIG. 9 to FIG. 22. FIG. 9 is a front view diagram of a magnetic buckle assembly 100*b* according to some embodiments of the present disclosure. FIG. 10 is a sectional diagram of the magnetic buckle assembly 100*b* along a C-C line shown in FIG. 9 according to some embodiments of the present disclosure. FIG. 11 is a sectional diagram of the magnetic buckle assembly 100*b* along a D-D line shown in FIG. 9 according to some embodiments of the present disclosure. FIG. 12 to FIG. 14 are diagrams of the two first magnetic components 7 and the second magnetic component 8 in different states according to some embodiments of the present disclosure. FIG. 15 is a diagram of the magnetic buckle assembly 100*b* as the two first buckle components are detached according to some embodiments of the present disclosure. FIG. 16 and FIG. 17 are diagrams of the first buckle component 10 at different views according to some embodiments of the present disclosure. FIG. 18 is an exploded diagram of the first buckle component 10 according to some embodiments of the present disclosure. FIG. 19 and FIG. 20 are partial diagrams of the magnetic buckle assembly 100*b* according to some embodiments of the present disclosure. FIG. 21 is another partial diagram of the magnetic buckle assembly 100*b* according to some embodiments of the present disclosure. FIG. 22 is a partial exploded diagram of the magnetic buckle assembly 100*b* according to some embodiments of the present disclosure. The difference between the magnetic buckle assembly 100*a* and the magnetic buckle assembly 100*b* is provided as follows.

Firstly, as shown in FIG. 10, FIG. 11 to FIG. 14, in some embodiments, the rotating axis L is arranged along a front-rear direction of the magnetic buckle assembly 100*b*. On the other hand, in some embodiments, the rotating axis L is arranged along a direction perpendicular to the lateral direction and the front-rear direction of the magnetic buckle assembly 100*a*.

As shown in FIG. 12 to FIG. 14, specifically, in some embodiments, the first end 71 and the second end 72 of the left first magnetic components 7 can be respectively a south pole (S) and a north pole (N), the first end 73 and the second end 74 of the right first magnetic component 7 can be respectively a south pole (S) and a north pole (N), and the first end 81 and the second end 82 of the second magnetic component 8 can be respectively be a south pole (S) and a north pole (N). When the operating component 4 is released, the two first magnetic components 7 and the second magnetic component 8 are located at positions as shown in FIG. 12, so that the first end 81 and the second end 82 of the second magnetic component 8 can respectively magnetically attract the second end 72 of the left first magnetic component 7 and the first end 73 of the right first magnetic component 7. When the operating component is operated to slide, the second magnetic component 8 can be driven to rotated by 180 degrees to be located at a position as shown in FIG. 14 around the rotating axis L, so that magnetic poles of the second magnetic component 8 is reversed, i.e., a direction of a magnetic field of the second magnetic component 8 is reversed. At this moment, the first end 81 and the second end 82 of the second magnetic component 8 can respectively magnetically repel the first end 73 of the right first magnetic component 7 and the second end 72 of the left first magnetic component 7. In detailed, during the rotation of the second magnetic component 8 around the rotating axis L from the position as shown in FIG. 12 to the position as shown in FIG. 14, the magnetic attracting force of the second magnetic component 8 acting on the two first magnetic components 7 decreases, and the magnetic repelling force of the second magnetic component 8 acting on the two first magnetic components 7 increases. The resultant magnetic force of the second magnetic component 8 acting on the two first magnetic components 7 is changed from the magnetic attracting force to the magnetic repelling force when the second magnetic component 8 or the switch 5 is rotated over 90 degrees around the rotating axis L, i.e., the second magnetic component 8 is rotated over a position as shown in FIG. 13.

Figure 23:
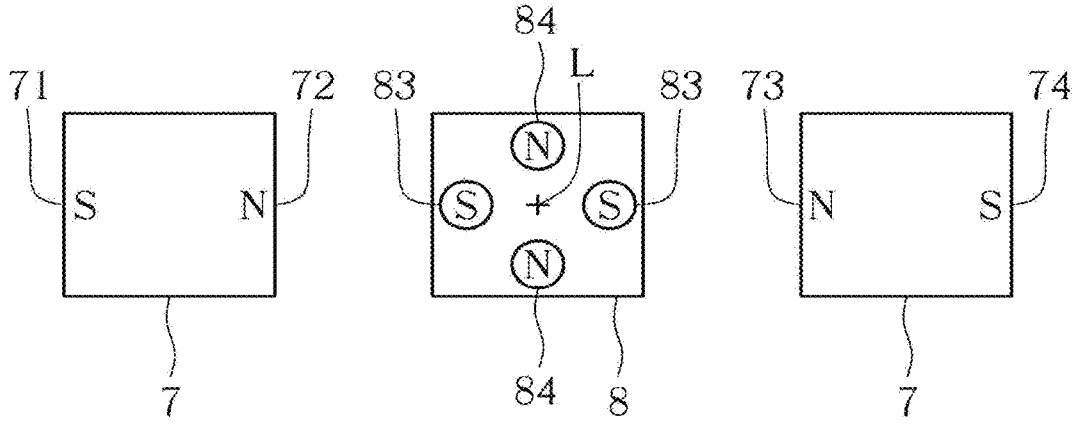
FIG. 23 to FIG. 25 are diagrams of the two first magnetic components and the second magnetic component in different states according to another embodiment of the present disclosure.
Figure 24:
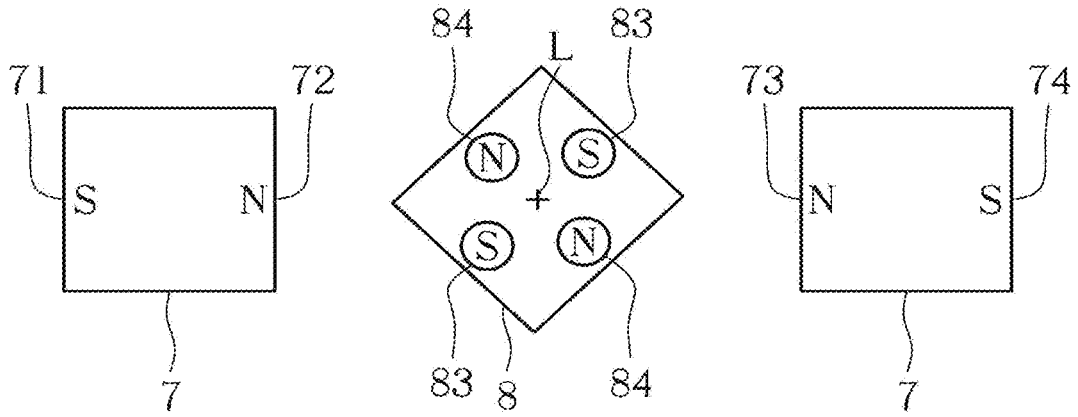
Figure 25:
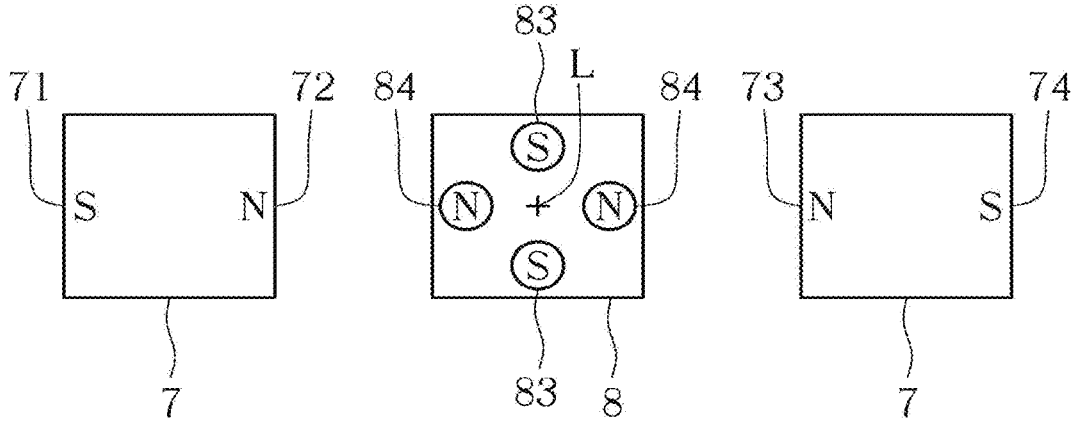

However, the present disclosure is not limited to the aforementioned embodiments. Please refer to FIG. 23 to FIG. 25. FIG. 23 to FIG. 25 are diagrams of the two first magnetic components 7 and the second magnetic component 8 in different states according to another embodiment of the present disclosure. As shown in FIG. 23 to FIG. 25, in some embodiments, the first end 71 and the second end 72 of the left first magnetic component 7 can be respectively a south pole (S) and a north pole (N), and the first end 73 and the second end 74 of the right first magnetic component 7 can be respectively a north pole (N) and a south pole (S). The second magnetic component 8 can be arranged with two attracting portions 83 opposite to each other and two repelling portions 84 opposite to each other. A line between the two attracting portions 83 can be perpendicular to a line between the two repelling portions 84. The two attracting portions 83 and the two repelling portions 84 can be two south poles (S) and two north poles (N). When the operating component 4 is released, the two first magnetic components 7 and the second magnetic component 8 are located at positions as shown in FIG. 23, so that the attracting portions 83 of the second magnetic component 8 located at 3 and 9 o'clock directions can respectively magnetically attract the second end 72 of the left first magnetic component 7 and the first end 73 of the right first magnetic component 7. When the operating component is operated to slide, the second magnetic component 8 can be driven to rotated by 90 degrees to be located at a position as shown in FIG. 25 around the rotating axis L, so that a direction of a magnetic force of the second magnetic component 8 acting on the two first magnetic components 7 is changed. At this moment, the repelling portions 84 of the second magnetic component 8 can respectively magnetically repel the first end 73 of the right first magnetic component 7 and the second end 72 of the left first magnetic component 7. In detailed, during the rotation of the second magnetic component 8 around the rotating axis L from the position as shown in FIG. 23 to the position as shown in FIG. 25, the magnetic attracting force of the second magnetic component 8 acting on the two first magnetic components 7 decreases, and the magnetic repelling force of the second magnetic component 8 acting on the two first magnetic components 7 increases. The direction of the resultant magnetic force of the second magnetic component 8 acting on the two first magnetic components 7 is changed when the second magnetic component 8 or the switch 5 is rotated over 45 degrees, i.e., the second magnetic component 8 is rotated over a position as shown in FIG. 24.

Figure 26:
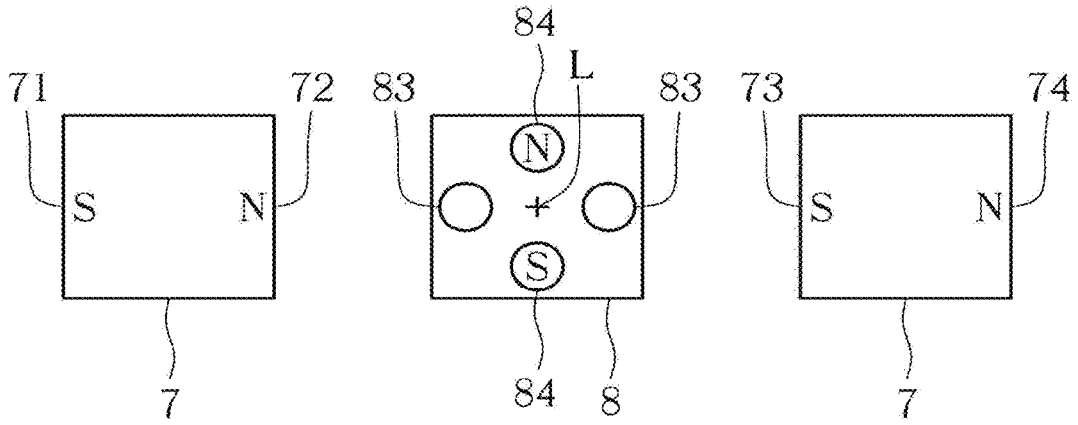
FIG. 26 to FIG. 28 are diagrams of the two first magnetic components and the second magnetic component in different states according to another embodiment of the present disclosure.
Figure 27:
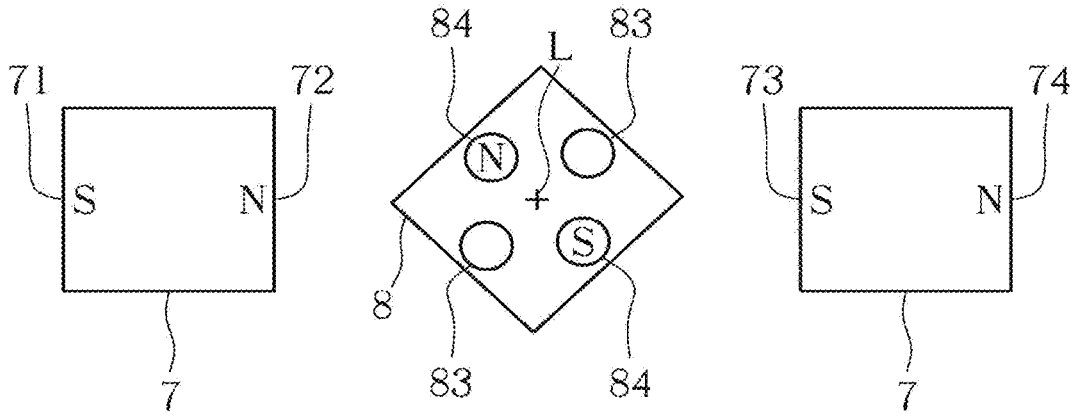
Figure 28:
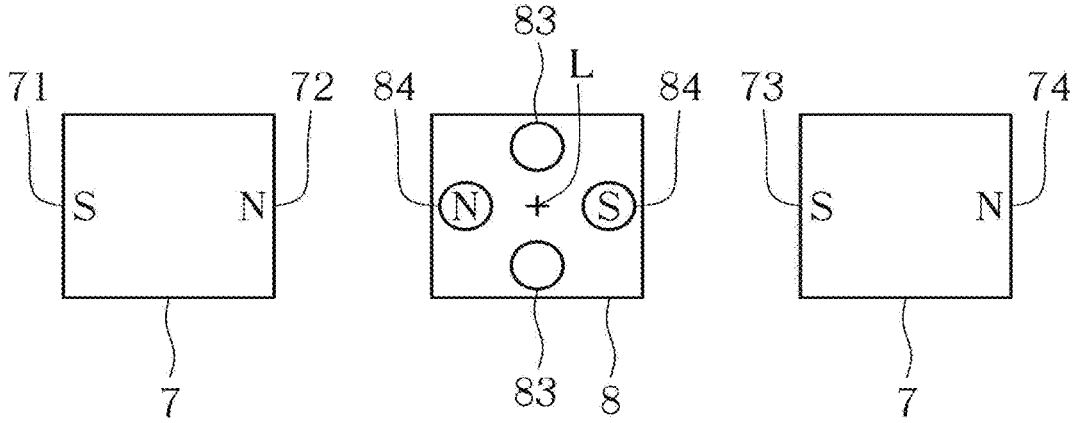

Please further refer to FIG. 26 to FIG. 28. FIG. 26 to FIG. 28 are diagrams of the two first magnetic components 7 and the second magnetic component in different states according to another embodiment of the present disclosure. As shown in FIG. 26 to FIG. 28, in some embodiments, the first end 71 and the second end 72 of the left first magnetic component 7 can be respectively a south pole (S) and a north pole (N), and the first end 73 and the second end 74 of the right first magnetic component 7 can be respectively a south pole (S) and a north pole (N). The second magnetic component 8 can be arranged with two attracting portions 83 opposite to each other and two repelling portions 84 opposite to each other. A line between the two attracting portions 83 can be perpendicular to a line between the two repelling portions 84. The two attracting portions 83 can be made of magnetic conductive material, and the two repelling portions 84 can be a north pole (N) and a south pole (S). When the operating component 4 is released, the two first magnetic components 7 and the second magnetic component 8 are located at positions as shown in FIG. 26, so that the attracting portions 83 of the second magnetic component 8 located at 3 and 9 o'clock directions can respectively magnetically attract the second end 72 of the left first magnetic component 7 and the first end 73 of the right first magnetic component 7. When the operating component is operated to slide, the second magnetic component 8 can be driven to rotated by 90 degrees to be located at a position as shown in FIG. 28 around the rotating axis L, so that the direction of the magnetic force of the second magnetic component 8 acting on the two first magnetic components 7 is changed. At this moment, the repelling portions 84 of the second magnetic component 8 can respectively magnetically repel the first end 73 of the right first magnetic component 7 and the second end 72 of the left first magnetic component 7. In detailed, during the rotation of the second magnetic component 8 around the rotating axis L from the position as shown in FIG. 26 to the position as shown in FIG. 28, the magnetic attracting force of the second magnetic component 8 acting on the two first magnetic components 7 decreases, and the magnetic repelling force of the second magnetic component 8 acting on the two first magnetic components 7 increases. The direction of the resultant magnetic force of the second magnetic component 8 acting on the two first magnetic components 7 is changed when the second magnetic component 8 or the switch 5 is rotated over 45 degrees, i.e., the second magnetic component 8 is rotated over a position as shown in FIG. 27.

Secondly, as shown in FIG. 9 to FIG. 11 and FIG. 15, in some embodiments, the operating component 4 is rotatably disposed on a front wall of the second buckle component 3 and can be a rotary knob. On the other hand, in the magnetic buckle assembly 100 a of the aforementioned embodiments, the operating component 4 is slidably disposed on the lateral wall of the second buckle component 3 and can be a push button.

Thirdly, as shown in FIG. 9 to FIG. 11 and FIG. 21, in some embodiments, the operating component 4 and the switch 5 are fixedly connected to each other, so that the operating component 4 can drive the switch 5 to rotate around the rotating axis L when the operating component 4 is operated to rotate. Specifically, in some embodiments, a connecting chamber 41 is formed on the operating component 4 and includes a connecting opening facing toward the switch 5, and the second magnetic component 8 is partially located inside the connecting chamber 41. An end portion of the switch 5 covers the connecting opening. Furthermore, the magnetic buckle assembly 100*b* further includes a connecting component 12 connected to the operating component 4 and the switch 5 along the rotating axis L. In some embodiments, the connecting component 12 can be a screw member. However, the present disclosure is not limited to thereto. For example, the connecting component can be a rivet or a pin. An accommodating chamber 52 is formed on the end portion of the switch 5. The accommodating chamber 52 includes an accommodating opening facing toward the connecting chamber 41 and communicated with the connecting chamber 41, and the connecting chamber 41 and the accommodating chamber 52 cooperatively accommodate the second magnetic component 8. On the other hand, in the magnetic buckle assembly 100*a* of the aforementioned embodiments, the operating component 4 is operated to slide to drive the switch 5 to rotate, and the second magnetic component 8 is embedded into the hollow structure 53 formed on the switch 5.

Fourthly, as shown in FIG. 10, FIG. 11, FIG. 20 and FIG. 22, in some embodiments, a first resilient component 13*b* is disposed between the switch 5 and the second buckle component 3 to bias the switch 5 to drive the operating component 4 to recover. The first resilient component 13*b* can be a torsional spring sheathed on the switch 5 and located between the switch 5 and the latch 6. On the other hand, in the magnetic buckle assembly 100*a* of the aforementioned embodiments, the first resilient component 13*a* can be the elastic spring disposed between the operating component 4 and the second buckle component 3.

Fifthly, as shown in FIG. 10, FIG. 11 and FIG. 16 to FIG. 19, in some embodiments, each locked structure 103 is formed on the corresponding shoulder strap buckle 1. On the other hand, in the magnetic buckle assembly 100*a* of the aforementioned embodiments, each locked structure 103 is formed on the corresponding waist strap buckle 2.

Sixthly, as shown in FIG. 10, FIG. 11, FIG. 21 and FIG. 22, in some embodiments, the latch 6 is linked to the switch 5, so that the operating component 4 can drive the latch 6 to allow the separation of each first buckle component 10 and the second buckle component 3 by the switch 5 indirectly when the operating component 4 is operated to drive the switch 5 to rotate to reverse the orientation of the second magnetic component 8, so as to reverse the direction of the magnetic field of the second magnetic component 8. Specifically, a driven cooperating structure 152 is formed on the latch 6, and a driving cooperating structure 142 is formed on the switch 5. More specifically, the driving cooperating structure 142 is located at the end portion of the switch 5 facing toward the latch 6. The latch 6 is slidably disposed on the second buckle component 3. The switch 5 rotates to drive the latch 6 to slide by cooperation of the driving cooperating structure 142 and the driven cooperating structure 152 to disengage the locking structures 61 formed on the latch 6 from the locked structures 103 formed on the shoulder strap buckles 2. The driving cooperating structure 142 can be a first helical surface structure, and a central axis of the first helical surface structure can coincide with the rotating axis L. The driven cooperating structure 152 can be a second helical surface structure. When the switch 5 rotates, the switch 5 drives the latch to slide by cooperation of the first helical surface structure and the second helical surface structure to disengage the locking structures 61 formed on the latch 6 from the locked structures 103 formed on the shoulder strap buckles 2. However, the present disclosure is not limited to the aforementioned embodiments. For example, in another embodiment, the driven cooperating structure can be a first helical surface structure, and the driving cooperating structure can be a protrusion slidable along the first helical surface structure. Alternatively, in another embodiment, the driving cooperating structure can be a first helical surface structure, and the driven cooperating structure can be a protrusion slidable along the first helical surface structure, so that the switch can drive the latch to slide by cooperation of the first helical surface structure and the protrusion when the switch is rotated. On the other hand, in the magnetic buckle assembly 100 a of the aforementioned embodiments, the latch 6 is linked to the operating component 4. The operating component drives the latch by the cooperation of the driving cooperating structure 141, i.e., the first inclined surface structure, formed on the operating component 4 and the driven cooperating structure 151, i.e., the second inclined surface, formed on the latch 6 to drive the locking structure 61 to disengage from the locked structure 103.

Seventhly, as shown in FIG. 10 and FIG. 11, in some embodiments, the first magnetic component 7 is aligned with the third magnetic component 9 along the front-rear direction of the magnetic buckle assembly 100*b*. On the other hand, in the magnetic buckle assembly 100*a* of the aforementioned embodiments, the first magnetic component is aligned with the third magnetic component 9 along the lateral direction of the magnetic buckle assembly 100*a*.

Other structures of the magnetic buckle assembly 100*b* are similar to the ones of the magnetic buckle assembly 100*a*. Detailed description thereof is omitted herein for simplicity.

Figure 29:
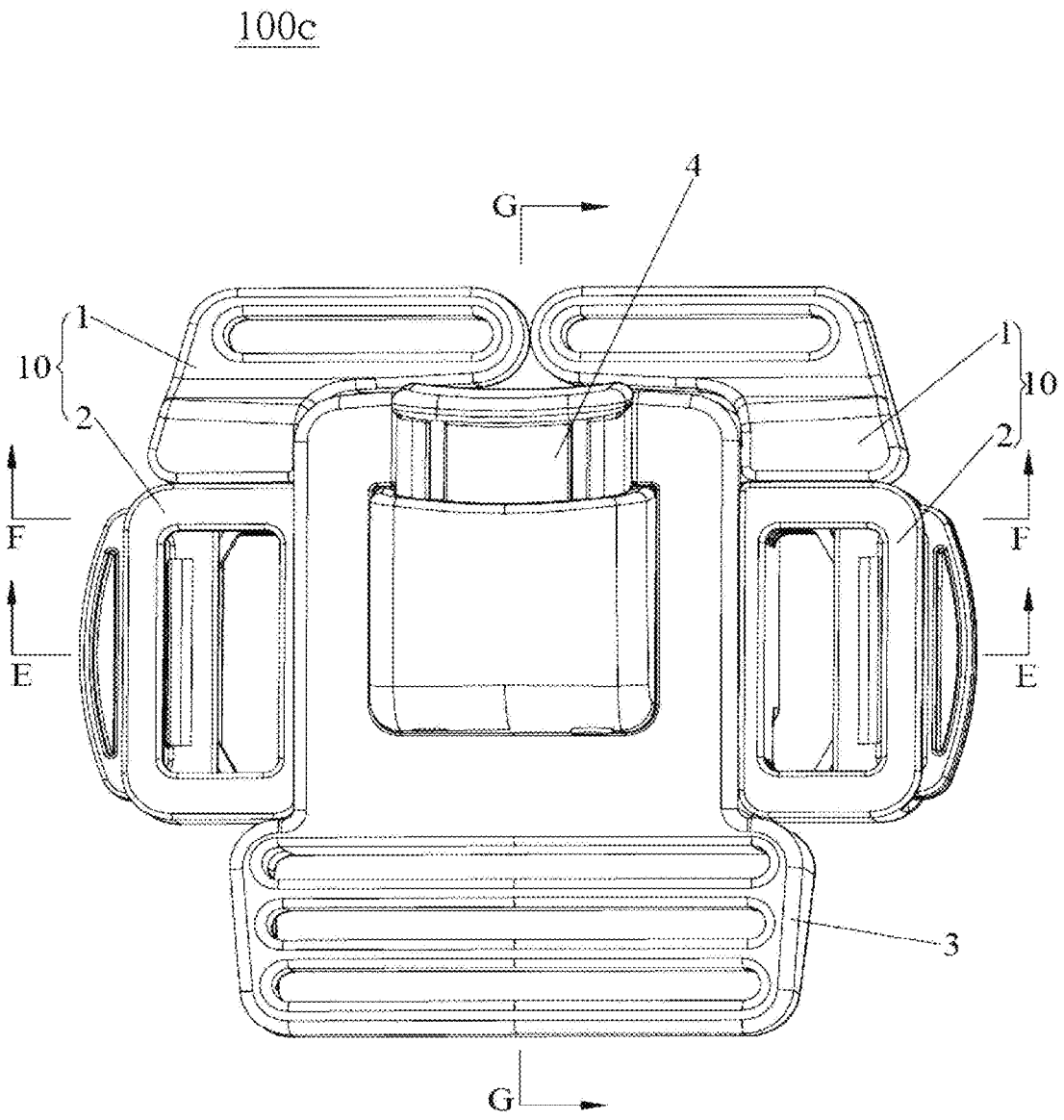
FIG. 29 is a front view diagram of a magnetic buckle assembly according to some embodiments of the present disclosure.
Figure 30:
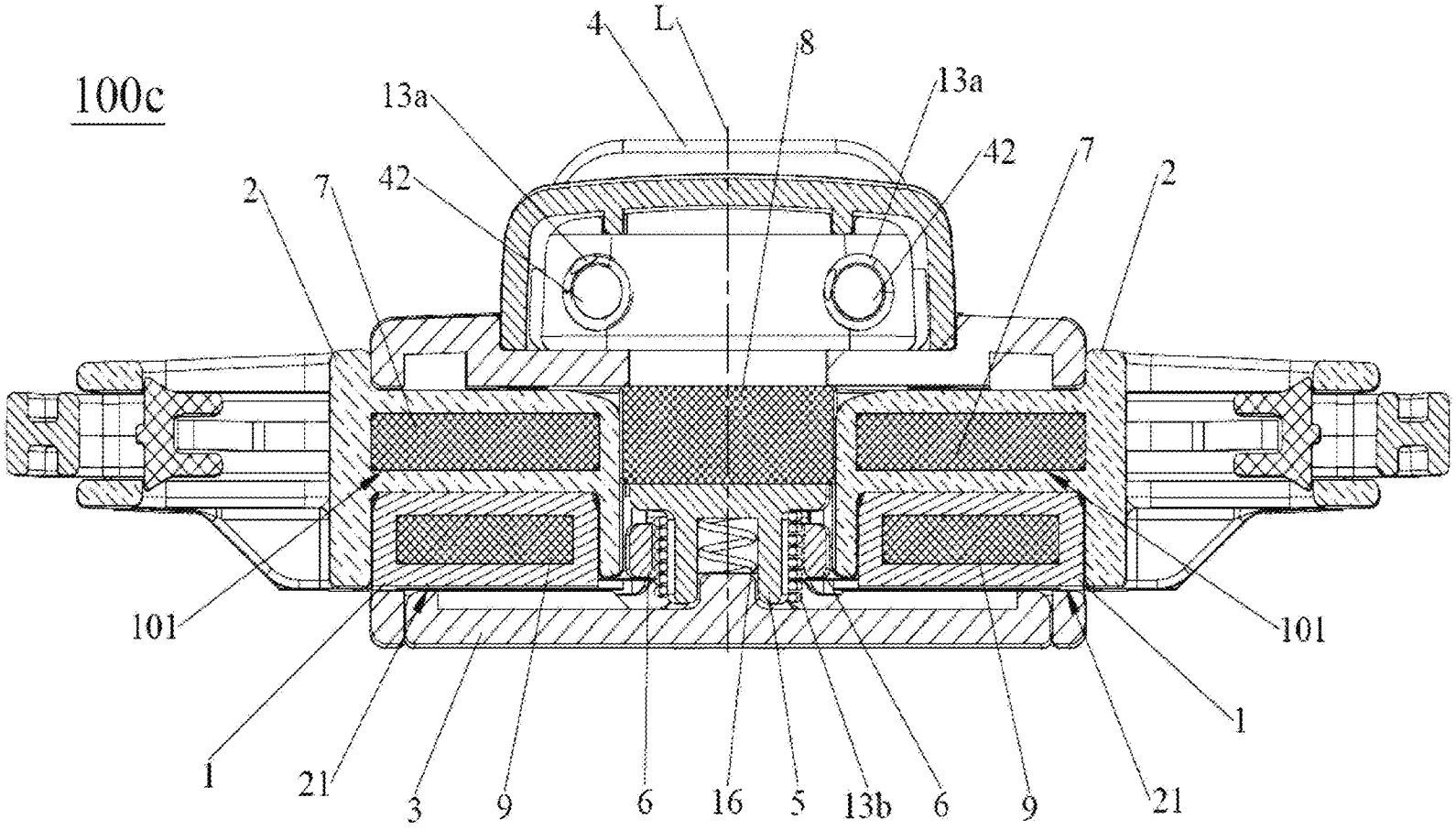
FIG. 30 is a sectional diagram of the magnetic buckle assembly along an E-E line shown in FIG. 29 according to some embodiments of the present disclosure.
Figure 31:
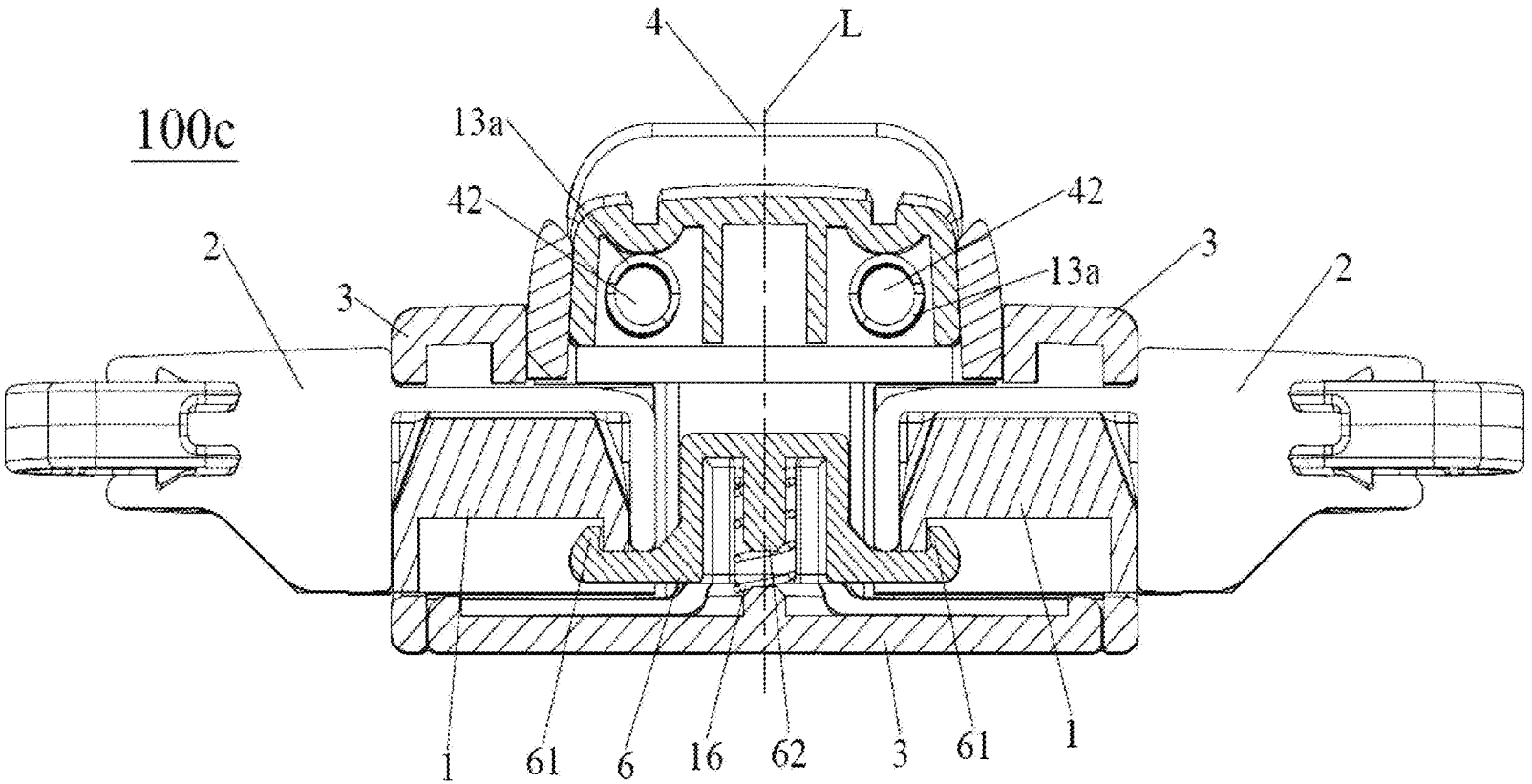
FIG. 31 is a sectional diagram of the magnetic buckle assembly along an F-F line shown in FIG. 29 according to some embodiments of the present disclosure.
Figure 32:
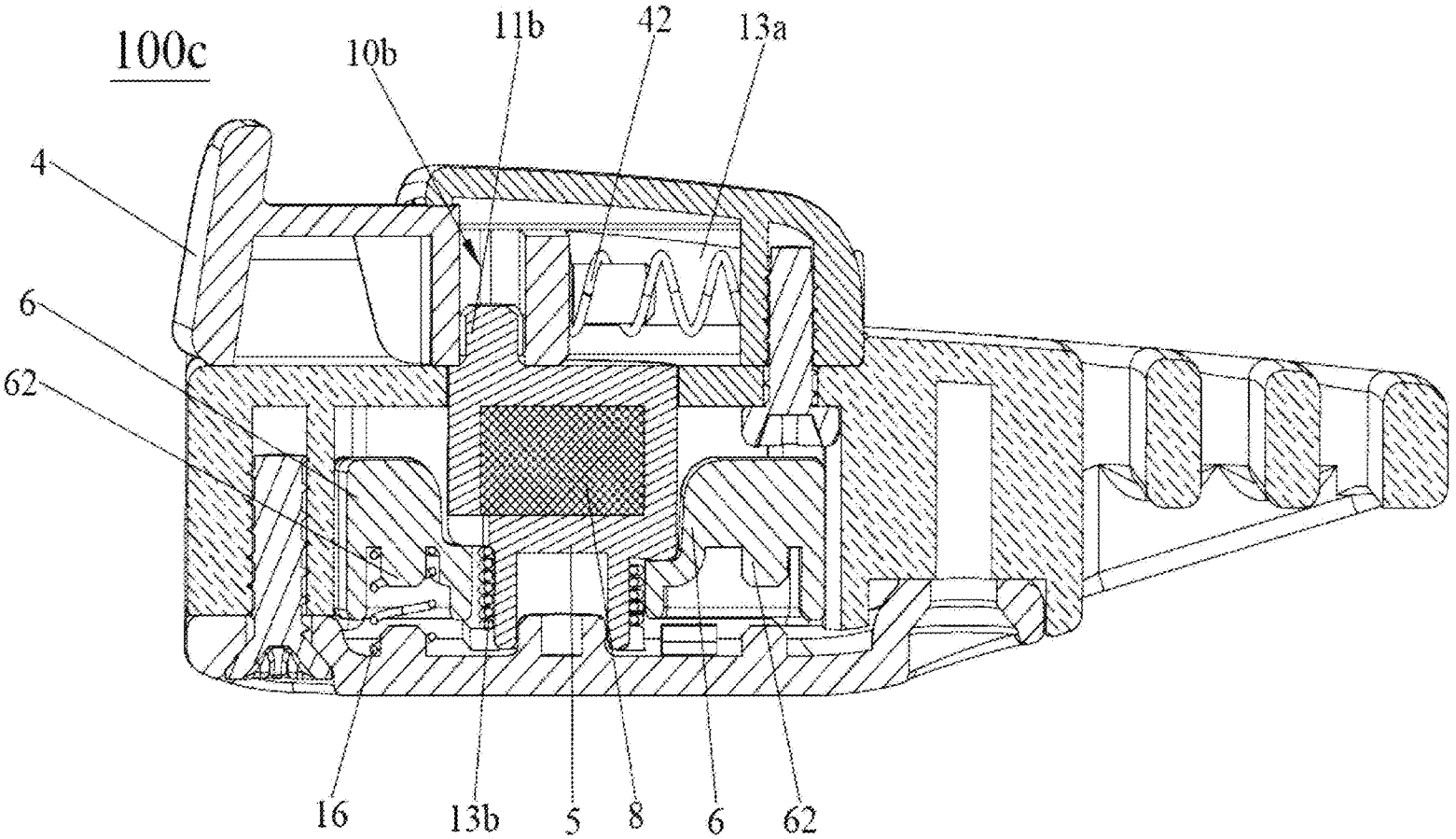
FIG. 32 is a sectional diagram of the magnetic buckle assembly along a G-G line shown in FIG. 29 according to some embodiments of the present disclosure.
Figure 33:
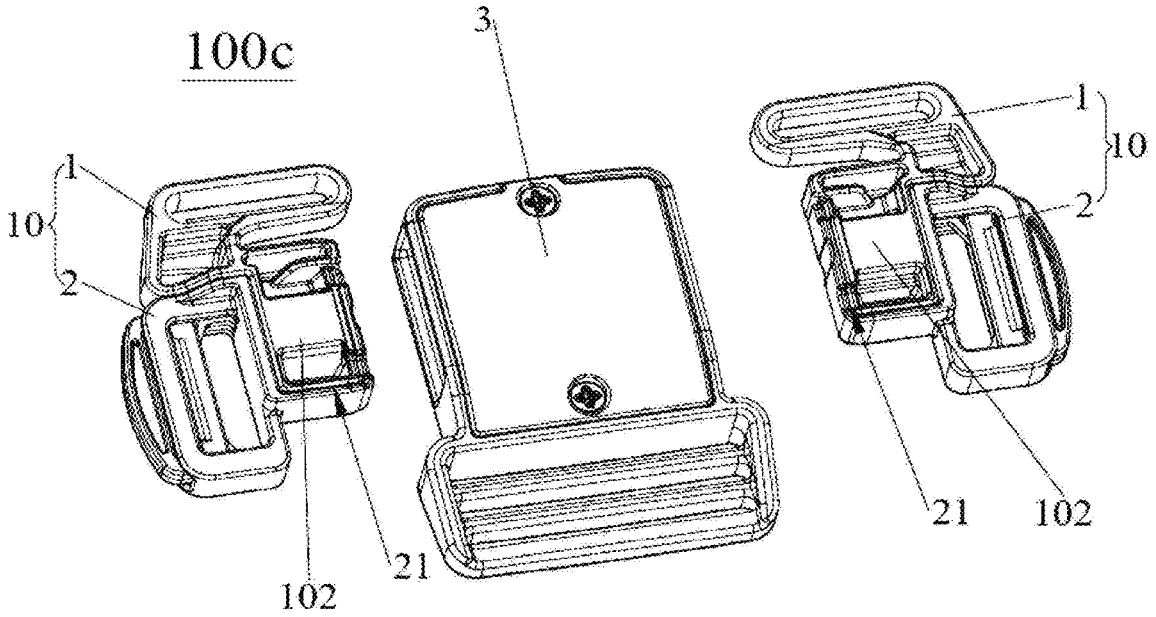
FIG. 33 and FIG. 34 are diagrams of the magnetic buckle assembly at different views as two first buckle components are detached according to some embodiments of the present disclosure.
Figure 34:
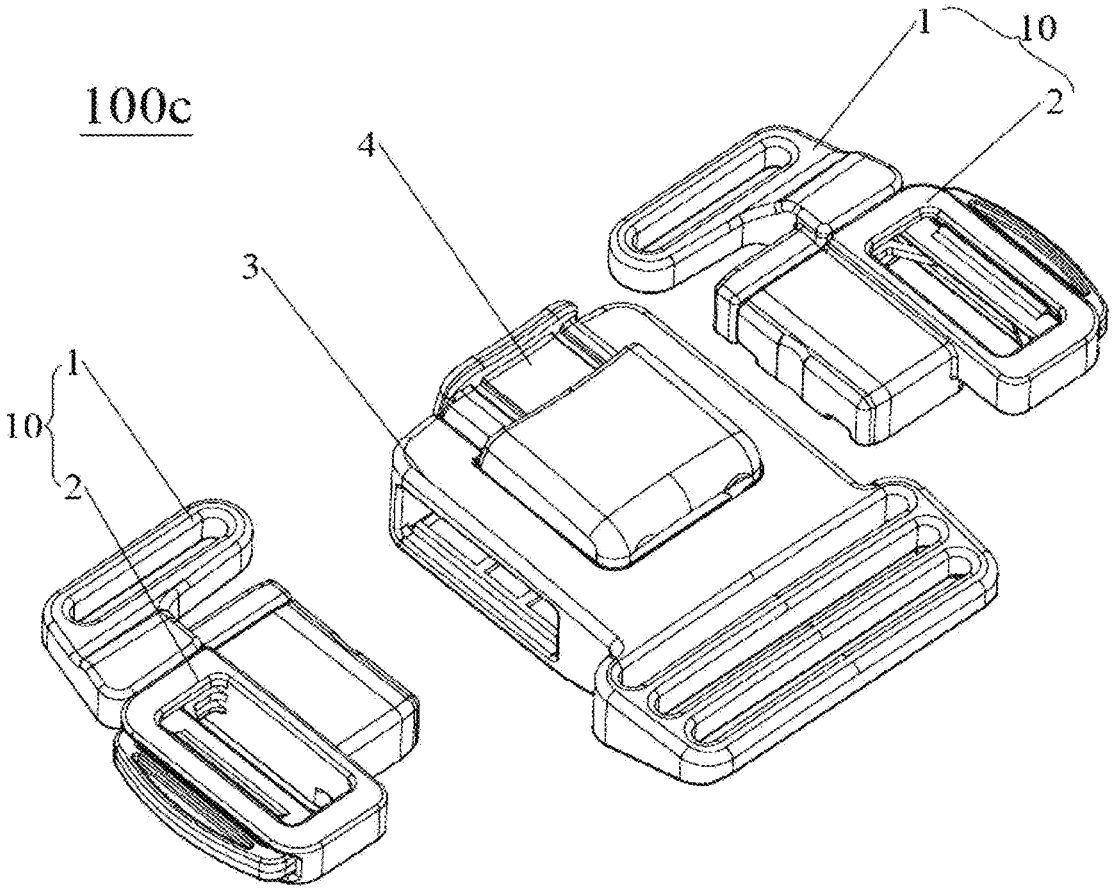
Figure 35:
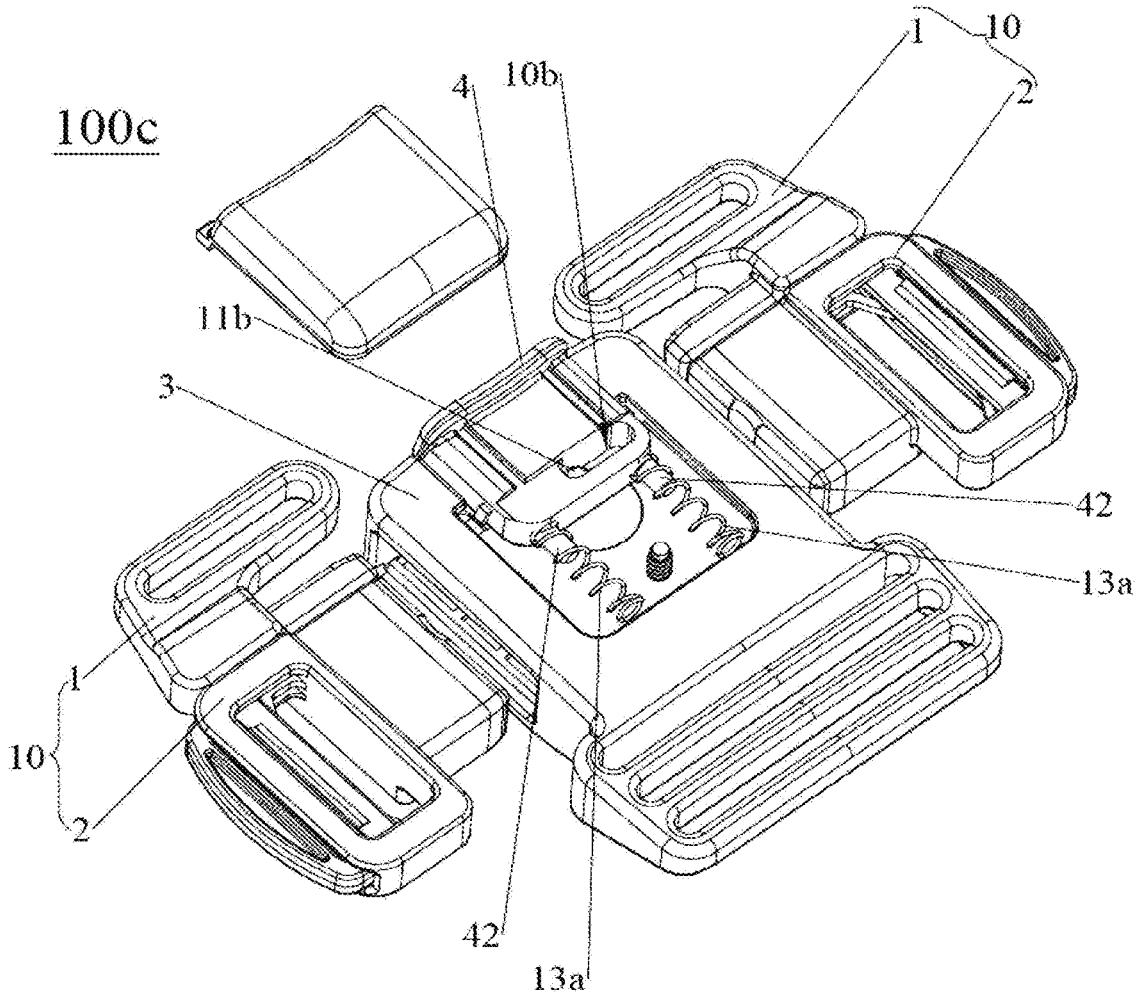
FIG. 35 is a diagram of the magnetic buckle assembly as the two first buckle components and a cover of a second buckle component are detached according to some embodiments of the present disclosure.
Figure 36:
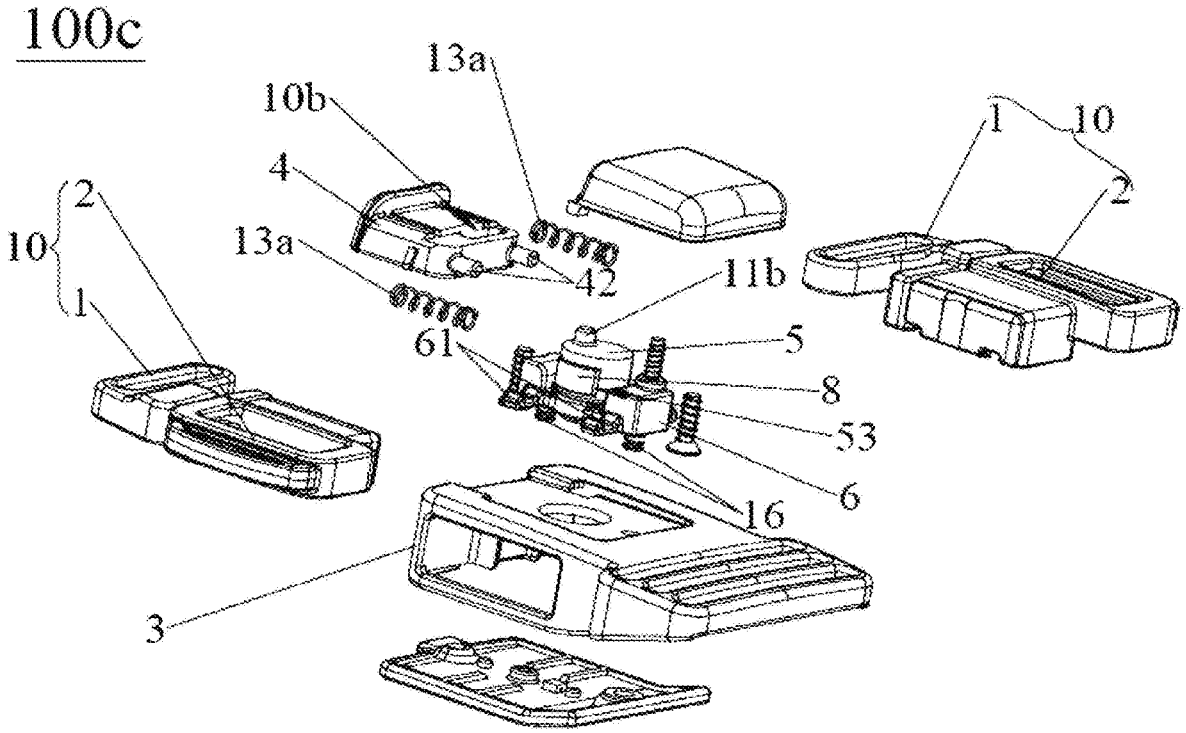
FIG. 36 is an exploded diagram of the magnetic buckle assembly according to some embodiments of the present disclosure.
Figure 37:
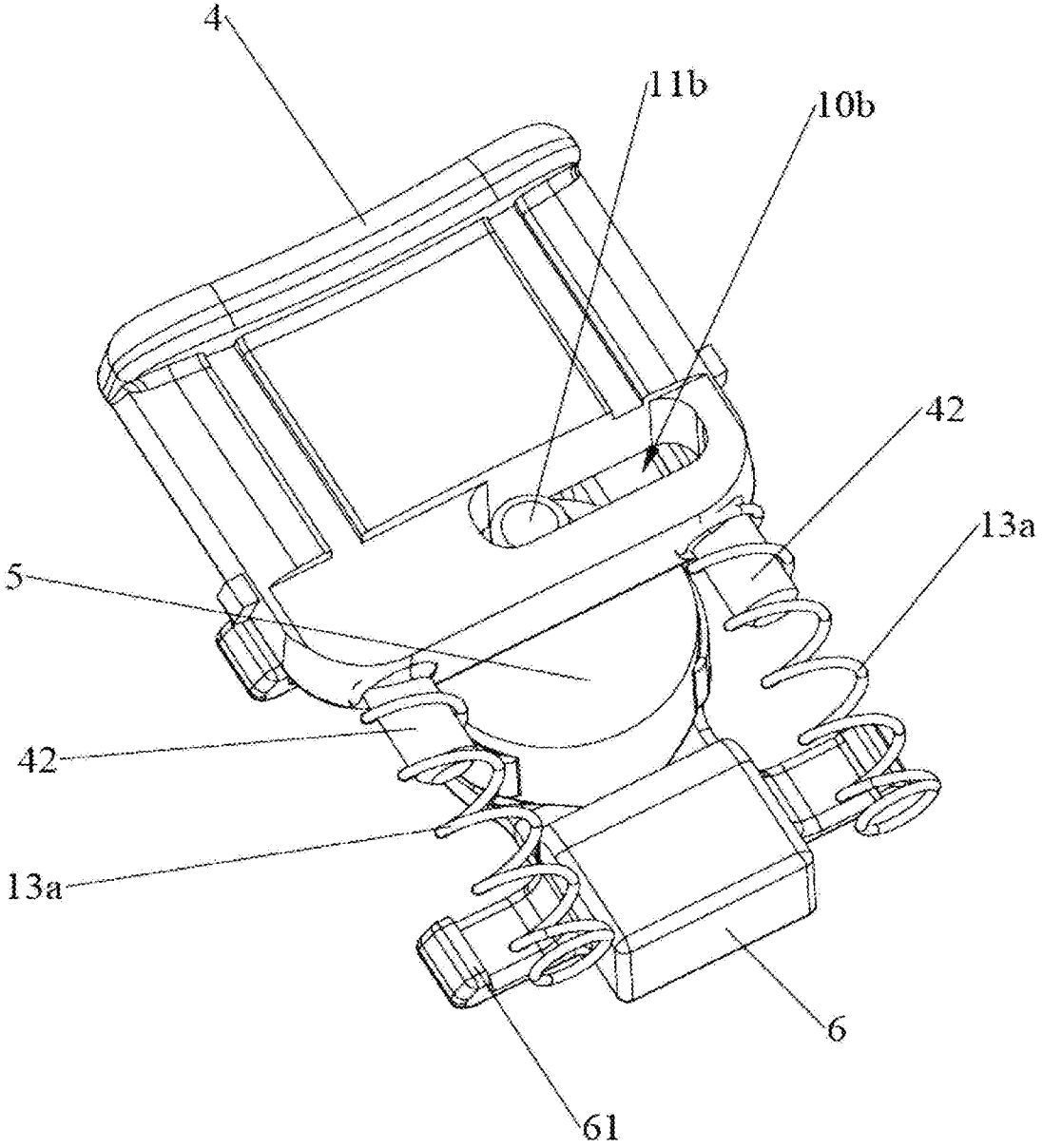
FIG. 37 is a partial diagram of the magnetic buckle assembly according to some embodiments of the present disclosure.
Figure 38:
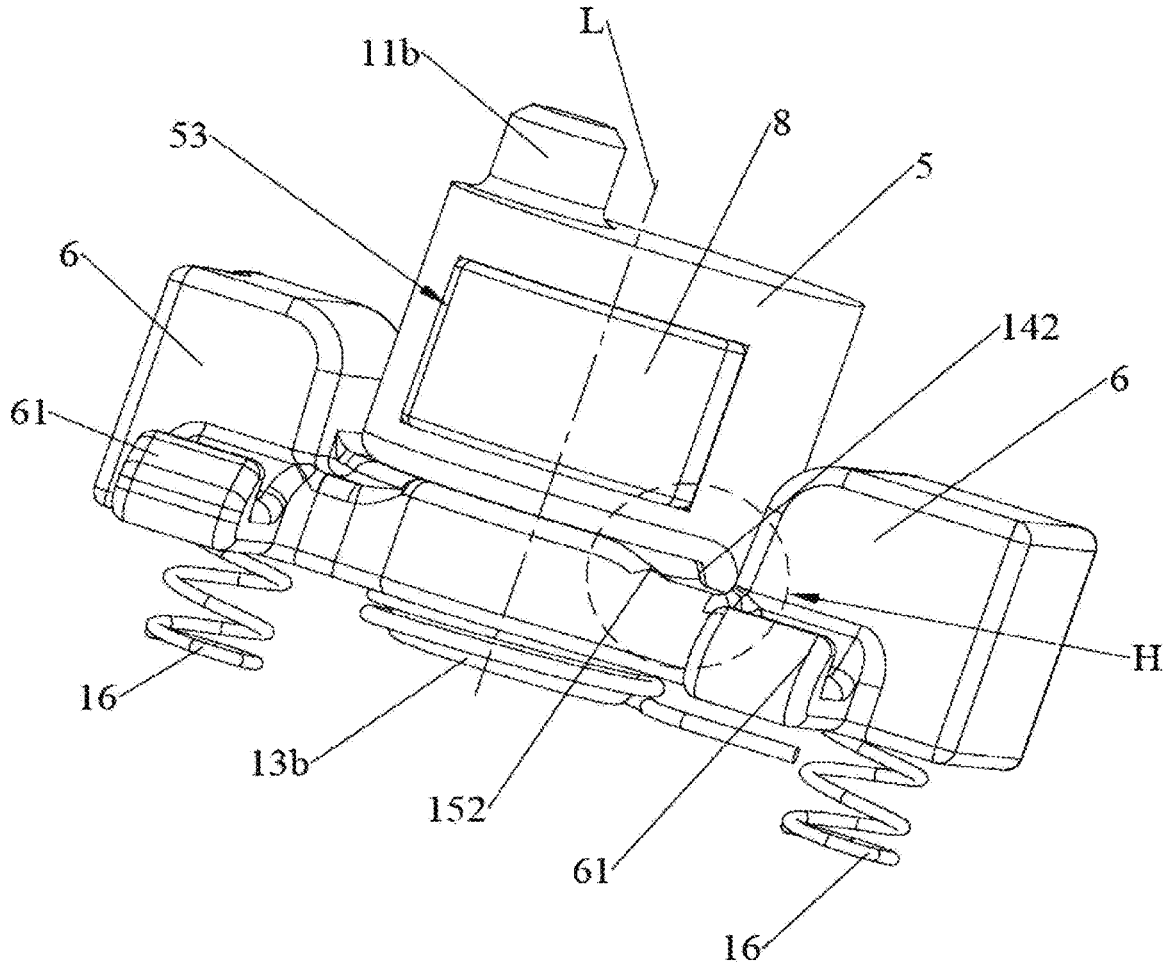
FIG. 38 is another partial diagram of the magnetic buckle assembly according to some embodiments of the present disclosure.
Figure 39:
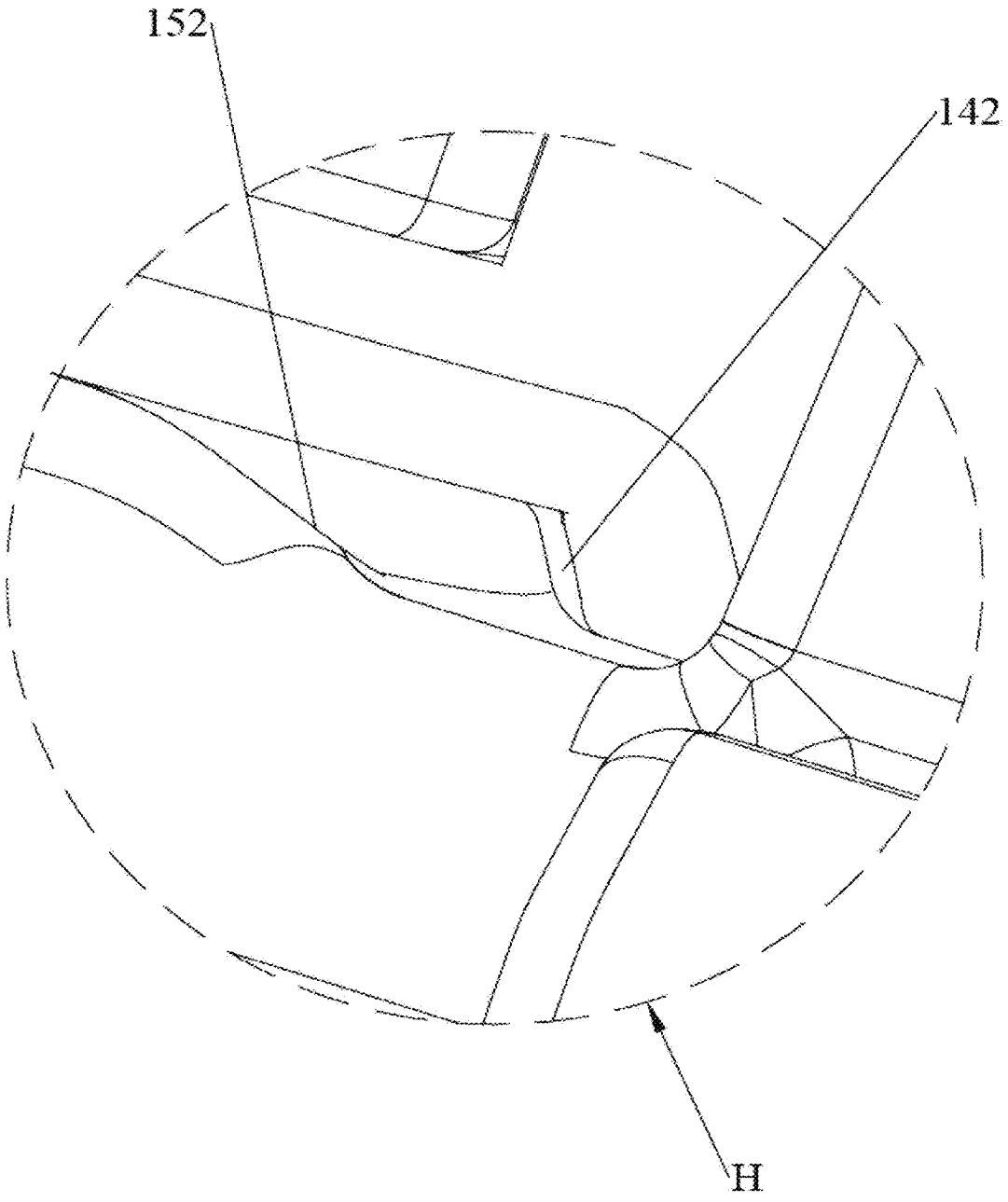
FIG. 39 is an enlarged diagram of an H portion of the magnetic buckle assembly shown in FIG. 38 according to some embodiments of the present disclosure.

Please refer to FIG. 29 to FIG. 39. FIG. 29 is a front view diagram of a magnetic buckle assembly 100*c* according to some embodiments of the present disclosure. FIG. 30 is a sectional diagram of the magnetic buckle assembly 100*c* along an E-E line shown in FIG. 29 according to some embodiments of the present disclosure. FIG. 31 is a sectional diagram of the magnetic buckle assembly 100*c* along an F-F line shown in FIG. 29 according to some embodiments of the present disclosure. FIG. 32 is a sectional diagram of the magnetic buckle assembly 100*c* along a G-G line shown in FIG. 29 according to some embodiments of the present disclosure. FIG. 33 and FIG. 34 are diagrams of the magnetic buckle assembly 100*c* at different views as the two first buckle components 10 are detached according to some embodiments of the present disclosure. FIG. 35 is a diagram of the magnetic buckle assembly 100*c* as the two first buckle components 10 and a cover of a second buckle component 3 are detached according to some embodiments of the present disclosure. FIG. 36 is an exploded diagram of the magnetic buckle assembly 100*c* according to some embodiments of the present disclosure. FIG. 37 is a partial diagram of the magnetic buckle assembly 100*c* according to some embodiments of the present disclosure. FIG. 38 is another partial diagram of the magnetic buckle assembly 100*c* according to some embodiments of the present disclosure. FIG. 39 is an enlarged diagram of an H portion of the magnetic buckle assembly 100*c* shown in FIG. 38 according to some embodiments of the present disclosure. The difference between the magnetic buckle assembly 100*b* and the magnetic buckle assembly 100*c* is provided as follows.

Firstly, as shown in FIG. 29 to FIG. 39, in some embodiments, the operating component 4 is movably connected to the switch 5. Specifically, the operating component 4 is slidably disposed on the front wall of the second buckle component 3 and drives the switch 5 to rotate around the rotating axis L when the operating component 4 is operated to slide. The operating component 4 can be a push button. The sliding direction of the operating component 4 relative to the second buckle component 3 intersects with an arranging direction of the rotating axis L and perpendicular to the lateral direction and the front-rear direction of the magnetic buckle assembly 100*c*. A driving structure 10*b* is formed on the operating component 4, and a driven structure 11*b* is formed on the switch 5 for cooperating with the driving structure 10*b*. The operating component 4 drives the switch 5 to rotate around the rotating axis L by cooperation of the driving structure 10*b* and the driven structure 11*b*. The driving structure 10*b* can be a slot structure, and the driven structure 11*b* can be a column structure slidably disposed inside the slot structure and offset from the rotating axis L. When the operating component 4 is operated to slide, the operating component 4 drives the switch 5 to rotate by cooperation of the slot structure and the column structure. More specifically, the column structure is located at an end surface of the switch 5 facing toward the operating component 4, and a longitudinal direction of the slot structure intersects with the sliding direction of the operating component 4. The longitudinal direction of the slot structure can be perpendicular to the sliding direction of the operating component 4, so that a resultant force acting on the switch 5 can drive the switch 5 to rotate around the rotating axis L. Furthermore, the hollow structure 53 is formed on a middle portion of the switch 5, and the second magnetic component 8 is embedded into the hollow structure 53. On the other hand, in the magnetic buckle assembly 100B of the aforementioned embodiments, the operating component 4 is fixed onto the switch 5, and the operating component 4 rotates to drive the switch 5 to rotate. Furthermore, in the magnetic buckle assembly 100*a* of the aforementioned embodiments, the second magnetic component 8 is accommodated inside the connecting chamber 41 and the accommodating chamber 52.

Secondly, as shown in FIG. 32 and FIG. 35 to FIG. 37, in some embodiments, the first resilient component 13 a can be the elastic spring disposed between the operating component 4 and the second buckle component 3. The guiding portion 42 is formed on the operating component 4 for resiliently deforming the first resilient component 13*a*, and the first resilient component 13*a* is sheathed on the guiding portion 42. On the other hand, the first resilient component 13*b* is a torsional spring sheathed on the switch 5 and located between the switch 5 and the second buckle component 3, i.e., a lateral surface of the switch 5 guides the deformation of the torsional spring.

Other structures of the magnetic buckle assembly 100*c* are similar to the ones of the magnetic buckle assembly 100*b*. Detailed description thereof is omitted herein for simplicity.

Figure 40:
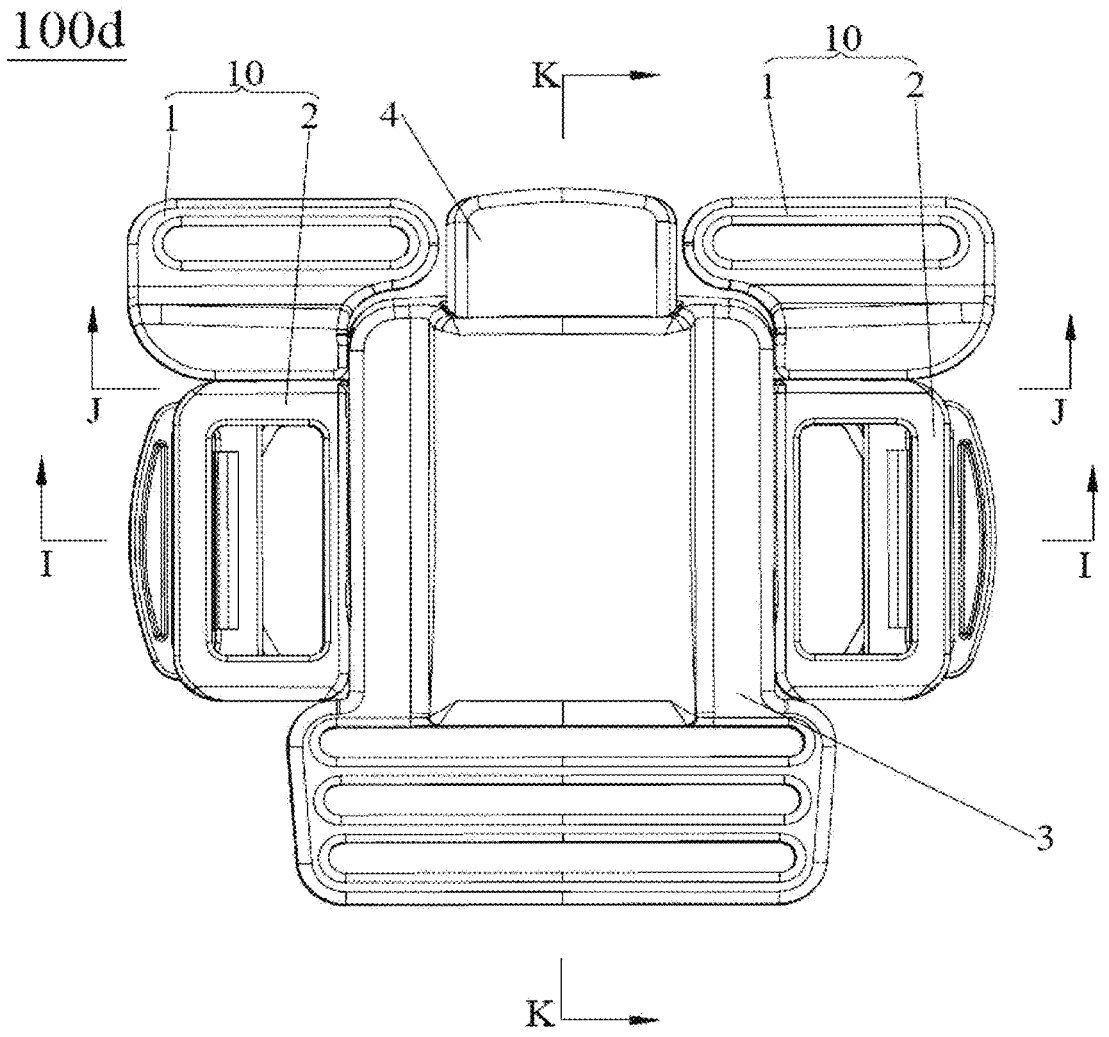
FIG. 40 is a front view diagram of a magnetic buckle assembly according to some embodiments of the present disclosure.
Figure 41:
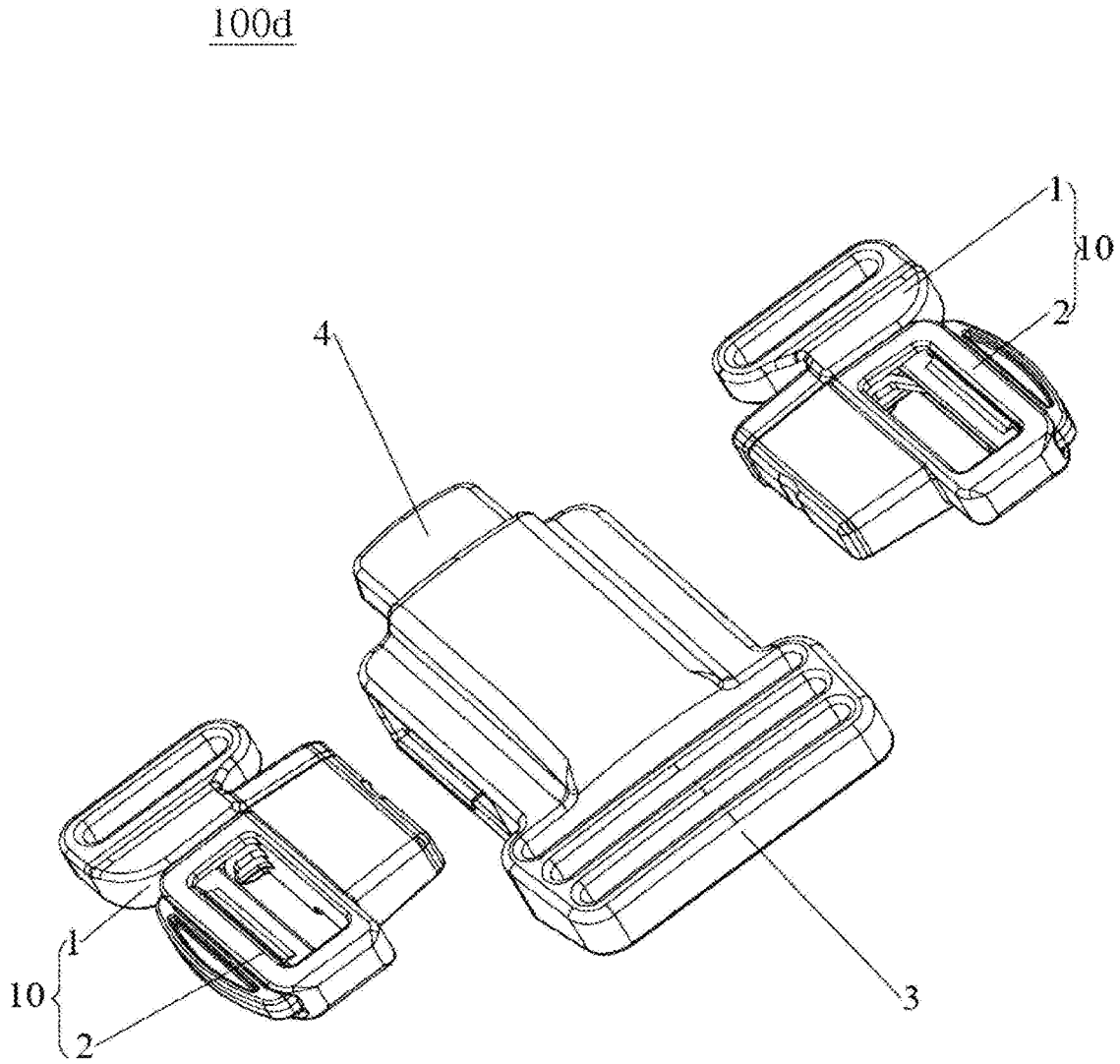
FIG. 41 and FIG. 42 are diagrams of the magnetic buckle assembly at different views as two first buckle components are detached according to some embodiments of the present disclosure.
Figure 42:
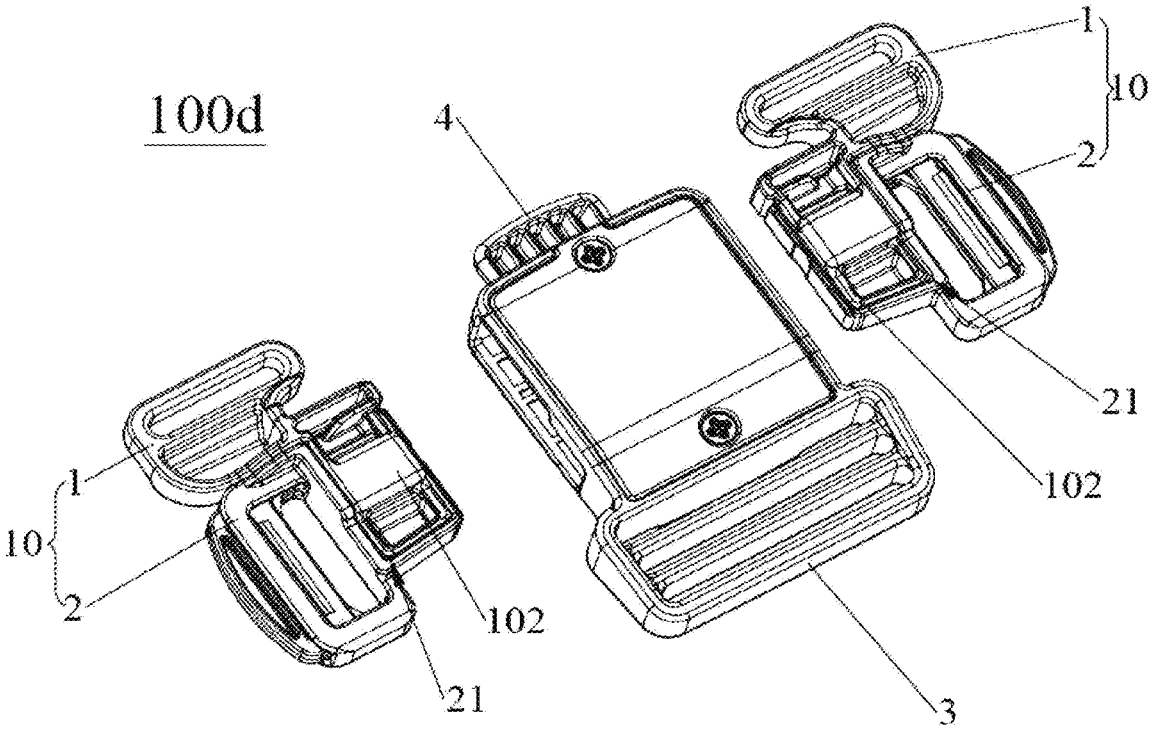
Figure 43:
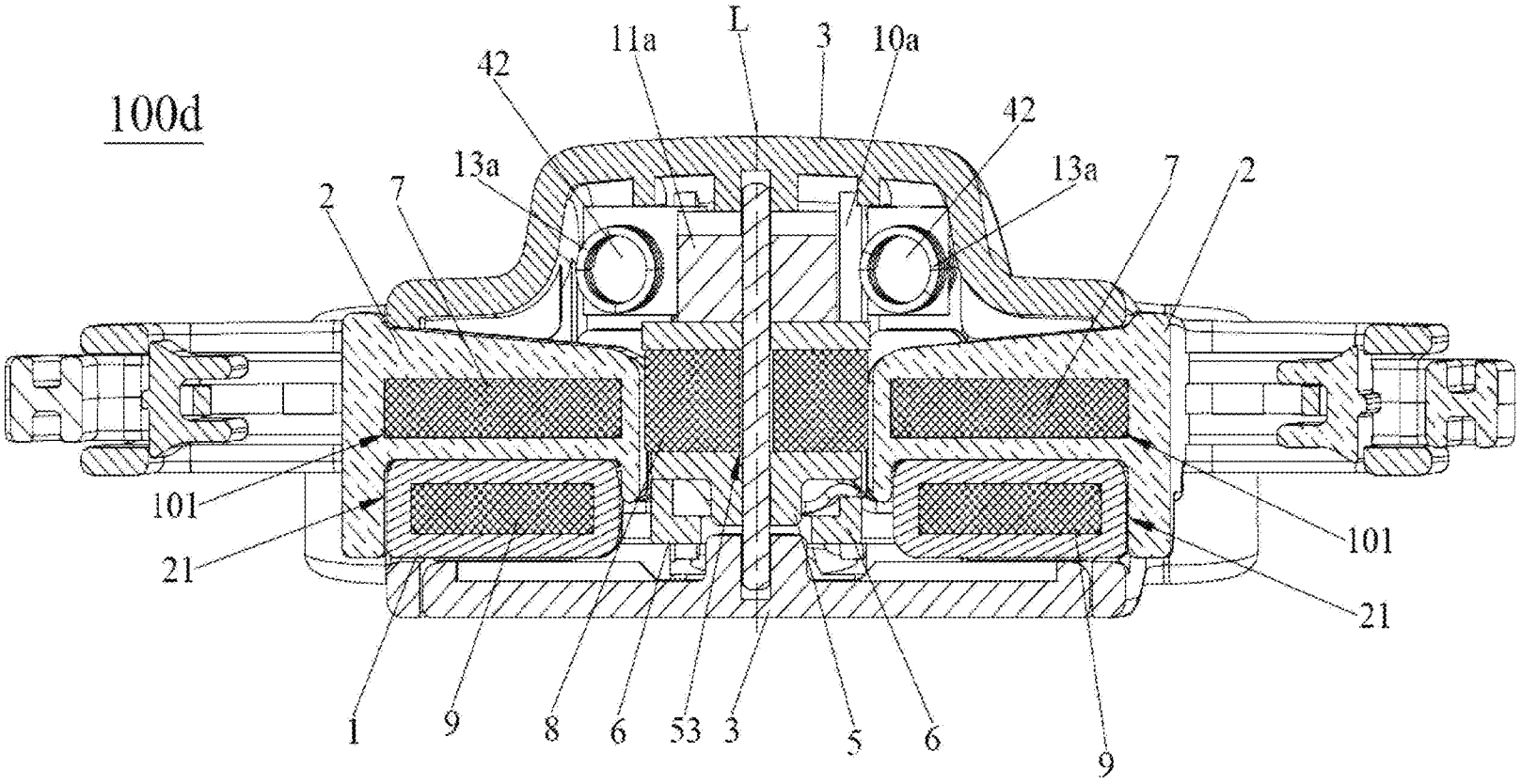
FIG. 43 is a sectional diagram of the magnetic buckle assembly along an I-I line shown in FIG. 40 according to some embodiments of the present disclosure.
Figure 44:
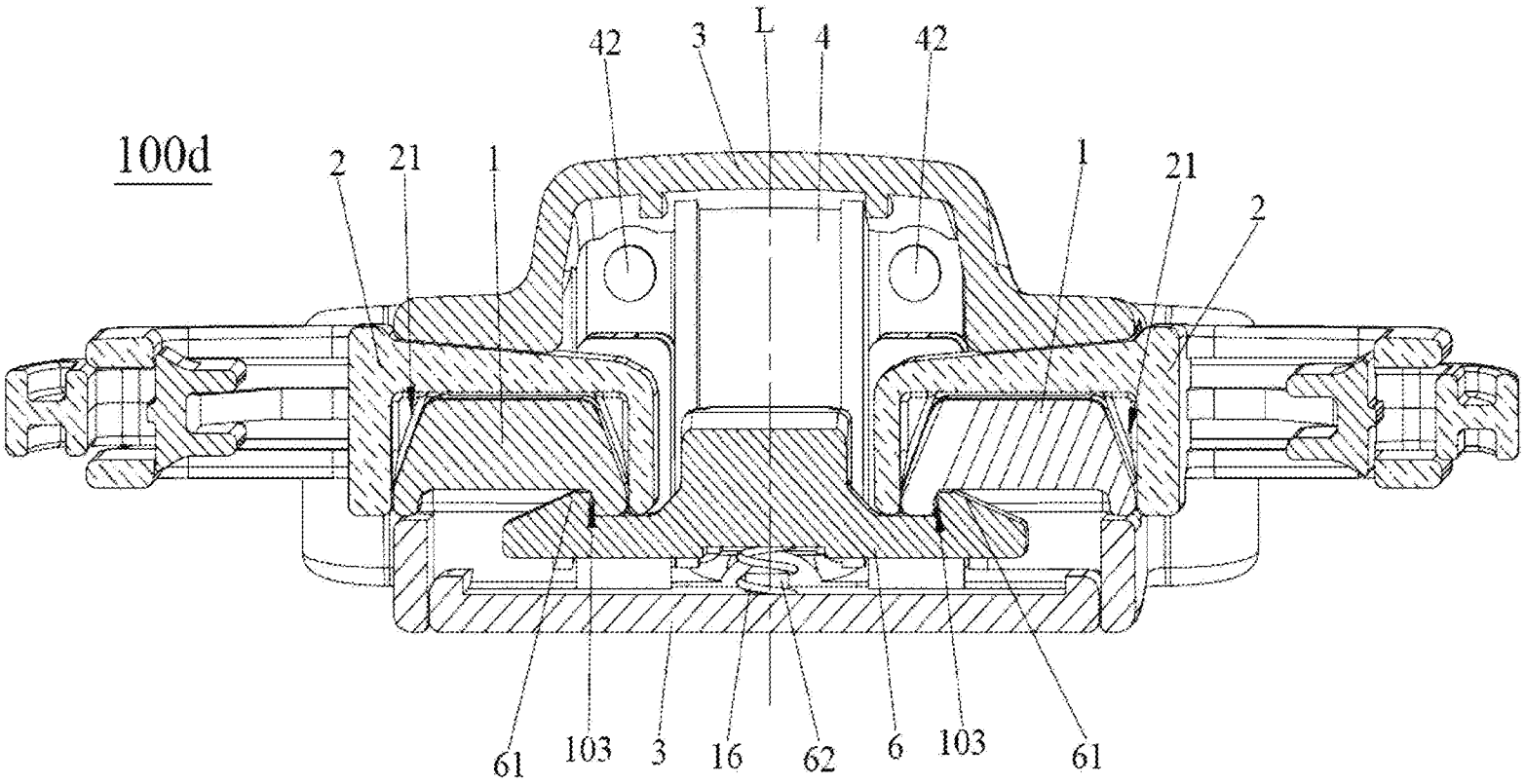
FIG. 44 is a sectional diagram of the magnetic buckle assembly along a J-J line shown in FIG. 40 according to some embodiments of the present disclosure.
Figure 45:
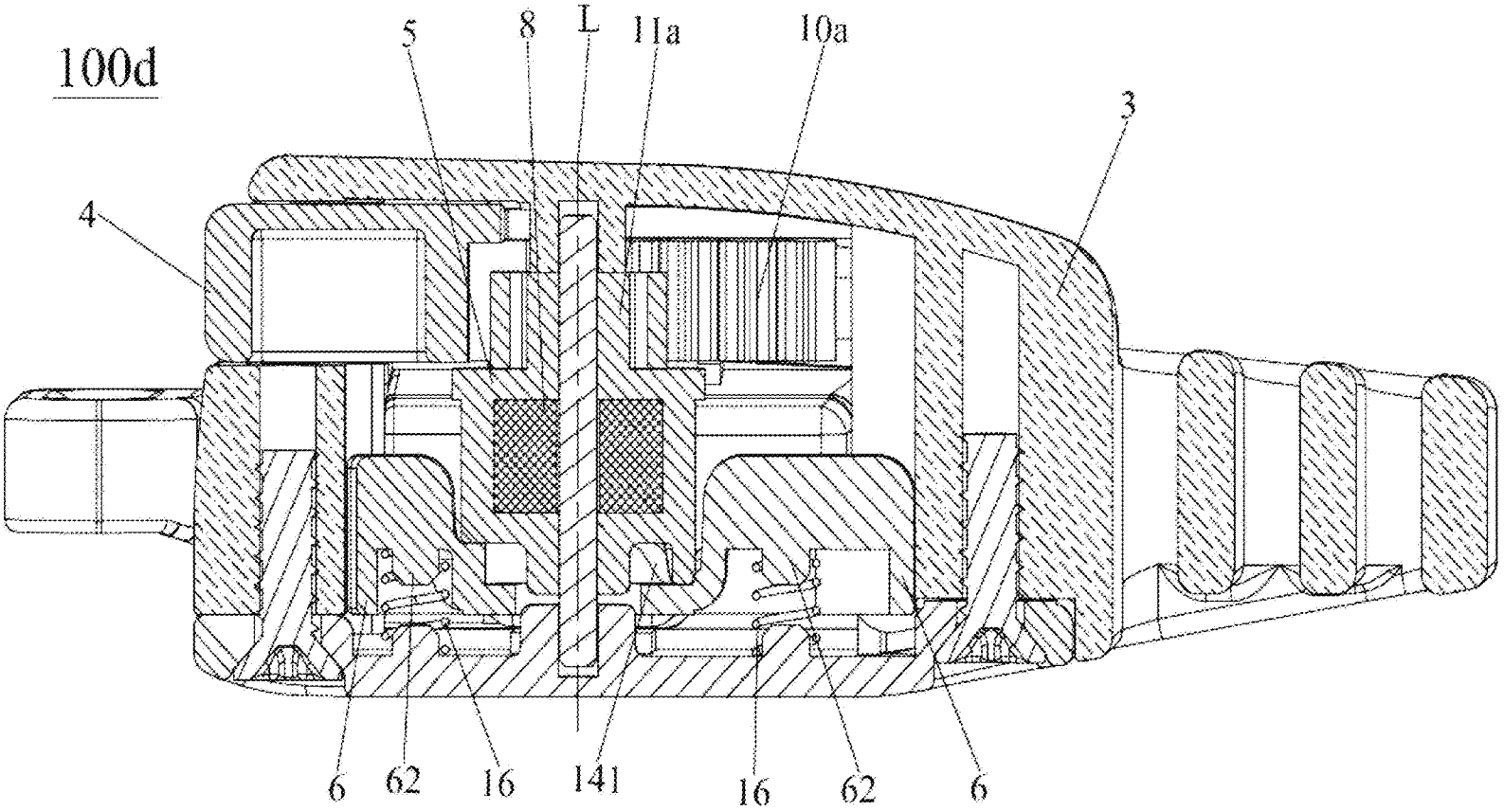
FIG. 45 is a sectional diagram of the magnetic buckle assembly along a K-K line shown in FIG. 40 according to some embodiments of the present disclosure.
Figure 46:
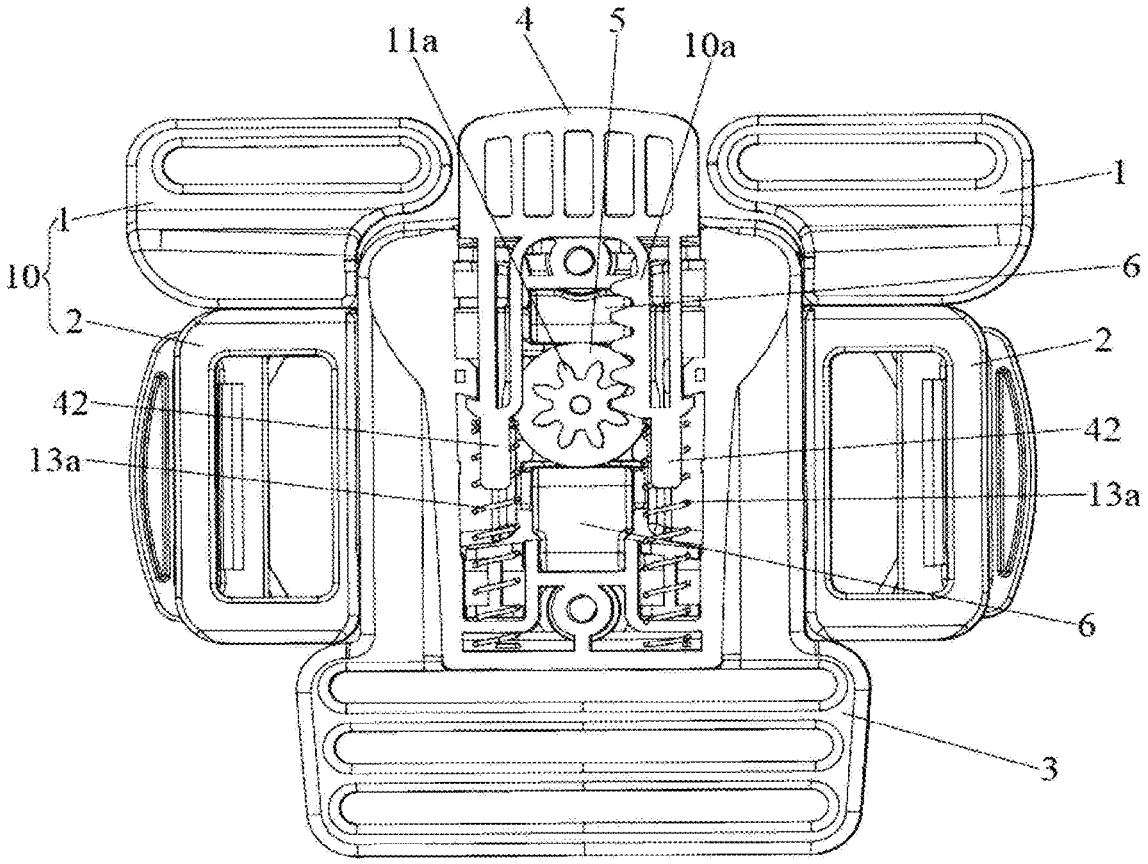
FIG. 46 and FIG. 47 are internal structural diagrams of the magnetic buckle assembly in different states according to some embodiments of the present disclosure.
Figure 47:
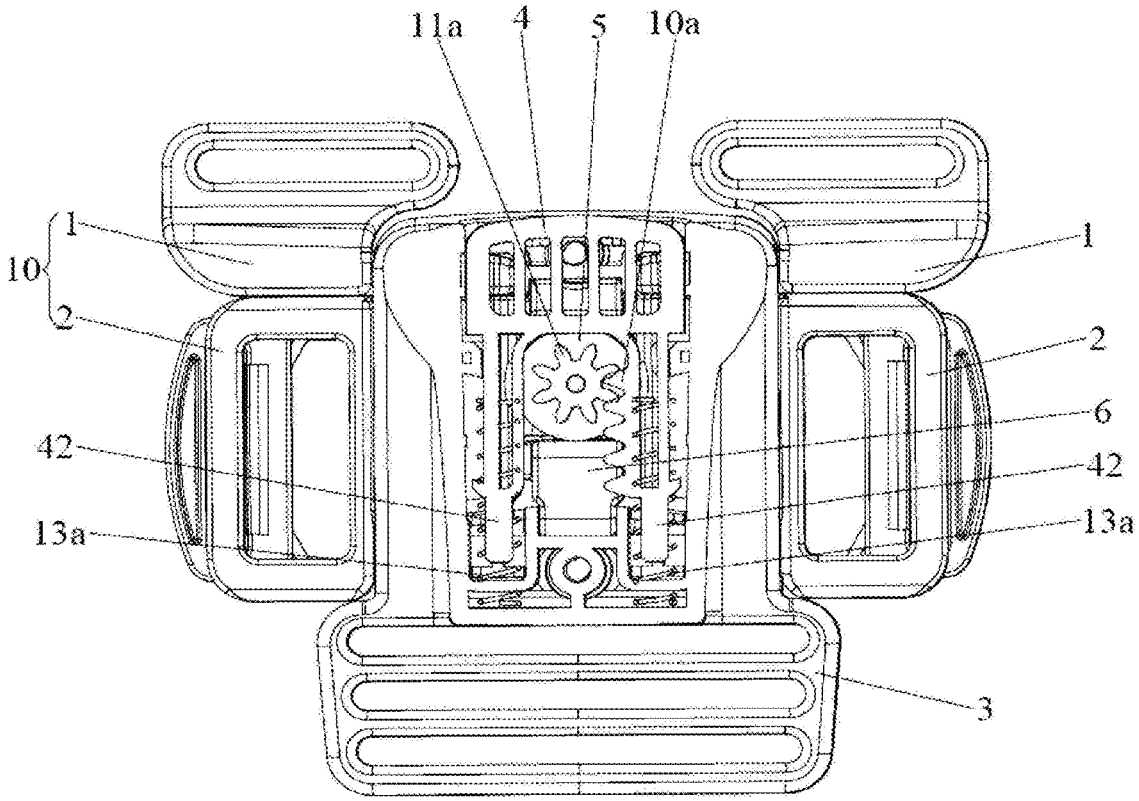
Figure 48:
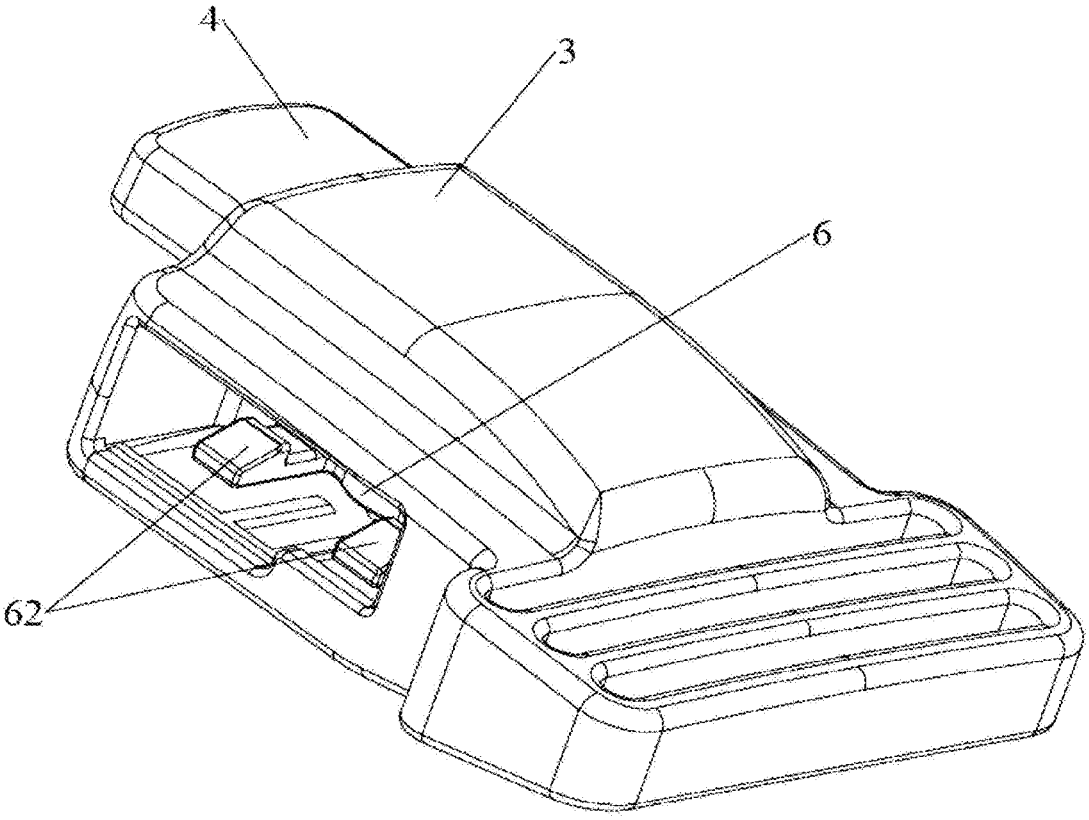
FIG. 48 is a diagram of a second buckle component according to some embodiments of the present disclosure.
Figure 49:
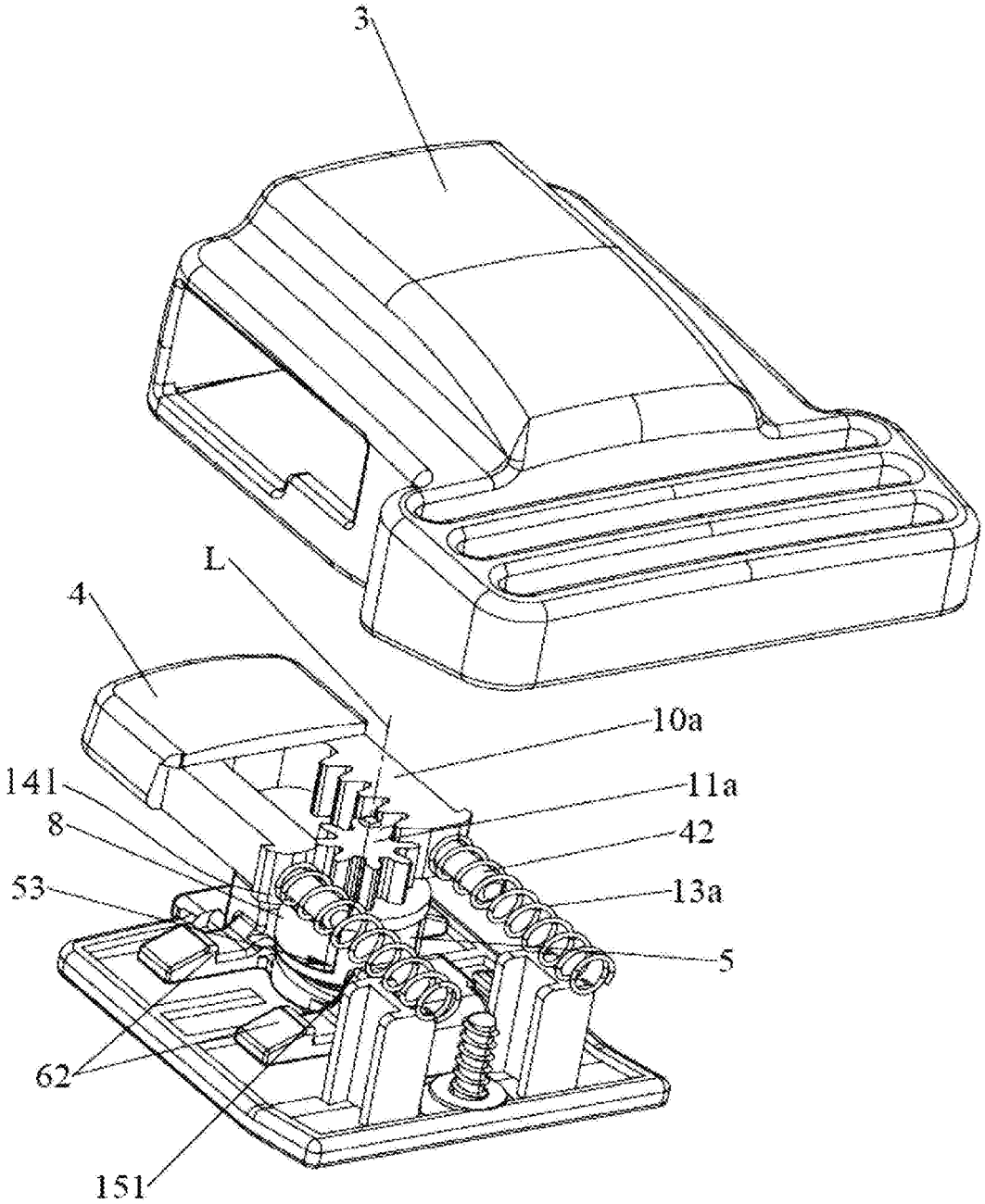
FIG. 49 is an exploded diagram of the second buckle component according to some embodiments of the present disclosure.

Please refer to FIG. 40 to FIG. 49. FIG. 40 is a front view diagram of the magnetic buckle assembly 100*d* according to some embodiments of the present disclosure. FIG. 41 and FIG. 42 are diagrams of the magnetic buckle assembly 100*d* at different views as the two first buckle components 10 are detached according to some embodiments of the present disclosure. FIG. 43 is a sectional diagram of the magnetic buckle assembly 100*d* along an I-I line shown in FIG. 40 according to some embodiments of the present disclosure. FIG. 44 is a sectional diagram of the magnetic buckle assembly 100*d* along a J-J line shown in FIG. 40 according to some embodiments of the present disclosure. FIG. 45 is a sectional diagram of the magnetic buckle assembly 100*d* along a K-K line shown in FIG. 40 according to some embodiments of the present disclosure. FIG. 46 and FIG. 47 are internal structural diagrams of the magnetic buckle assembly 100*d* indifferent states according to some embodiments of the present disclosure. FIG. 48 is a diagram of the second buckle component 3 according to some embodiments of the present disclosure. FIG. 49 is an exploded diagram of the second buckle component 3 according to some embodiments of the present disclosure. The difference between the magnetic buckle assembly 100*c* and the magnetic buckle assembly 100*d* is provided as follows. As shown in FIG. 40 to FIG. 49, in some embodiments, the driving structure 10*a* can be a gear rack structure, and the driven structure 11*a* can be a gear wheel structure for rotatably engaging with the gear rack structure. When the operating component 4 is operated to slide, the operating component 4 drives the switch 5 to rotate by cooperation of the gear rack structure and the gear wheel structure. Specifically, the gear wheel structure is located at an end portion of the switch 5 adjacent to the operating component 4. Furthermore, in some embodiments, the driving cooperating structure 141, i.e., the first inclined surface structure, is formed on the operating component 4. The driven cooperating structure 151, i.e., the second inclined surface, is formed on the latch 6, so that the operating component 4 can drive the latch 6 by cooperation of the driving cooperating structure 141 and the driven cooperating structure 151 when the operating component 4 is operated to slide.

Other structures of the magnetic buckle assembly 100*d* are similar to the ones of the magnetic buckle assembly 100*c*. Detailed description thereof is omitted herein for simplicity.

Figure 50:
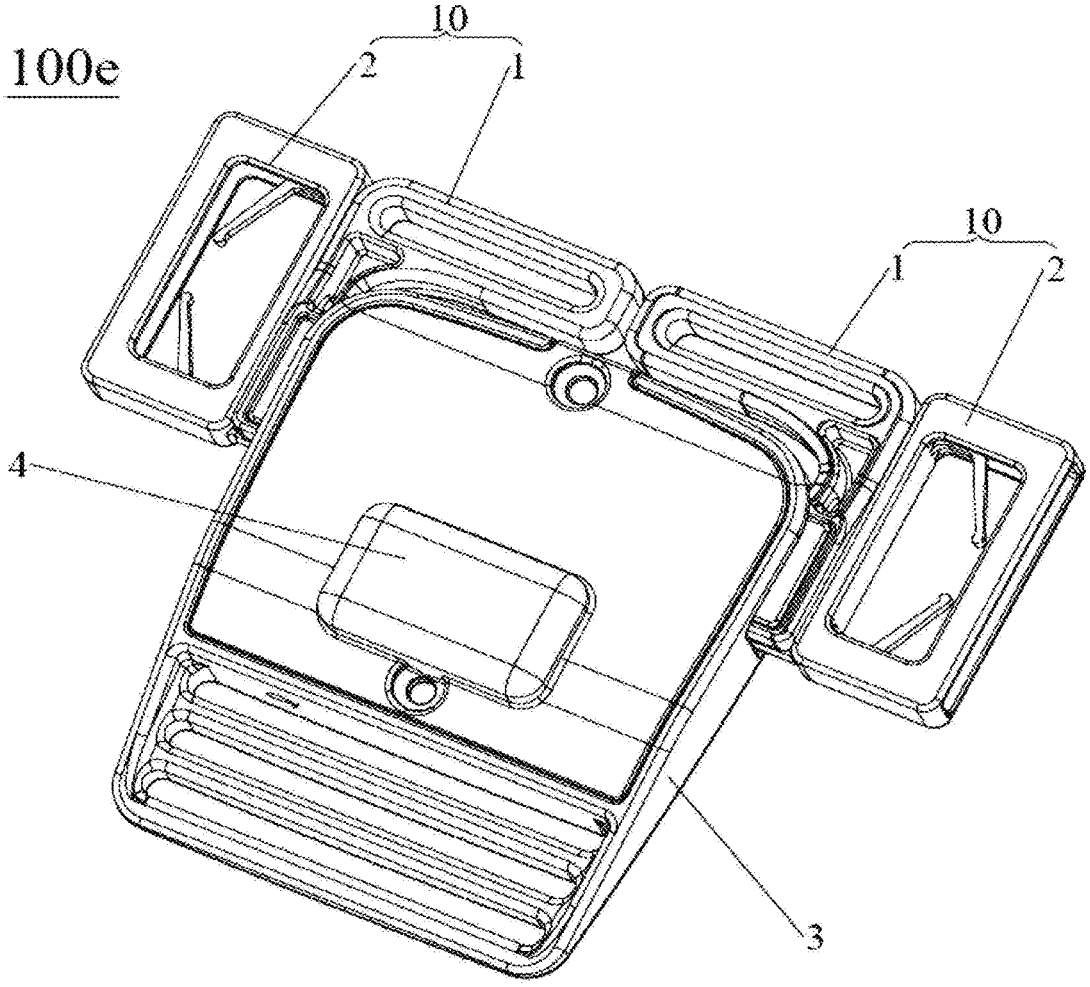
FIG. 50 is a diagram of a magnetic buckle assembly according to some embodiments of the present disclosure.
Figure 51:
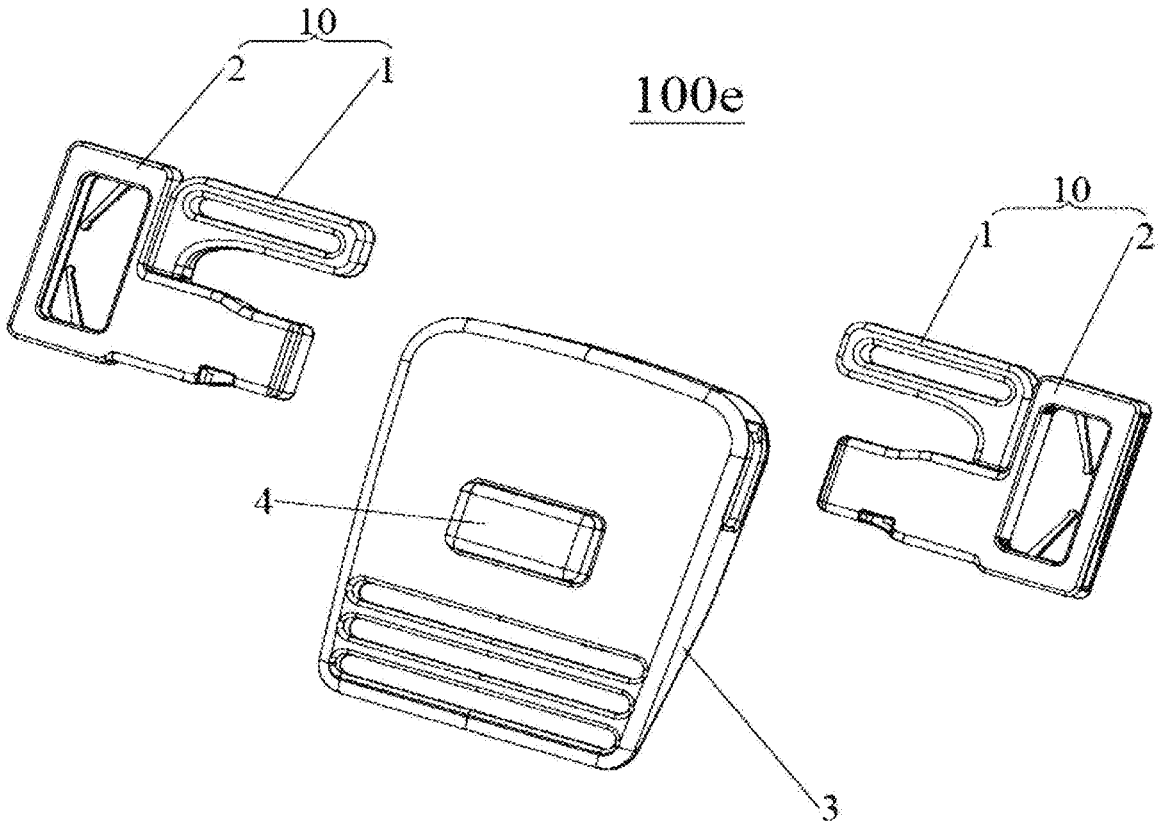
FIG. 51 is a diagram of the magnetic buckle assembly as two first buckle components are detached according to some embodiments of the present disclosure.
Figure 52:
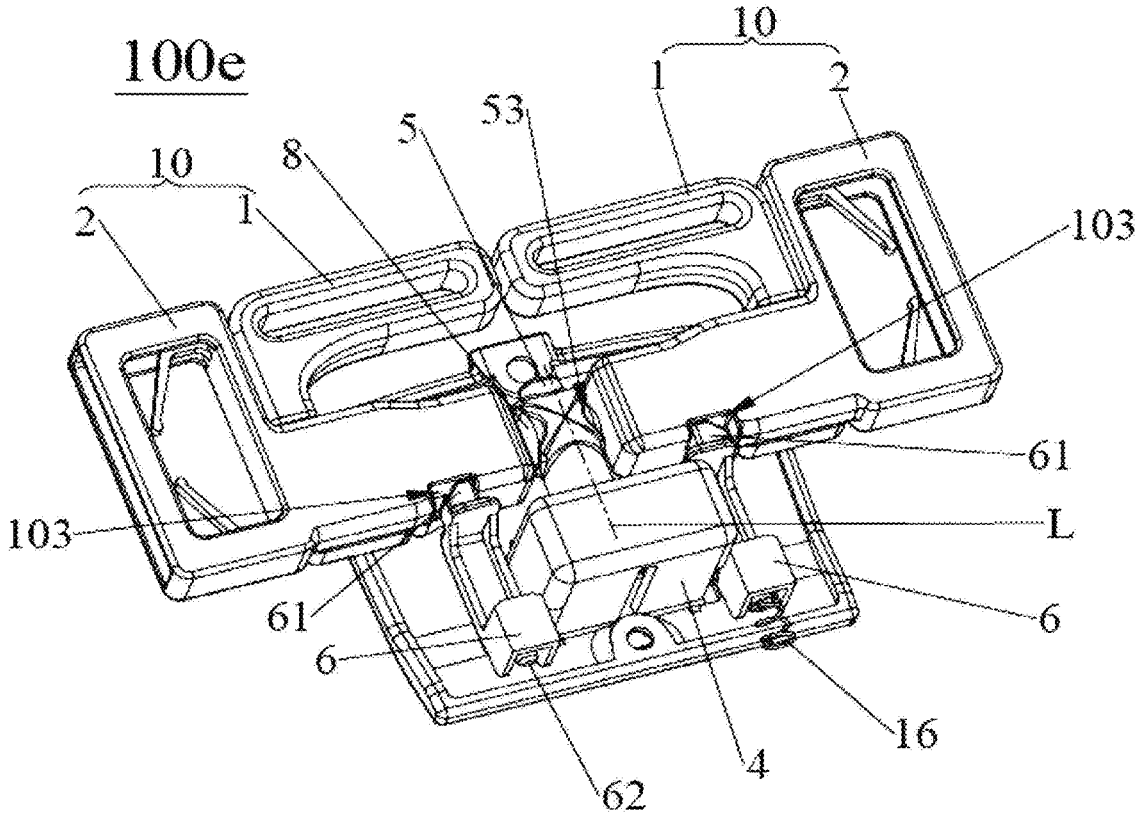
FIG. 52 is a partial diagram of the magnetic buckle assembly according to some embodiments of the present disclosure.
Figure 53:
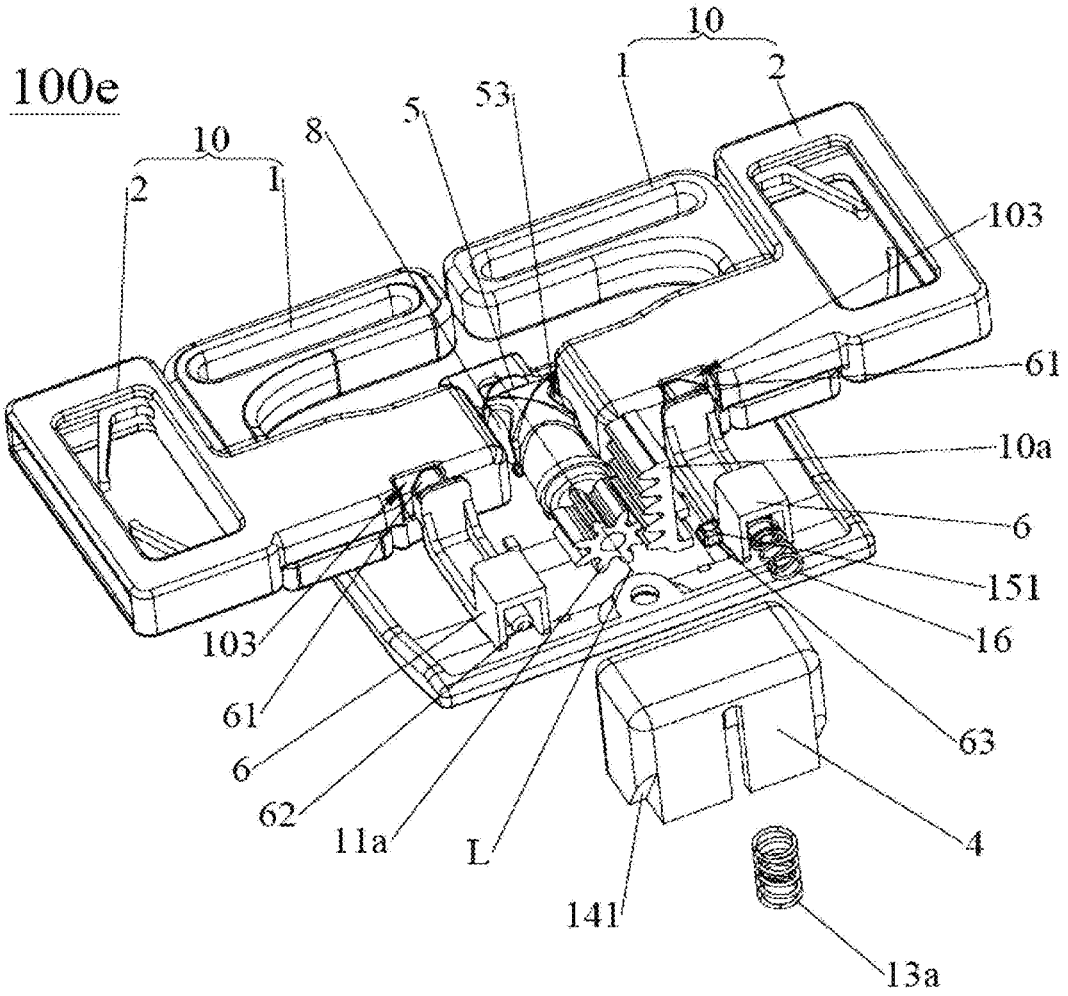
FIG. 53 is a partial exploded diagram of the magnetic buckle assembly according to some embodiments of the present disclosure.
Figure 54:
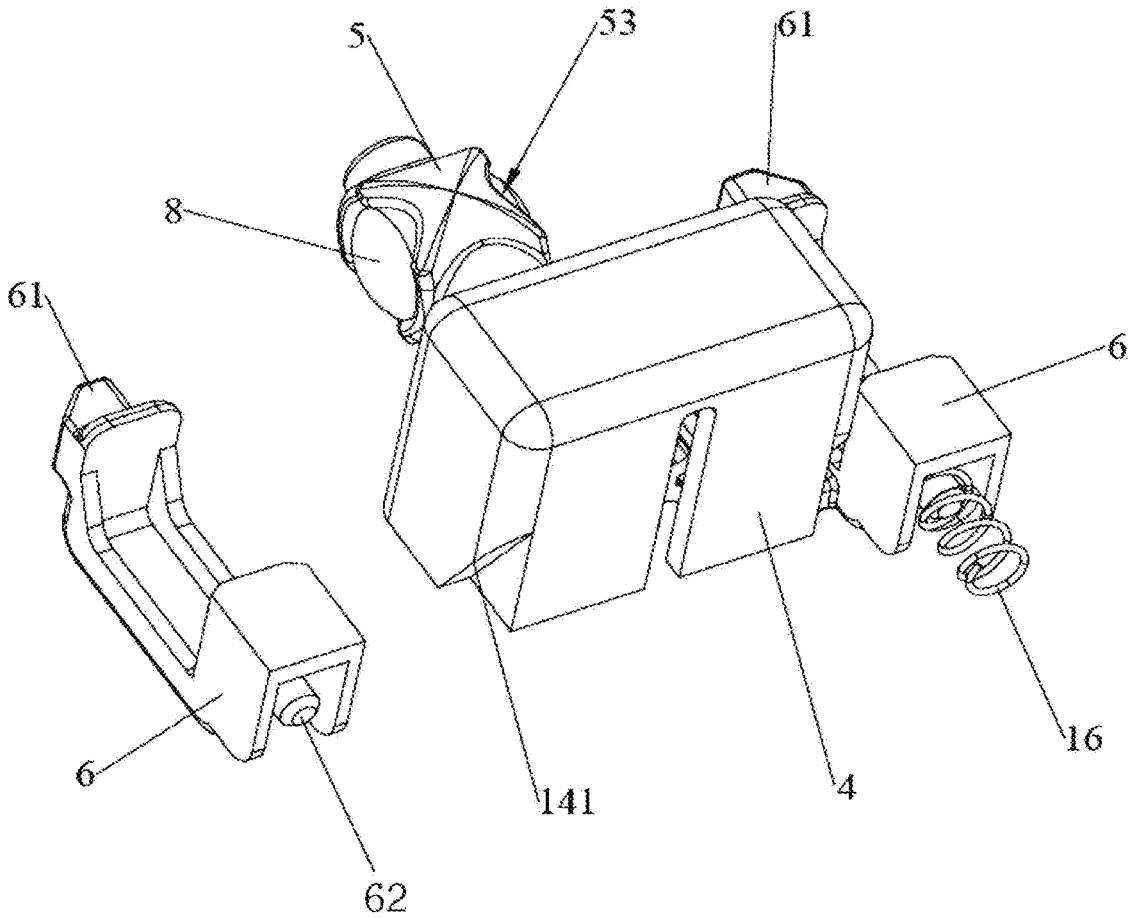
FIG. 54 is another partial diagram of the magnetic buckle assembly according to some embodiments of the present disclosure.
Figure 55:
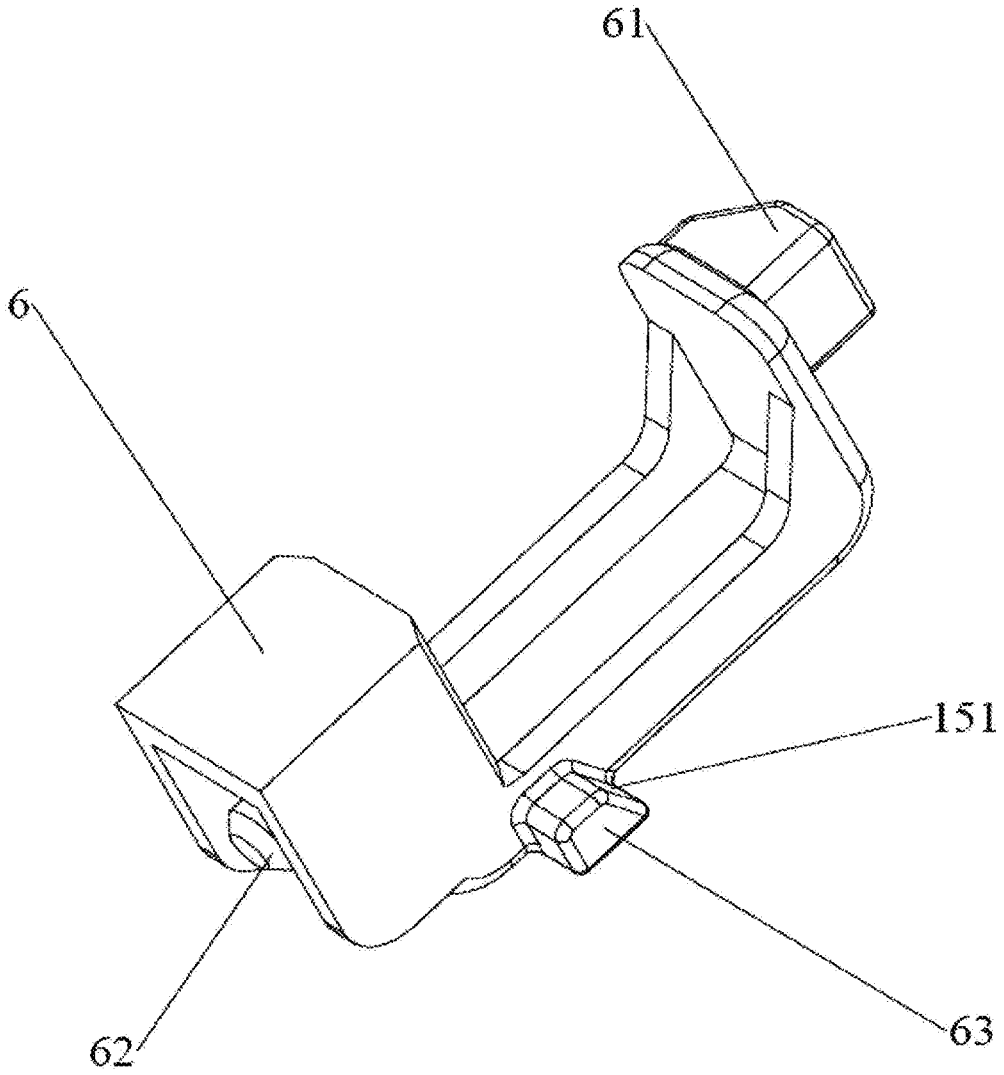
FIG. 55 is a diagram of a latch according to some embodiments of the present disclosure.

Please refer to FIG. 50 to FIG. 55. FIG. 50 is a diagram of a magnetic buckle assembly 100*e* according to some embodiments of the present disclosure. FIG. 51 is a diagram of the magnetic buckle assembly 100*e* as the two first buckle components 10 are detached according to some embodiments of the present disclosure. FIG. 52 is a partial diagram of the magnetic buckle assembly 100*e* according to some embodiments of the present disclosure. FIG. 53 is a partial exploded diagram of the magnetic buckle assembly 100*e* according to some embodiments of the present disclosure. FIG. 54 is another partial diagram of the magnetic buckle assembly 100*e* according to some embodiments of the present disclosure. FIG. 55 is a diagram of the latch 6 according to some embodiments of the present disclosure. The difference between the magnetic buckle assembly 100*a* and the magnetic buckle assembly 100*e* is provided as follows.

Firstly, as shown in FIG. 50 to FIG. 55, in some embodiments, the operating component 4 is disposed on the front wall of the second buckle component 3 and slidable along the front-rear direction of the magnetic buckle assembly 100*d*. On the other hand, in the magnetic buckle assembly 100*a* of the aforementioned embodiments, the operating component 4 is disposed on the lateral wall of the second buckle component 3 and slidable along the lateral direction of the magnetic buckle assembly 100*a*.

Secondly, as shown in FIG. 53 to FIG. 55, in some embodiments, the driving cooperating structure 141, i.e., the first inclined surface structure, is formed on a lateral wall of the operating component 4. The driven cooperating structure 151, i.e., the second inclined surface, is formed on a protrusion of a lateral wall of the latch 6. On the other hand, in the magnetic buckle assembly 100*a* of the aforementioned embodiments, the driving cooperating structure 141, i.e., the first inclined surface structure, is formed on a bottom wall of the operating component 4, and the driven cooperating structure 151, i.e., the second inclined surface, is formed on a top wall of the latch 6.

Other structures of the magnetic buckle assembly 100*e* are similar to the ones of the magnetic buckle assembly 100*a*. Detailed description thereof is omitted herein for simplicity.

Figure 56:
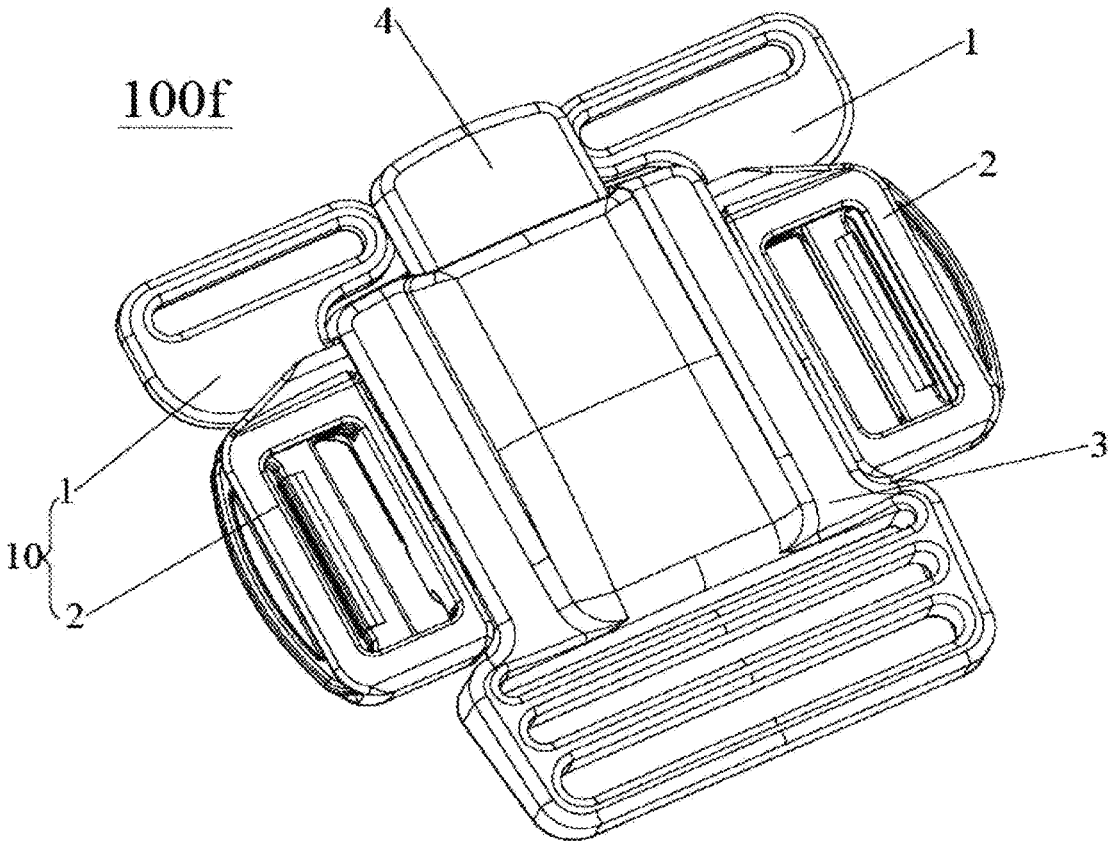
FIG. 56 is a schematic diagram of a magnetic buckle assembly according to some embodiments of the present disclosure.
Figure 57:
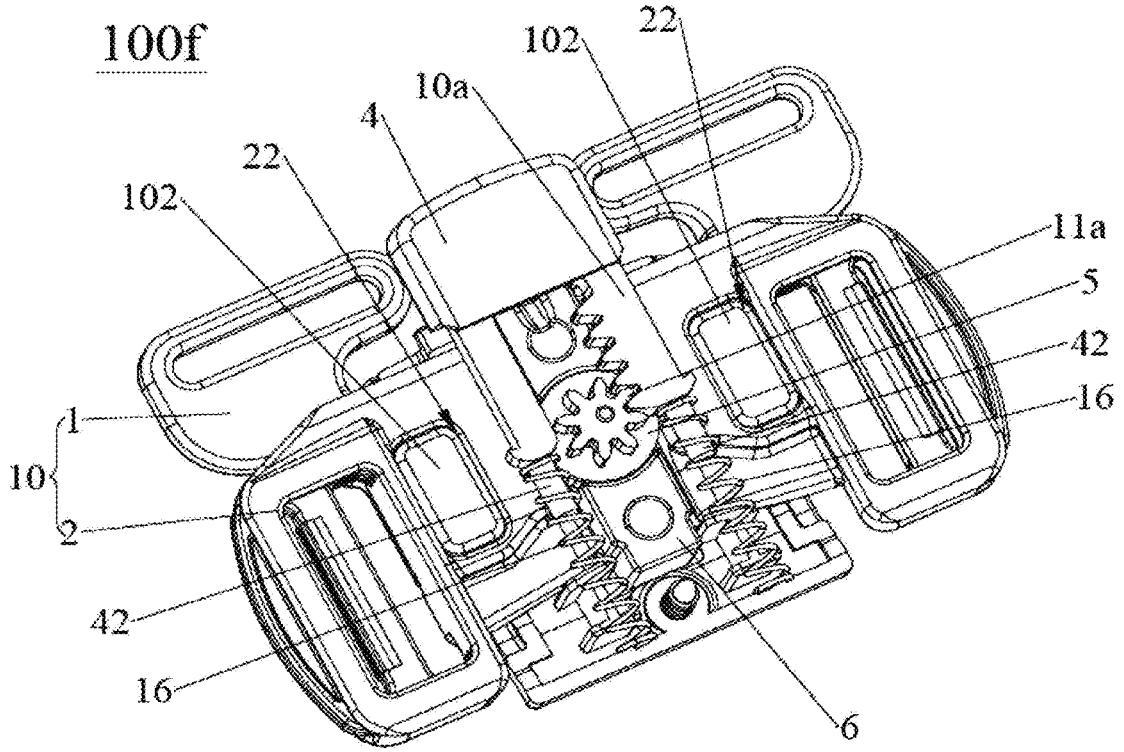
FIG. 57 is a partial diagram of the magnetic buckle assembly according to some embodiments of the present disclosure.
Figure 58:
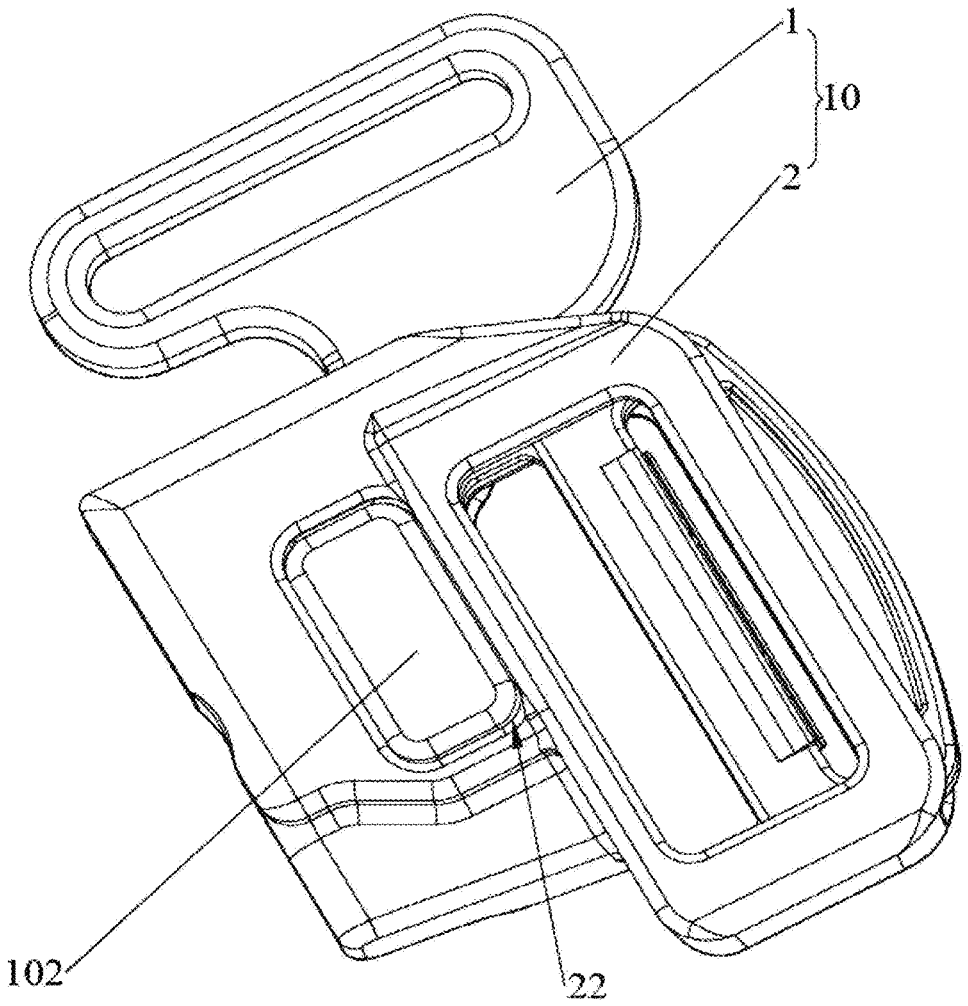
FIG. 58 and FIG. 59 are diagrams of a second buckle component at different views according to some embodiments of the present disclosure.
Figure 59:
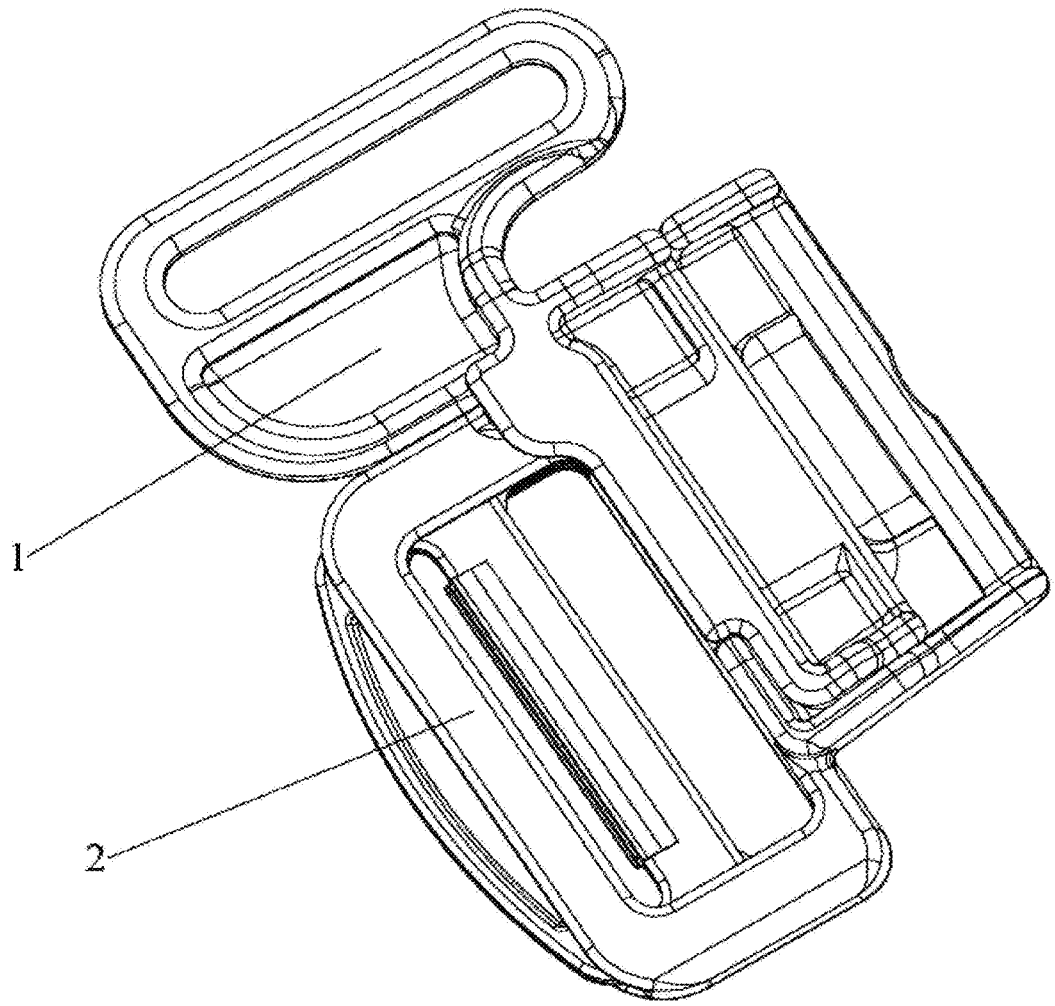

Please refer to FIG. 56 to FIG. 59. FIG. 56 is a schematic diagram of a magnetic buckle assembly 100*f* according to some embodiments of the present disclosure. FIG. 57 is a partial diagram of the magnetic buckle assembly 100*f* according to some embodiments of the present disclosure. FIG. 58 and FIG. 59 are diagrams of the second buckle component 3 at different views according to some embodiments of the present disclosure. The difference between the magnetic buckle assembly 100*d* and the magnetic buckle assembly 100*f* is provided as follows.

Firstly, as shown in FIG. 56 to FIG. 59, in some embodiments, the shoulder strap buckle 1 is stacked above the waist strap buckle 2 along a front-rear direction of the magnetic buckle assembly 100*f*. An engaging portion 22 is formed on the waist strap buckle 2. The engaging portion 22 can be an engaging hole. The engaging arm 102 protrudes from the shoulder strap buckle 1 for engaging with the engaging portion 22, and an outline of the engaging arm 102 matches with an outline of the engaging hole. The engaging arm 102 is embedded into the engaging hole, so that the engaging arm 102 is visible from the front, which makes the connection of the shoulder strap buckle 1 and the waist strap buckle 2 more easily. On the other hand, in the magnetic buckle assembly 100*d* of the aforementioned embodiments, the engaging arm 102 engages with the recess structure formed on the rear surface of the waist strap buckle 3, so that the engaging arm 102 is invisible from the front. The configuration of the connection of the shoulder strap buckle 1 and the waist strap buckle 2 depends on practical demands.

Secondly, as shown in FIG. 56 to FIG. 59, in some embodiments, the magnetic buckle assembly 100*f* includes the two first magnetic components 7 disposed on the two first buckle components 10 and the second magnetic component 8 disposed on the switch 5 inside the second buckle component 3, and the third magnetic component is omitted herein for reducing occupied space of the first buckle component 10 and lowering the manufacturing cost. On the other hands, in the magnetic buckle assembly 100*d* of the aforementioned embodiments, the magnetic buckle assembly 100*d* includes the two first magnetic components 7 disposed on the two first buckle components 10, the two third magnetic components 9 disposed on the two first buckle components 10 and the second magnetic component 8 disposed on the switch 5 inside the second buckle component 3.

Other structures of the magnetic buckle assembly 100*f* are similar to the ones of the magnetic buckle assembly 100*d*. Detailed description thereof is omitted herein for simplicity.

Figure 60:
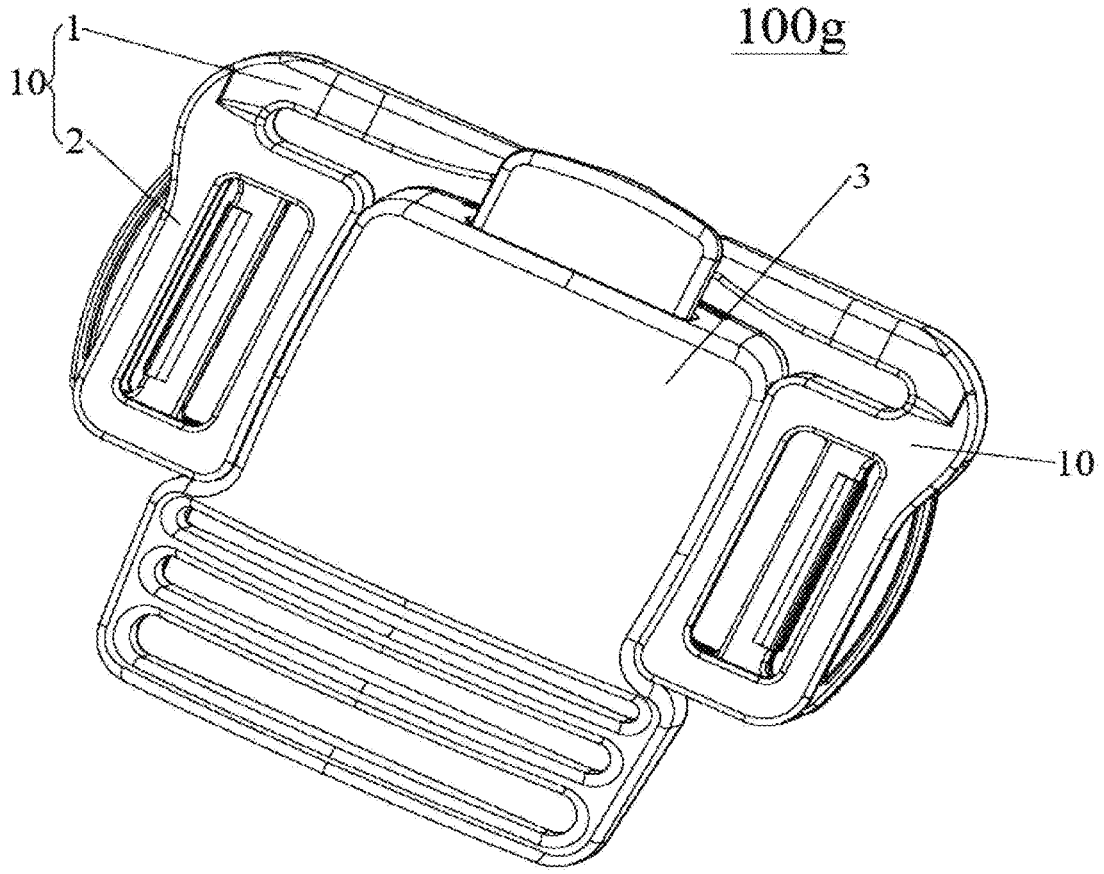
FIG. 60 is a schematic diagram of a magnetic buckle assembly according to some embodiments of the present disclosure.
Figure 61:
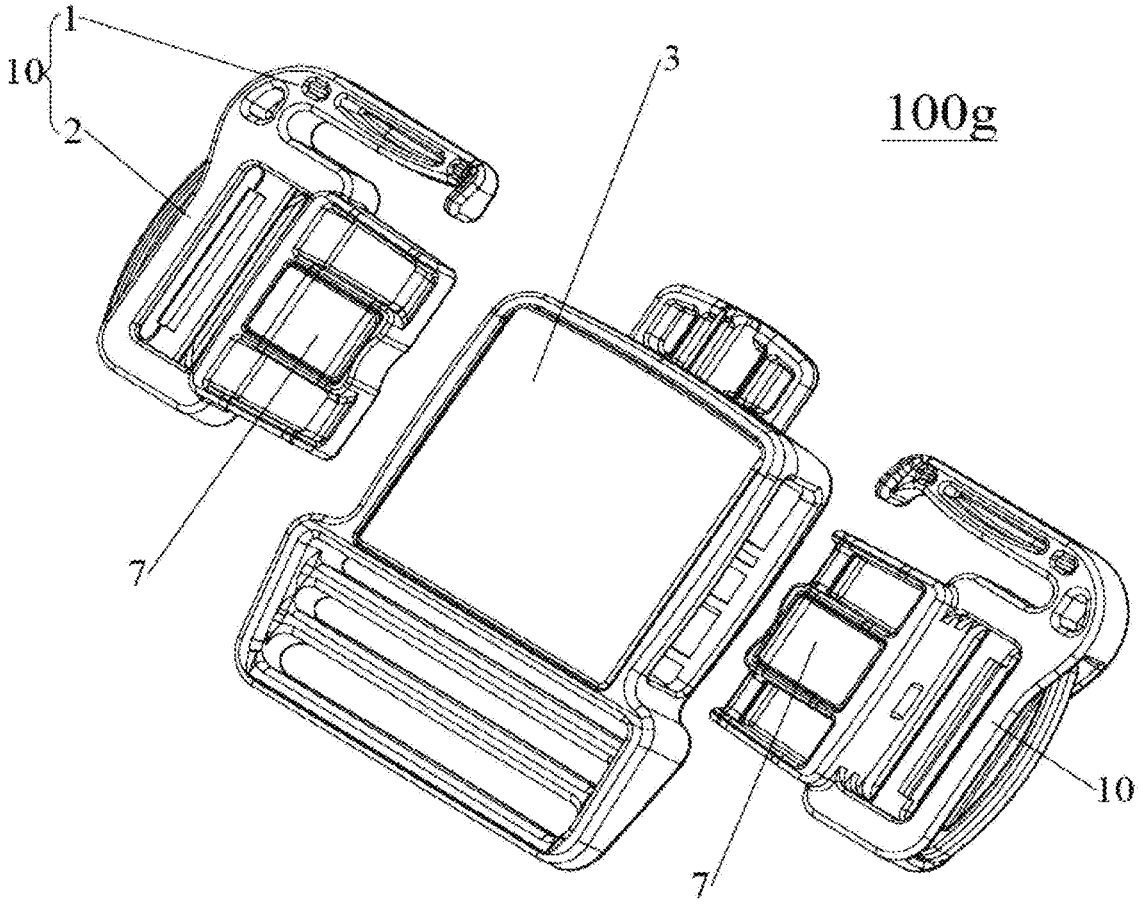
FIG. 61 is a diagram of the magnetic buckle assembly as two first buckle components are detached according to some embodiments of the present disclosure.
Figure 62:
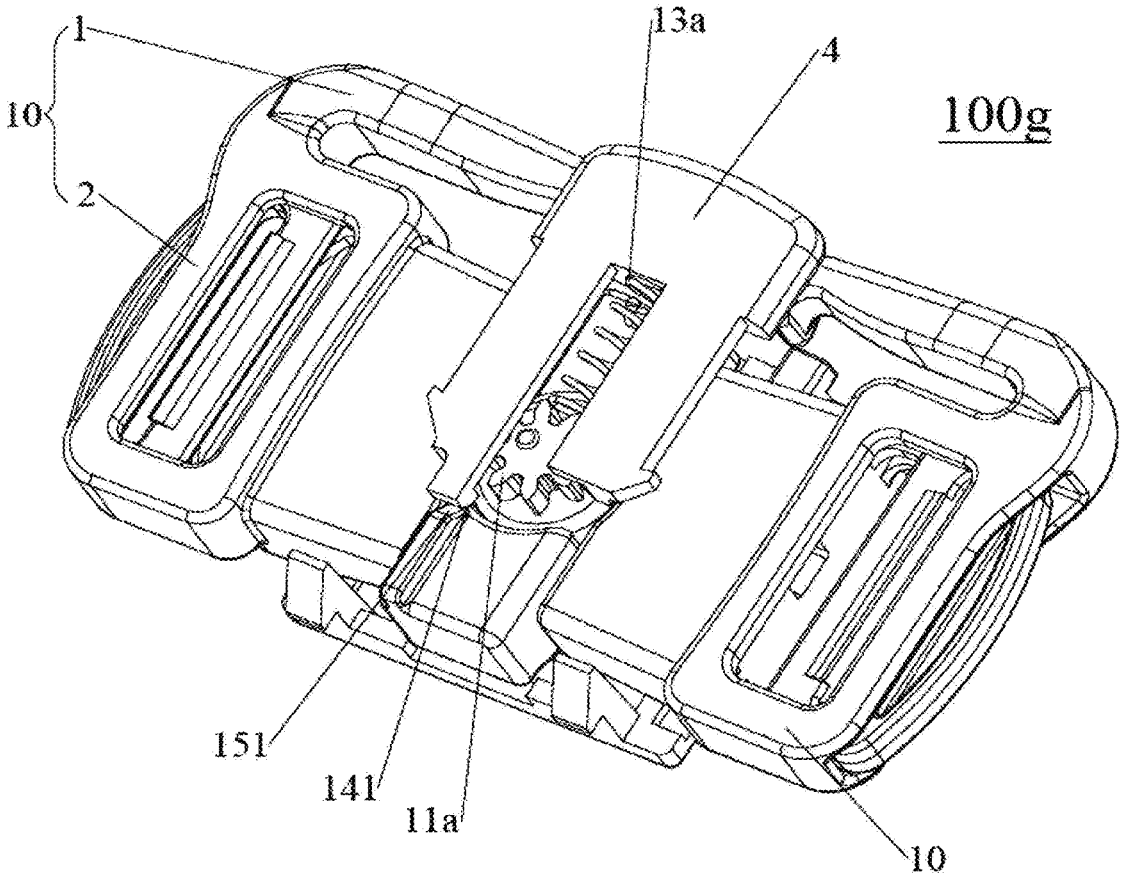
FIG. 62 and FIG. 63 are partial diagrams of the magnetic buckle assembly at different views according to some embodiments of the present disclosure.
Figure 63:
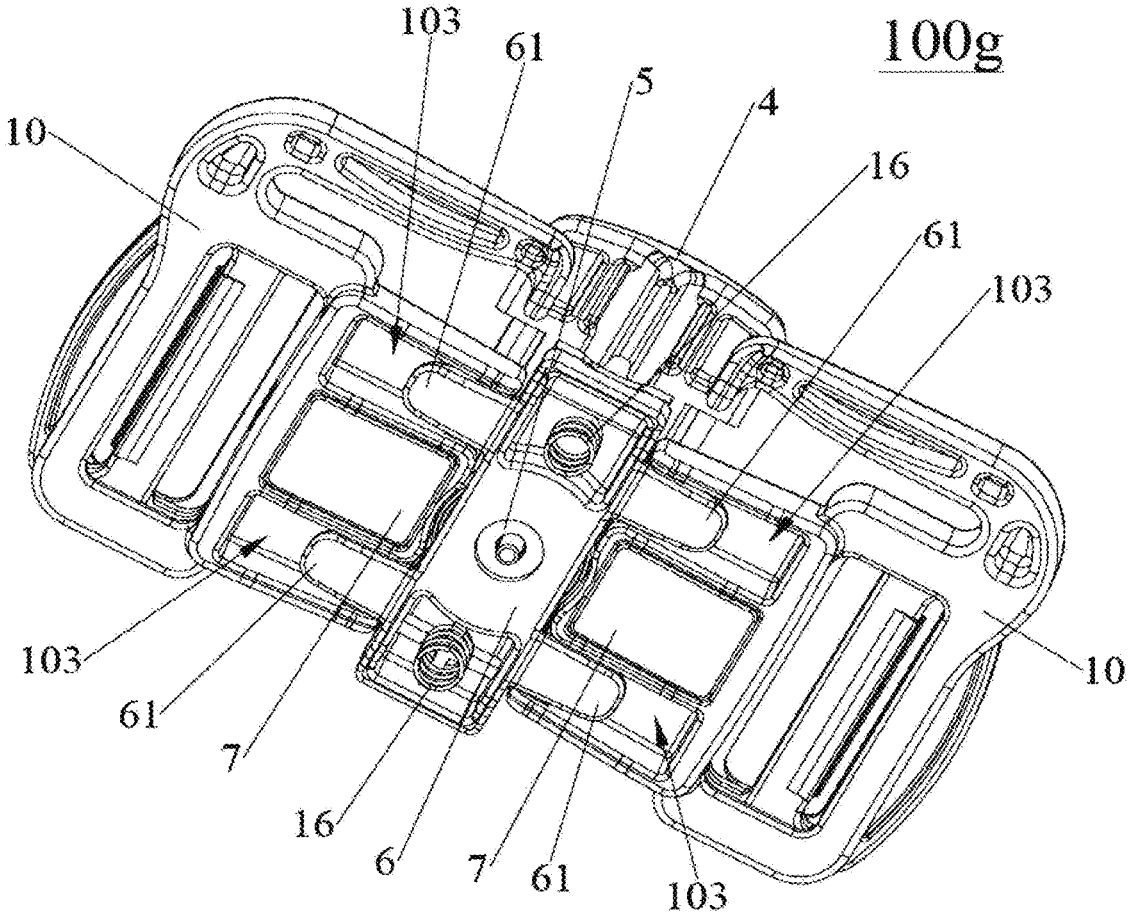
Figure 64:
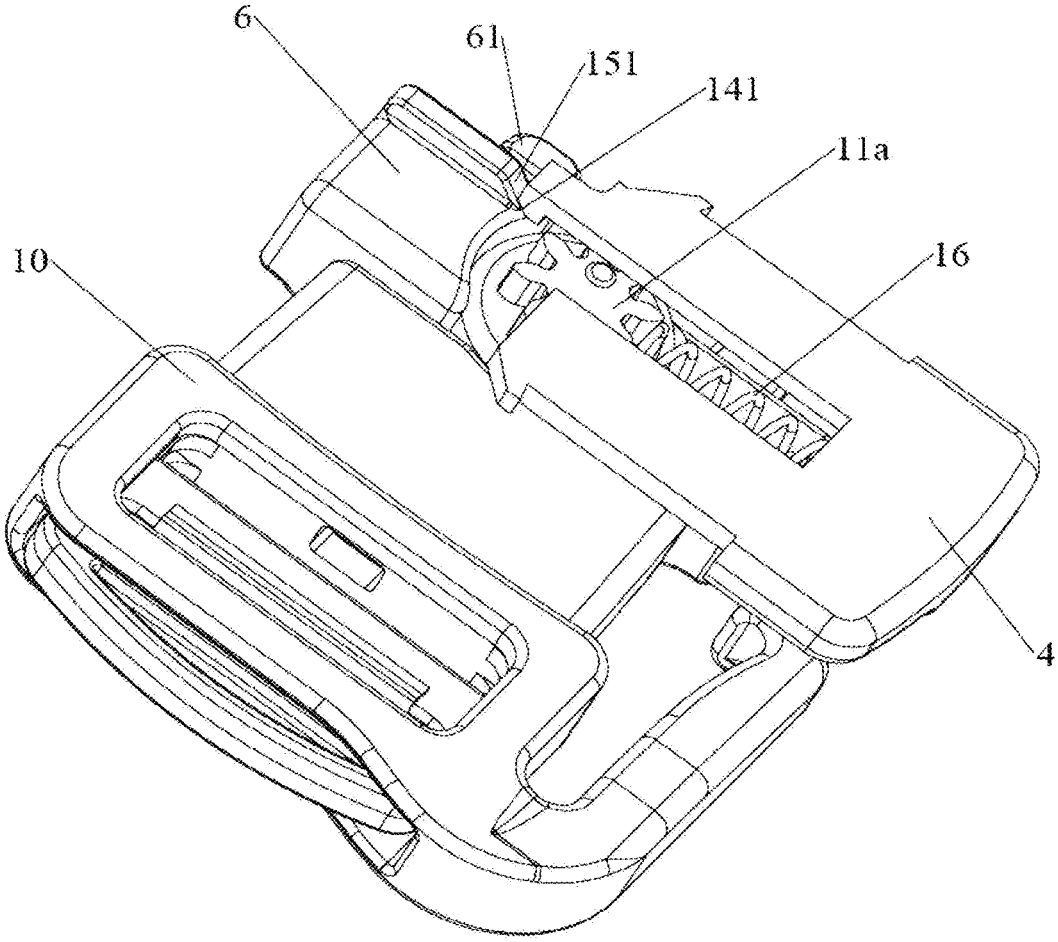
FIG. 64 is another partial diagram of the magnetic buckle assembly according to some embodiments of the present disclosure.

Please refer to FIG. 60 to FIG. 64. FIG. 60 is a schematic diagram of a magnetic buckle assembly 100*g* according to some embodiments of the present disclosure. FIG. 61 is a diagram of the magnetic buckle assembly 100*g* as the two first buckle components 10 are detached according to some embodiments of the present disclosure. FIG. 62 and FIG. 63 are partial diagrams of the magnetic buckle assembly 100*g* at different views according to some embodiments of the present disclosure. FIG. 64 is another partial diagram of the magnetic buckle assembly 100*g* according to some embodiments of the present disclosure. The difference between the magnetic buckle assembly 100*d* and the magnetic buckle assembly 100*g* is provided as follows.

Firstly, as shown in FIG. 60 and FIG. 61, in some embodiments, each first buckle component 10 includes the shoulder strap buckle 1 and the waist strap buckle 2. The shoulder strap buckle 1 and the waist strap buckle 2 are combined with each other to form a one-piece male buckle. The second buckle component 3 is a crotch strap buckle. On the other hand, in the magnetic buckle assembly 100*d* of the aforementioned embodiments, the shoulder strap buckle 1 and the waist strap buckle 2 are two separated structures which can be assembled with each other.

Secondly, as shown in FIG. 60 to FIG. 64, in some embodiments, the magnetic buckle assembly 100*g* includes the first magnetic components 7 disposed on the two first buckle components 10 and the second magnetic component 8 disposed on the switch 5 inside the second buckle component 3, and the third magnetic component is omitted. On the other hand, in the magnetic buckle assembly 100*d* of the aforementioned embodiments, the magnetic buckle assembly 100*d* includes the two first magnetic components 7 disposed on the two first buckle components 10, the two third magnetic components 9 disposed on the two first buckle components 10 and the second magnetic component 8 disposed on the switch 5 inside the second buckle component 3.

Thirdly, as shown in FIG. 62 to FIG. 64, in some embodiments, the operating component 4 is linked to the latch 6 directly. Specifically, the driven cooperating structure 151 is formed on the latch 6, and the driving cooperating structure 141 is formed on the operating component 4. When the operating component 4 is operated to slide, the operating component 4 drives the latch 6 by cooperation of the driving cooperating component 141 and the driven cooperating component 151 to disengage the locking structure 61 from the locked structure 103. The driving cooperating structure 141 can be a first inclined surface structure inclined relative to the sliding direction of the latch 6, and the driven cooperating structure 151 can be a second inclined surface structure. The operating component 4 is operated to slide to drive the first inclined surface structure to push the second inclined surface structure to drive the latch 6 to slide to disengage the locking structure 61 from the locked structure 103. On the other hand, in the magnetic buckle assembly 100*d* of the aforementioned embodiments, the operating component 4 drives the switch 5 to rotate to drive the latch 6 to slide. Specifically, when the operating component 4 drives the switch 5 to rotate, the switch 5 drives the latch 6 to slide by cooperation of the driving cooperating structure 141, i.e., the first helical surface structure, and the driven cooperating structure 151, i.e., the second helical surface structure, so as to disengage the locking structure 61 from the locked structure 103. Furthermore, in the magnetic buckle assembly 100*d* of the aforementioned embodiments, the central axis of the first helical surface structure coincides with the rotating axis L.

Other structures of the magnetic buckle assembly 100*g* are similar to the ones of the magnetic buckle assembly 100*d*. Detailed description thereof is omitted herein for simplicity.

Figure 65:
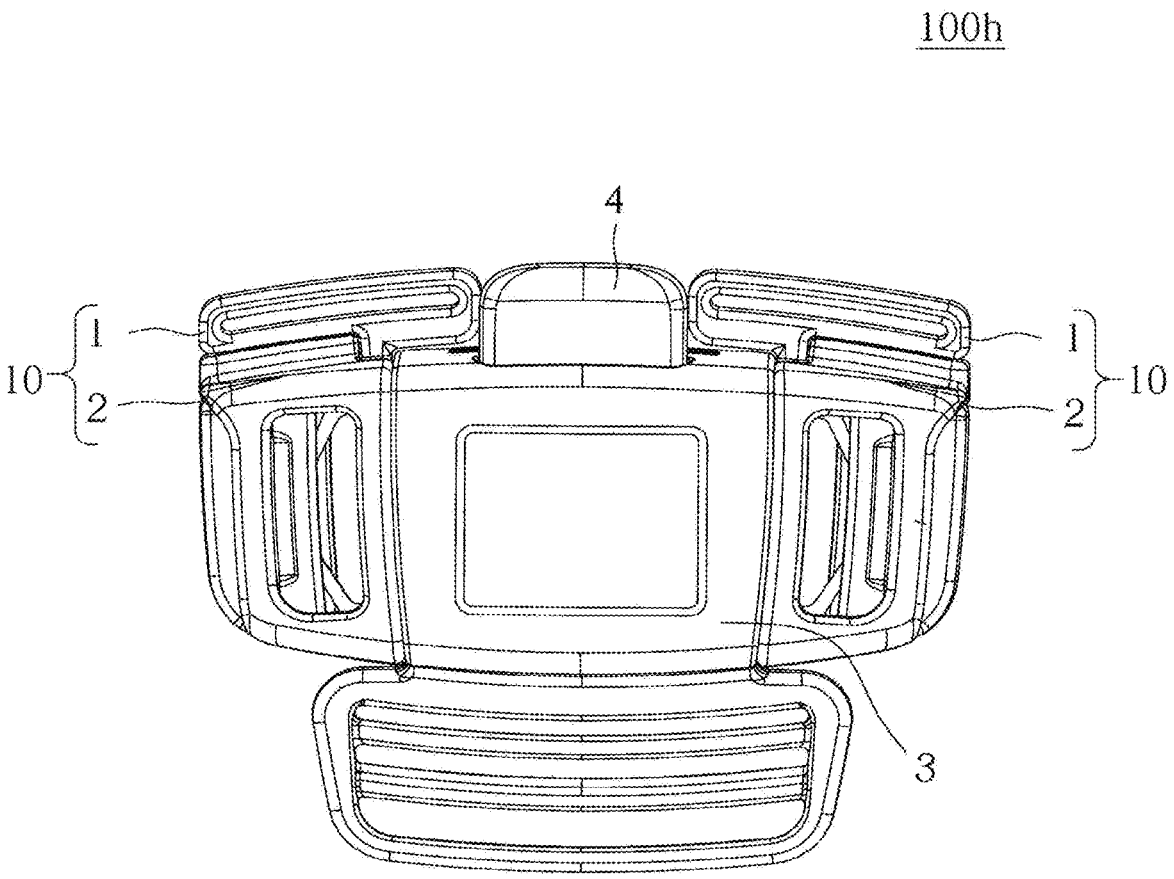
FIG. 65 is a front view diagram of a magnetic buckle assembly according to some embodiments of the present disclosure.
Figure 66:
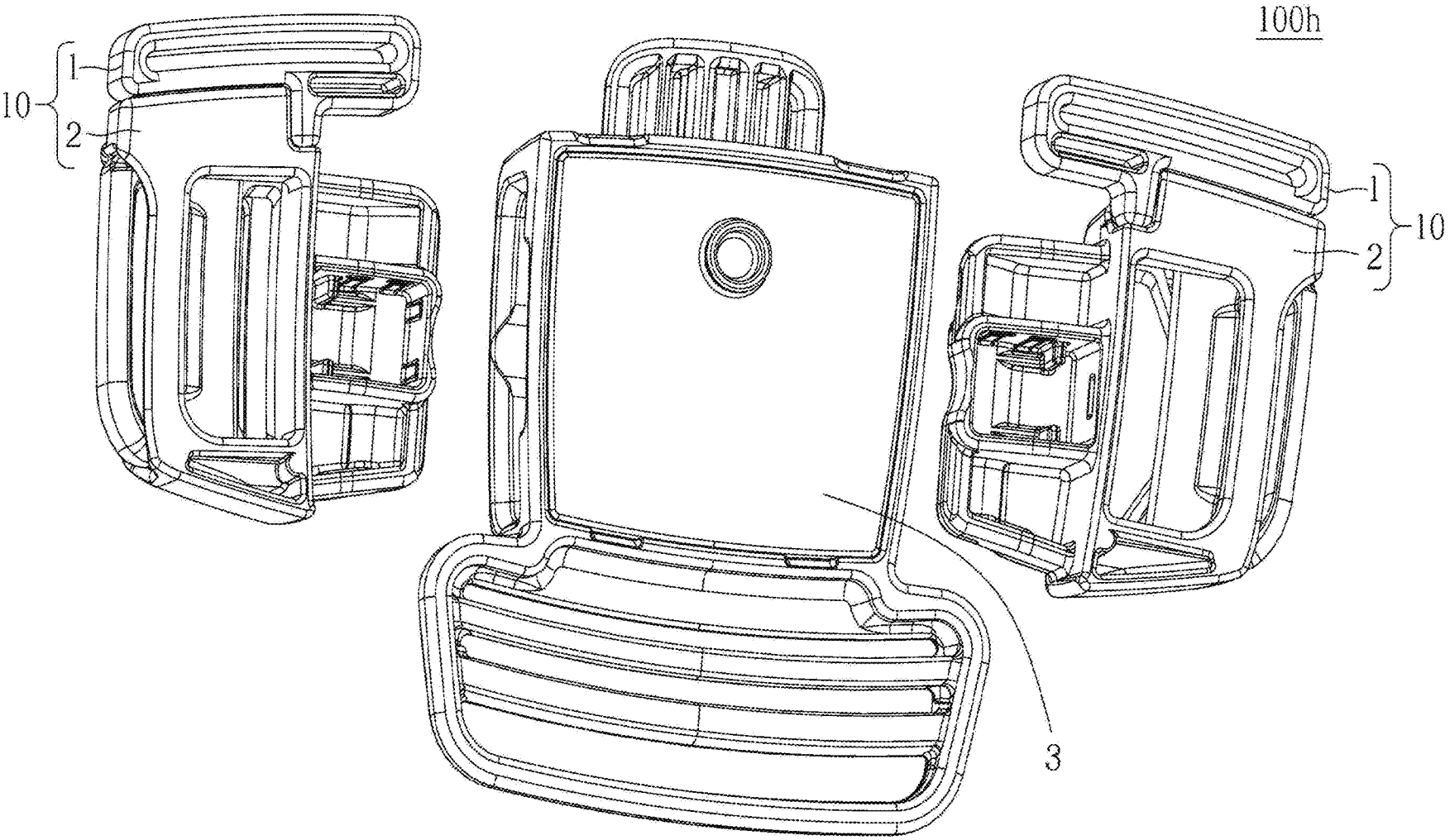
FIG. 66 is a partial diagram of the magnetic buckle assembly as two first buckle components are detached according to some embodiments of the present disclosure.
Figure 67:
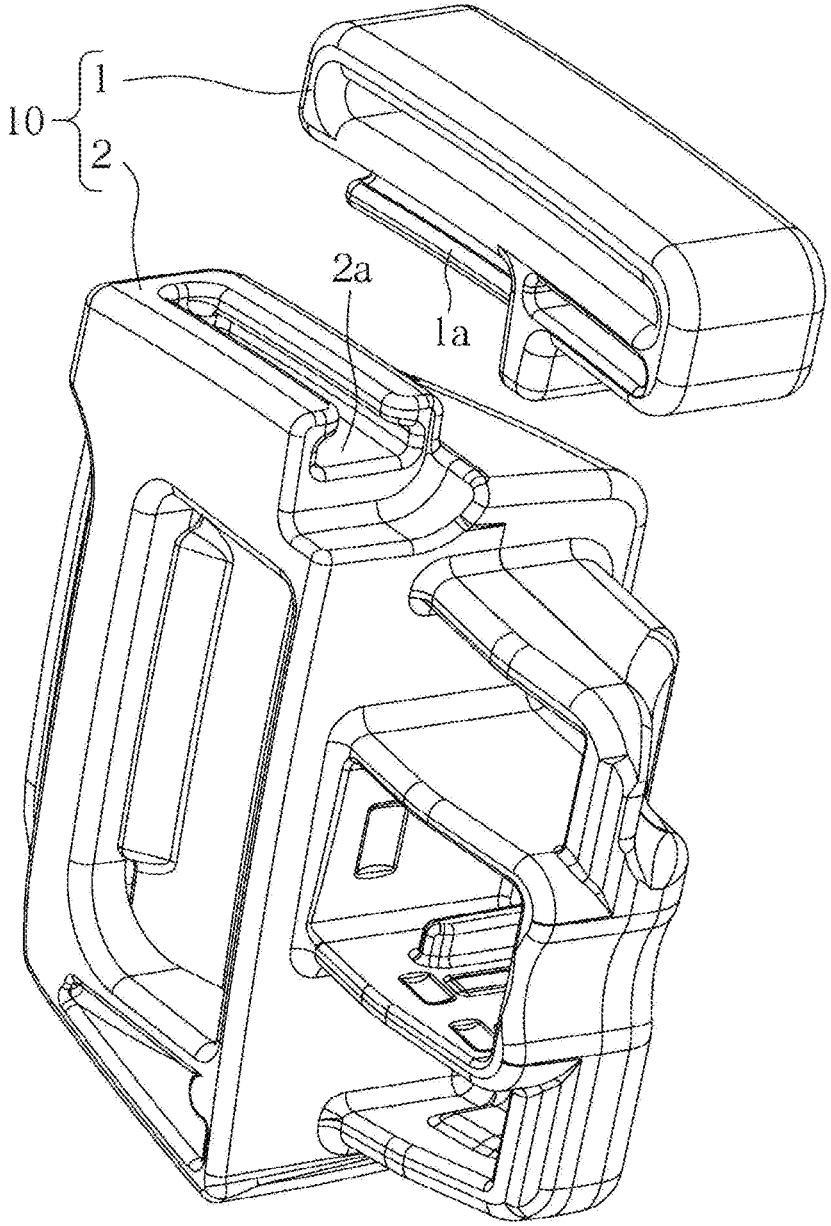
FIG. 67 and FIG. 68 are partial exploded diagrams of the first buckle component at different views according to some embodiments of the present disclosure.
Figure 68:
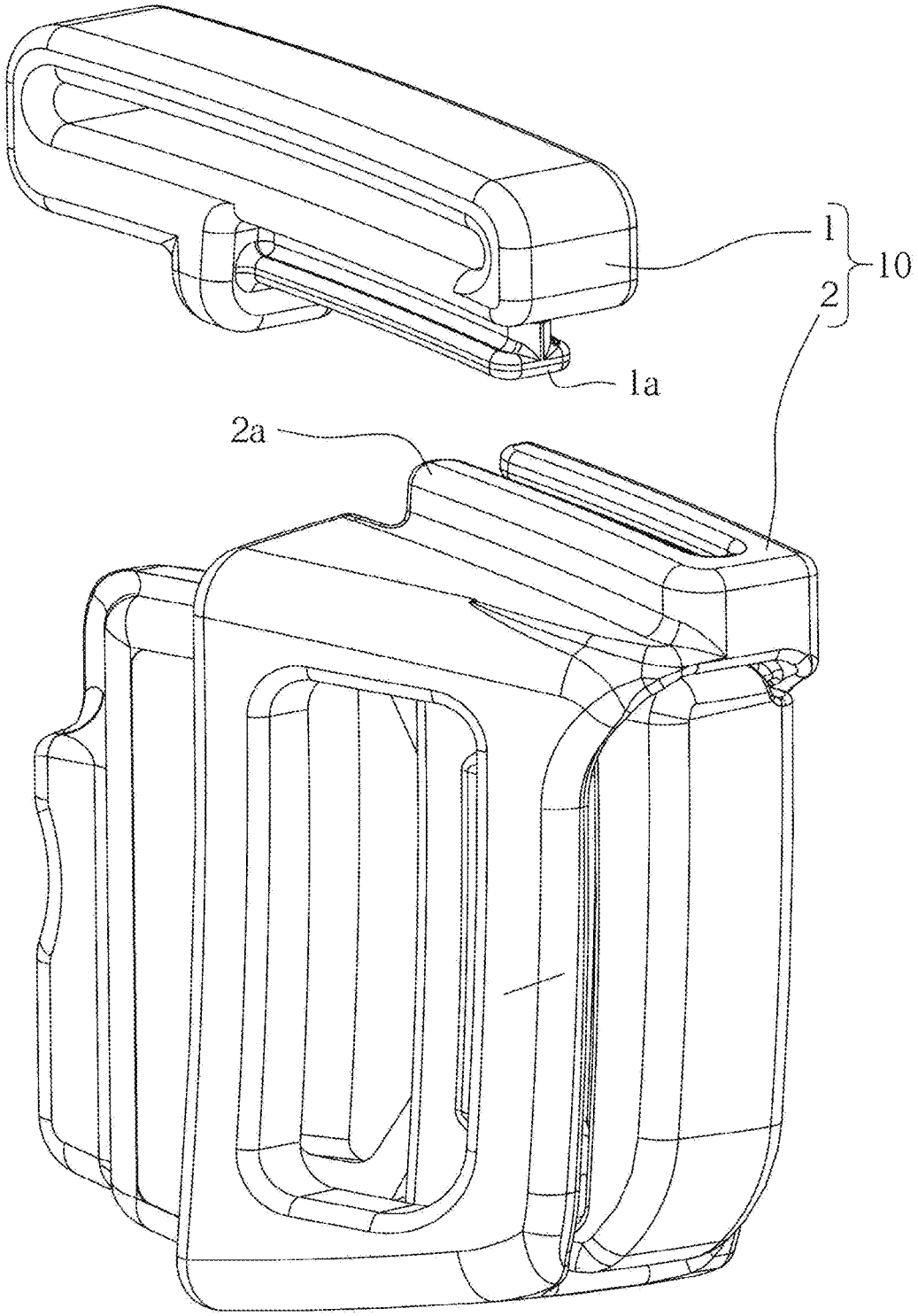

Please refer to FIG. 65 to FIG. 68. FIG. 65 is a front view diagram of a magnetic buckle assembly 100*h* according to some embodiments of the present disclosure. FIG. 66 is a partial diagram of the magnetic buckle assembly 100*h* as the two first buckle components are detached according to some embodiments of the present disclosure. FIG. 67 and FIG. 68 are partial exploded diagrams of the first buckle component 10 at different views according to some embodiments of the present disclosure. The difference between the magnetic buckle assembly 100*d* and the magnetic buckle assembly 100*g* is provided as follows. As shown in FIG. 65 to FIG. 67, in some embodiments, each first buckle component 10 includes the shoulder strap buckle 1 and the waist strap buckle 2. The shoulder strap buckle 1 is slidably assembled with the waist strap buckle 2. Specifically, an inserting slot 2*a* is formed on the waist strap buckle 2. An inserting portion 1*a* is formed on the shoulder strap buckle 1. The shoulder strap buckle 1 is assembled with the waist strap buckle 2 by insertion of the inserting portion 1*a* into the inserting slot 2*a*. Across section of the inserting portion 1*a* can be formed in a T shape, and a cross section of the inserting slot 2*a* matches with the cross section of the inserting portion 1*a*. Furthermore, there is no third magnetic component disposed on the shoulder strap buckle 1.

Other structures of the magnetic buckle assembly 100*h* are similar to the ones of the magnetic buckle assembly 100*d*. Detailed description thereof is omitted herein for simplicity.

Figure 69:
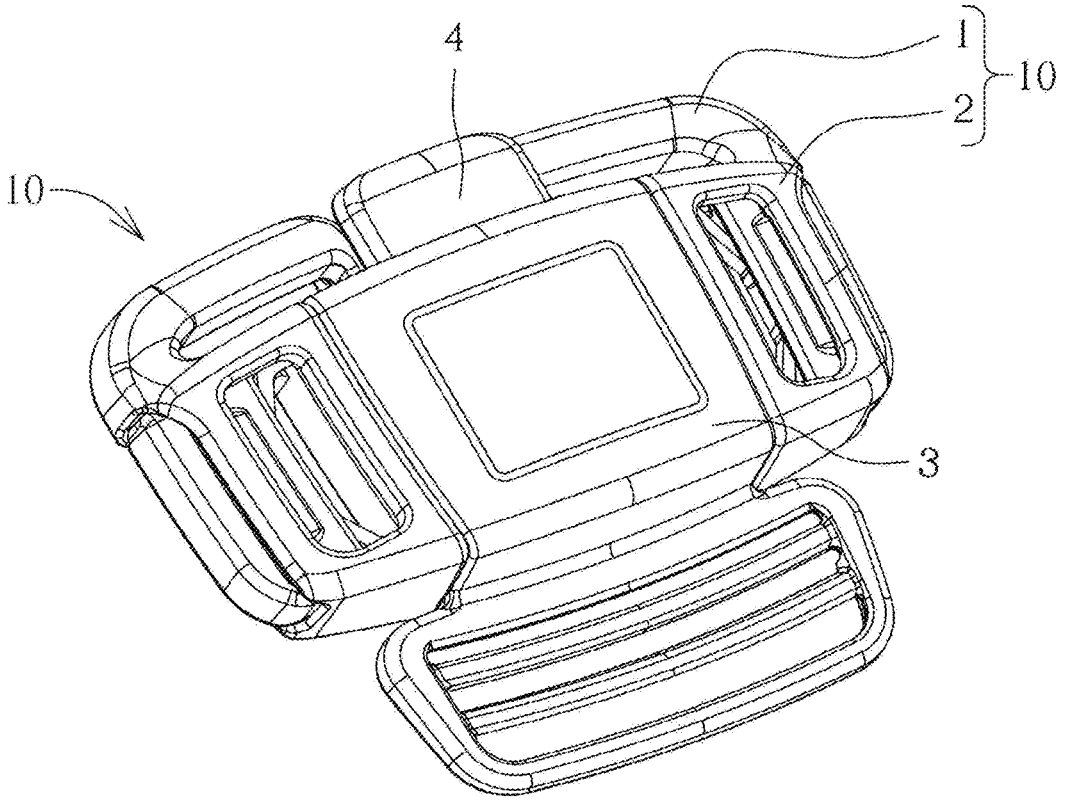
FIG. 69 is a schematic diagram of a magnetic buckle assembly according to some embodiments of the present disclosure.
Figure 70:
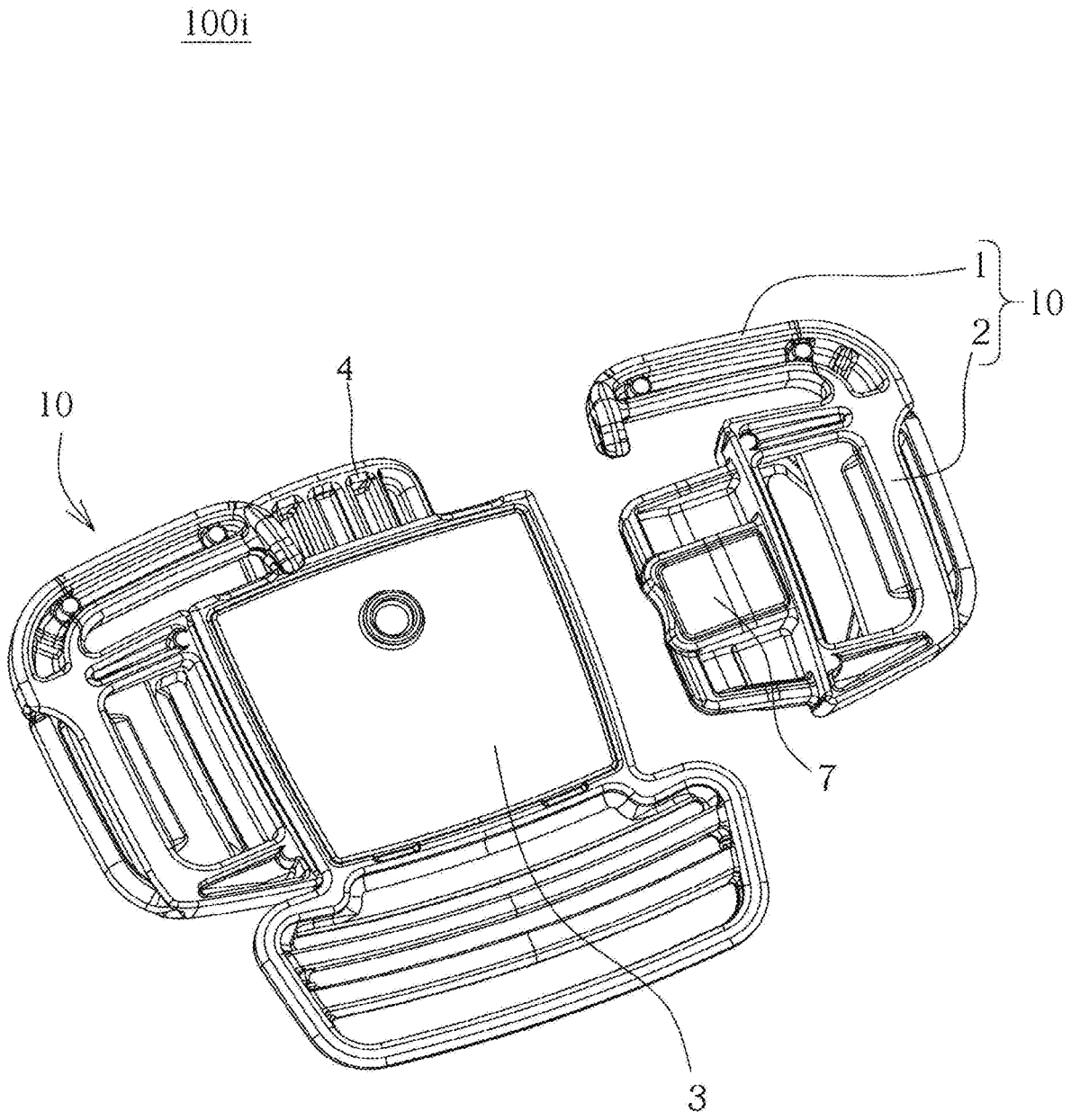
FIG. 70 is a diagram of the magnetic buckle assembly as one of first buckle components is detached according to some embodiments of the present disclosure
Figure 71:
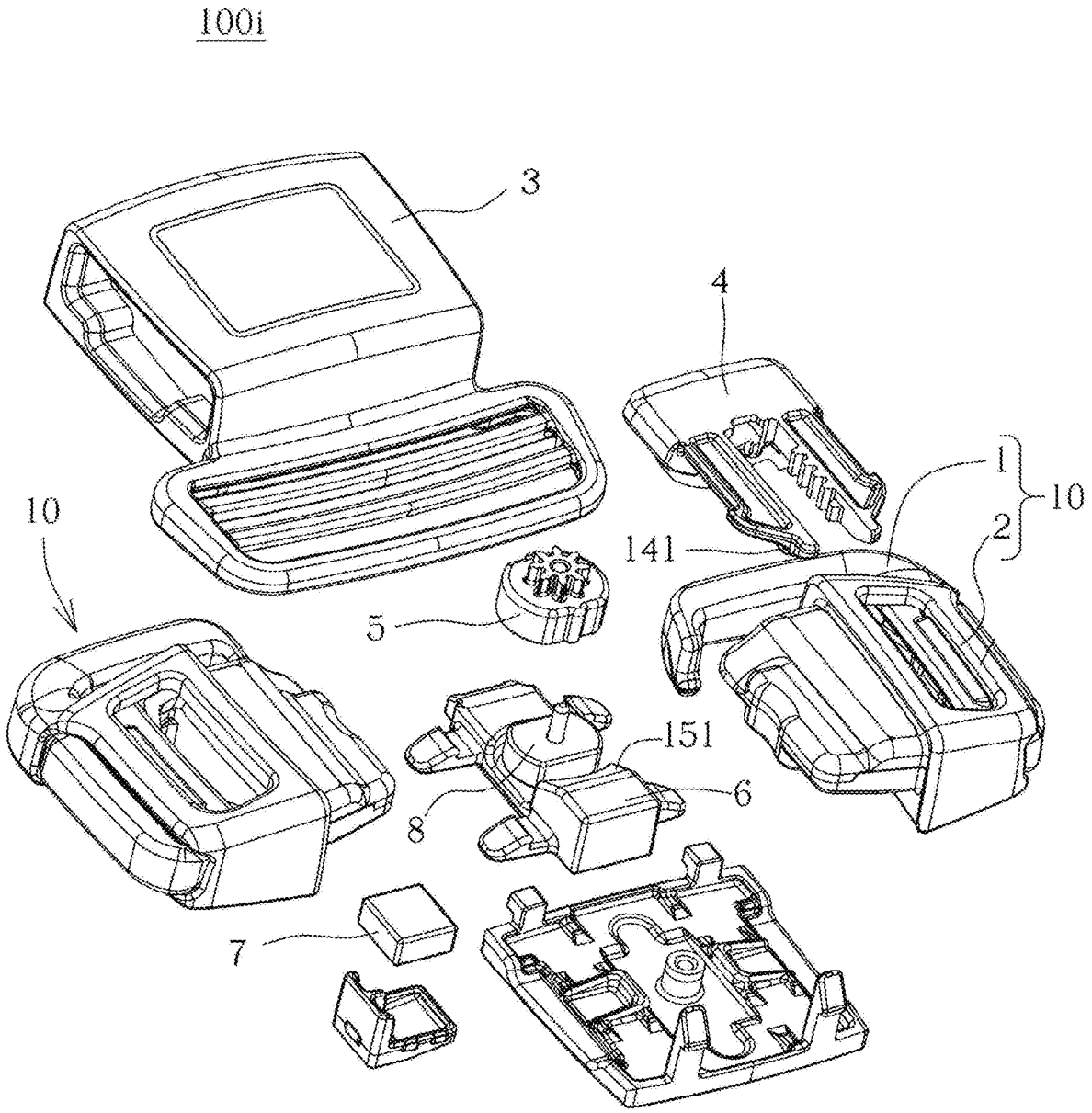
FIG. 71 is an exploded diagram of the magnetic buckle assembly according to some embodiments of the present disclosure.

Please refer to FIG. 69 to FIG. 71. FIG. 69 is a schematic diagram of a magnetic buckle assembly 100*i* according to some embodiments of the present disclosure. FIG. 70 is a diagram of the magnetic buckle assembly 100*i* as one of the first buckle components 10 is detached according to some embodiments of the present disclosure. FIG. 71 is an exploded diagram of the magnetic buckle assembly 100*i* according to some embodiments of the present disclosure. As shown in FIG. 69 to FIG. 71, in some embodiments, similar to the magnetic buckle assembly 100*g* of the aforementioned embodiments, each first buckle component 10 includes the shoulder strap buckle 1 and the waist strap buckle 2. The shoulder strap buckle 1 and the waist strap buckle 2 are combined with each other to form a one-piece male buckle. The second buckle component 3 is a crotch strap buckle. The two first magnetic components 7 are disposed on the two first buckle components 10. The second magnetic component 8 is disposed on the switch 5 inside the second buckle component 3. The third-magnetic component is omitted. Other structures of the magnetic buckle assembly 100 *i*, e.g., structure for driving the latch 6 to disengage from the first buckle components 10, are similar to the ones of the magnetic buckle assembly 100*d* of the aforementioned embodiments. Detailed description thereof is omitted herein for simplicity.

Figure 72:
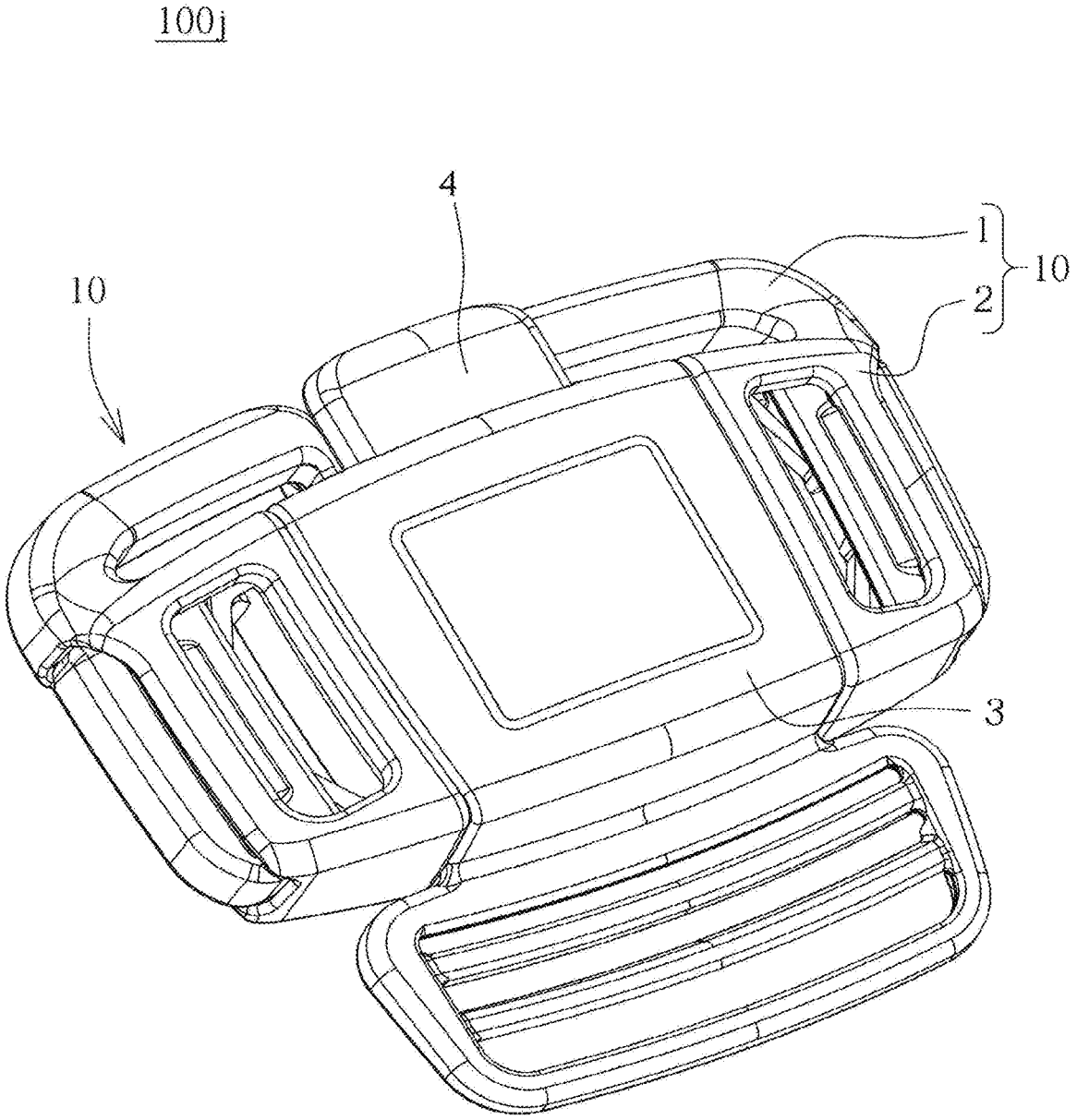
FIG. 72 is a schematic diagram of a magnetic buckle assembly according to some embodiments of the present disclosure.
Figure 73:
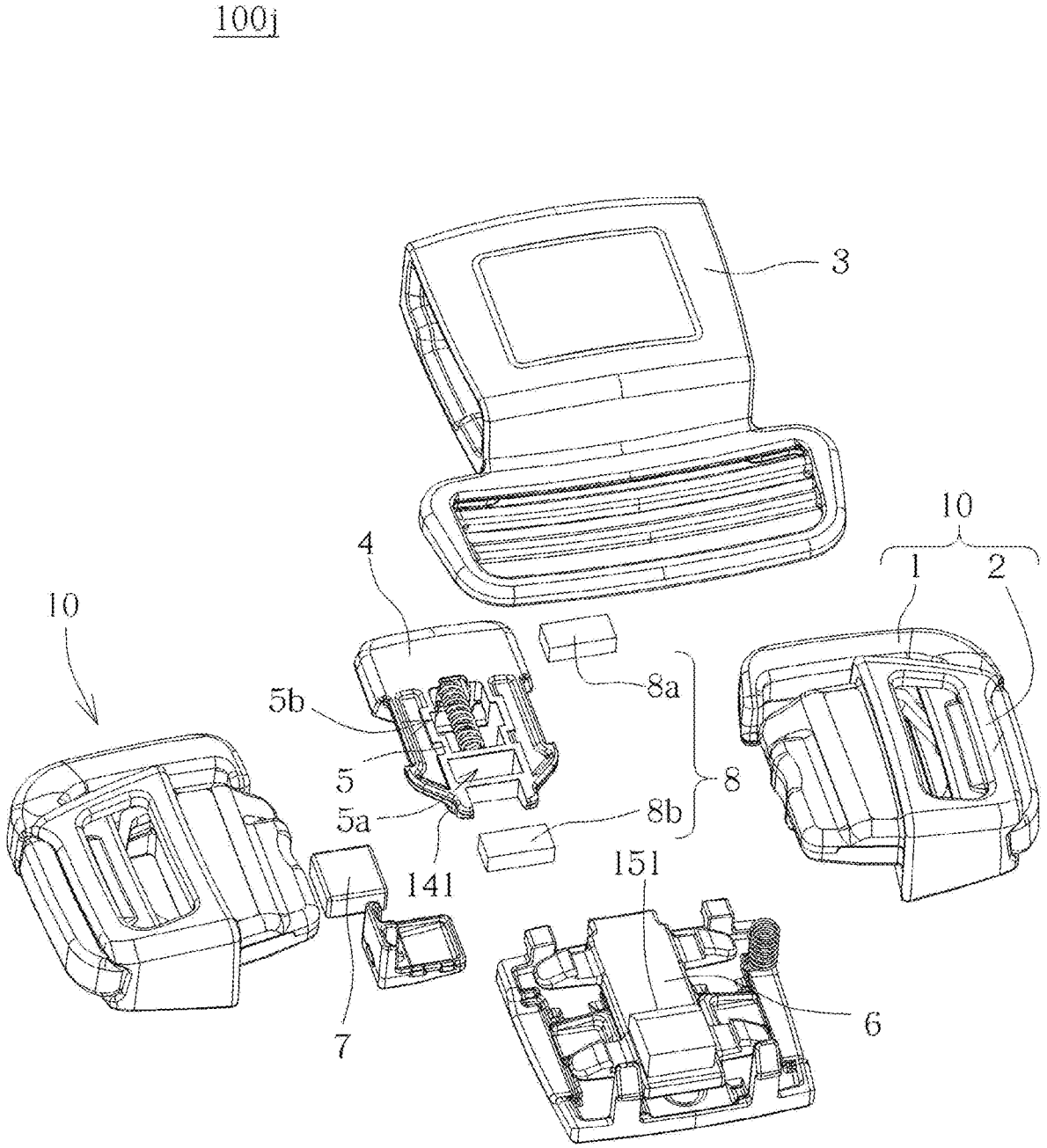
FIG. 73 is an exploded diagram of the magnetic buckle assembly according to some embodiments of the present disclosure.
Figure 74:
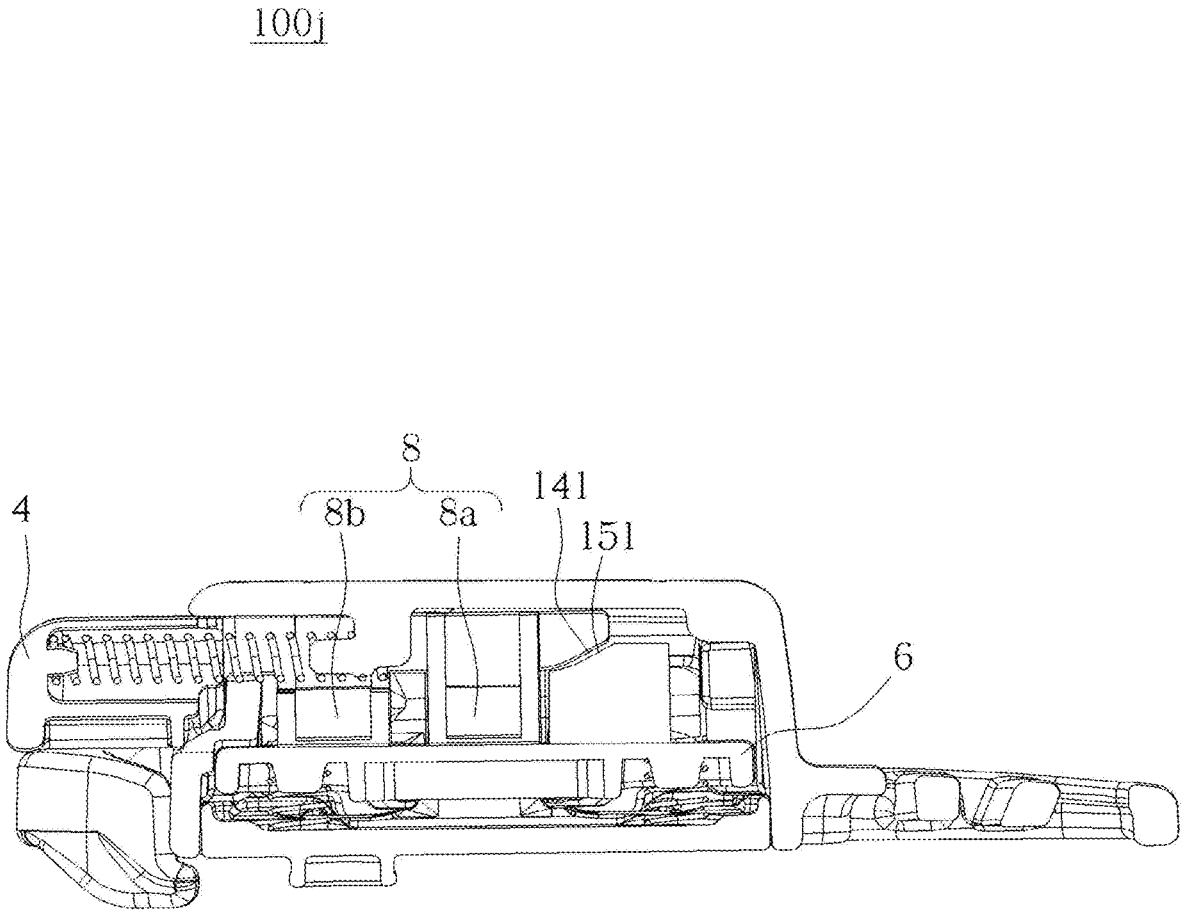
FIG. 74 is a sectional diagram of the magnetic buckle assembly according to some embodiments of the present disclosure.
Figure 75:
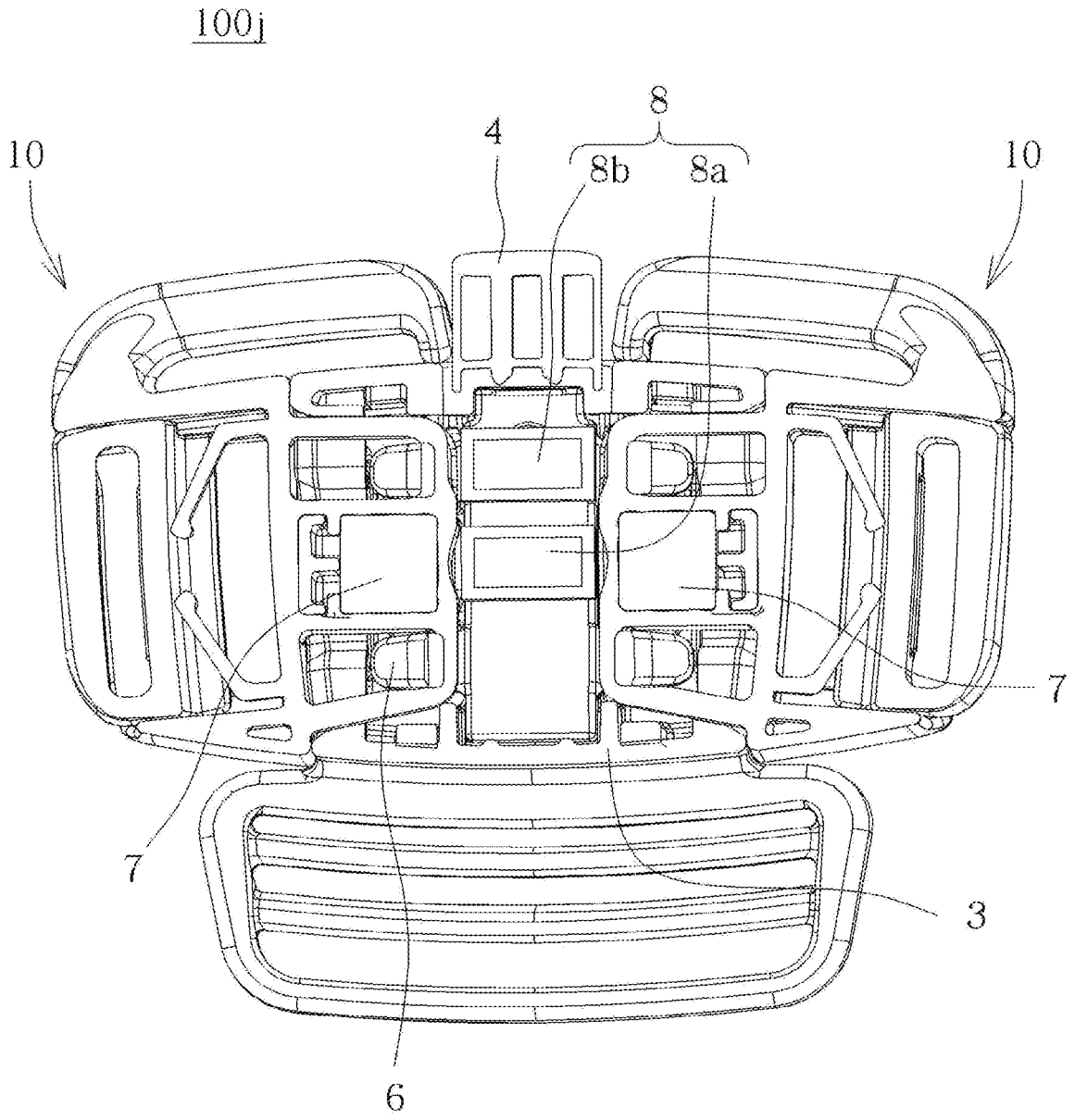
FIG. 75 and FIG. 76 are diagrams of the magnetic buckle assembly at different states according to some embodiments of the present disclosure.
Figure 76:
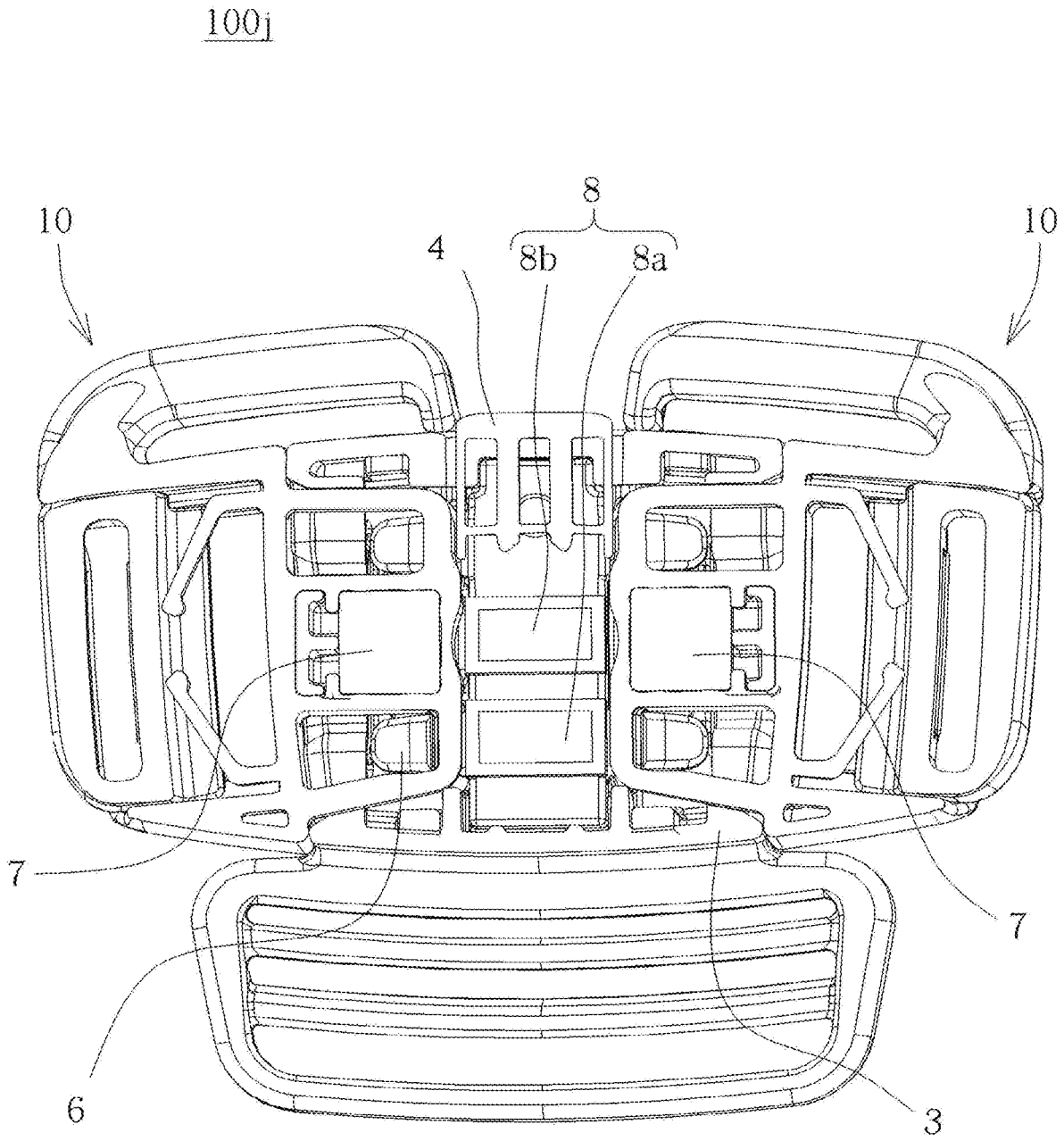

Please refer to FIG. 72 to FIG. 76. FIG. 72 is a schematic diagram of a magnetic buckle assembly 100*j* according to some embodiments of the present disclosure. FIG. 73 is an exploded diagram of the magnetic buckle assembly 100 *j* according to some embodiments of the present disclosure. FIG. 74 is a sectional diagram of the magnetic buckle assembly 100*j* according to some embodiments of the present disclosure. FIG. 75 and FIG. 76 are diagrams of the magnetic buckle assembly 100*j* at different states according to some embodiments of the present disclosure. As shown in FIG. 72 to FIG. 76, in some embodiments, similar to the magnetic buckle assembly 100*g* of the aforementioned embodiments, each first buckle component 10 includes the shoulder strap buckle 1 and the waist strap buckle 2. The shoulder strap buckle 1 and the waist strap buckle 2 are combined with each other to form a one-piece male buckle. The second buckle component 3 is a crotch strap buckle. The two first magnetic components 7 are disposed on the two first buckle components 10. The third magnetic component is omitted. Different from the magnetic buckle assembly 100*g* of the aforementioned embodiments, the switch 5 is fixedly connected to the operating component 4, and the second magnetic component 8 is disposed on the switch 5 and slidable along with the operating component 4. The second magnetic component 8 includes a first magnetic part 8*a* and a second magnetic part 8*b* disposed inside a first chamber 5*a* and a second chamber 5*b* formed on the switch 5. The first magnetic part 8*a* is for magnetically attracting the two first magnetic components 7, and the second magnetic part 8*b* is for magnetically repelling the two first magnetic components 7. In some embodiments, the first magnetic part 8*a* and the second magnetic part 8*b* are separated parts. However, in another embodiment, the first magnetic part and the second magnetic part can be integrally formed.

When the operating component 4 is released and recovered to a position as shown in FIG. 75, the first magnetic part 8*a* is aligned with the two first magnetic components 7 to magnetically attract the two first magnetic components 7 for facilitating the mating of the two first buckle components 10 and the second buckle component 3. When the operating component is operated to slide to a position as shown in FIG. 76, the second magnetic part 8*b* is aligned with the two first magnetic components 7 to magnetically repel the two first magnetic components 7 for facilitating the separation of the two first buckle components 10 and the second buckle component 3. Other Structures of the magnetic buckle assembly 100*j* of the aforementioned embodiments are similar to the ones of the magnetic buckle assembly 100*d* of the aforementioned embodiments. Detailed description is omitted herein for simplicity.

Figure 77:
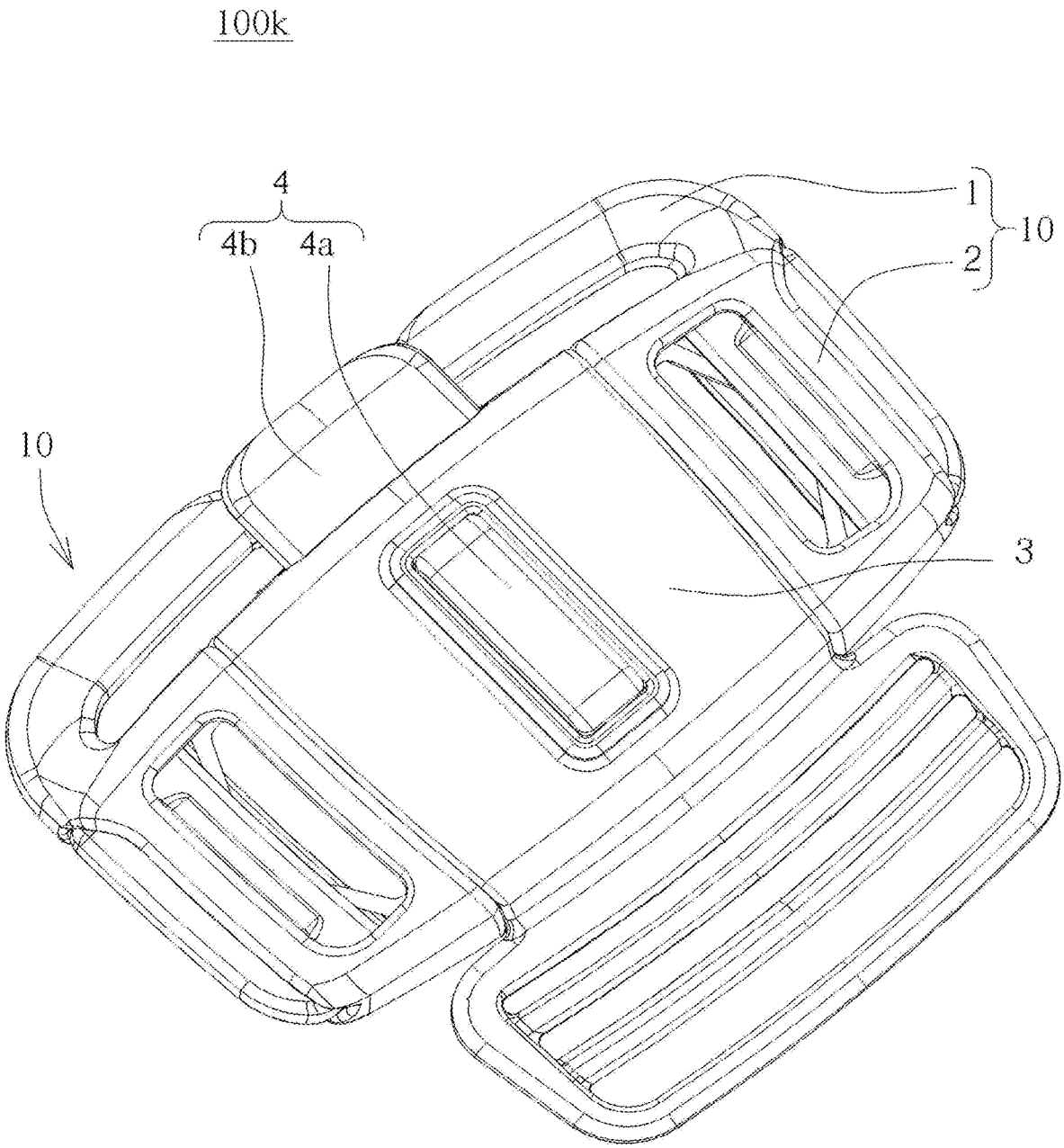
FIG. 77 is a schematic diagram of a magnetic buckle assembly according to some embodiments of the present disclosure.
Figure 78:
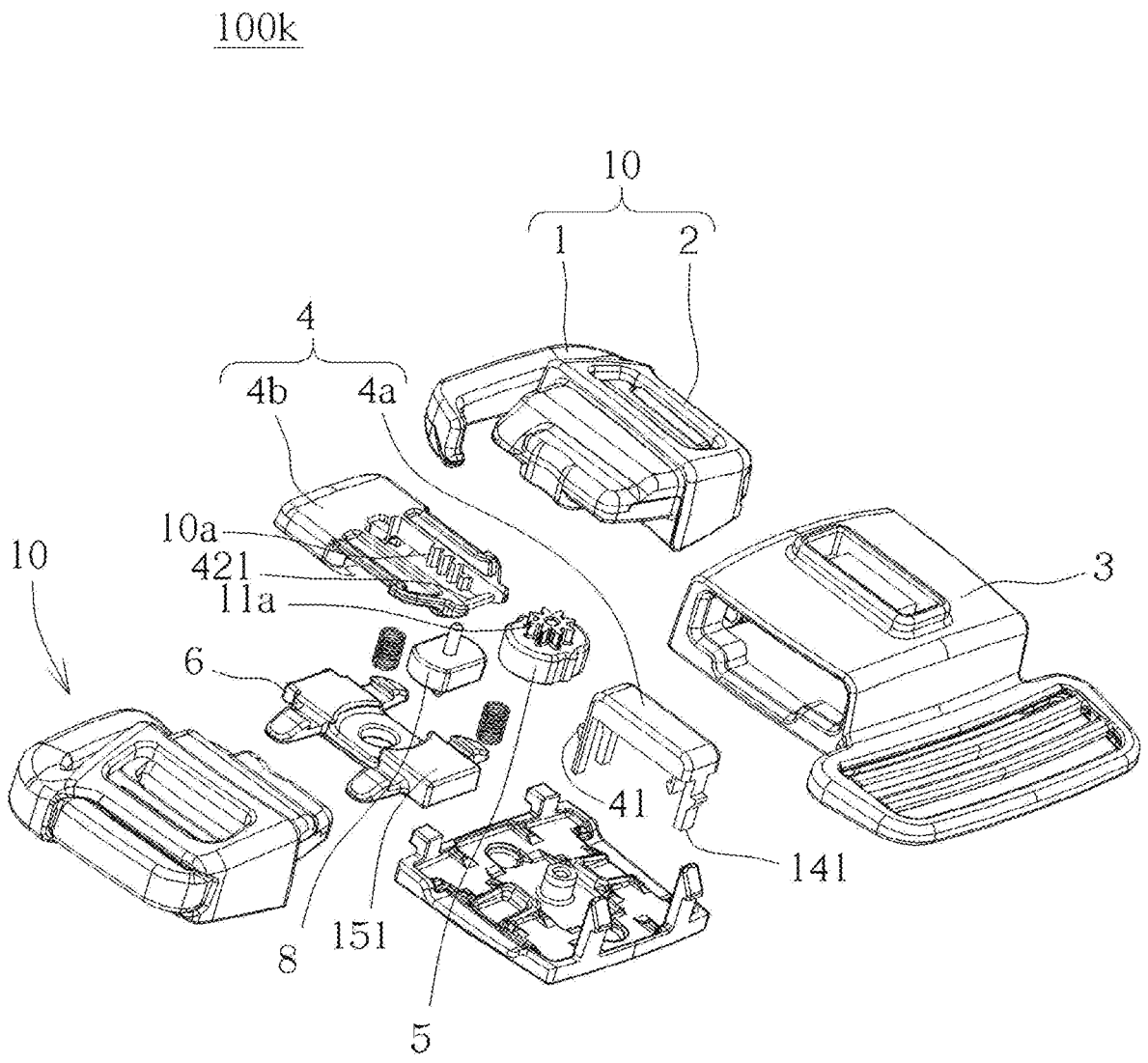
FIG. 78 is an exploded diagram of the magnetic buckle assembly according to some embodiments of the present disclosure.
Figure 79:
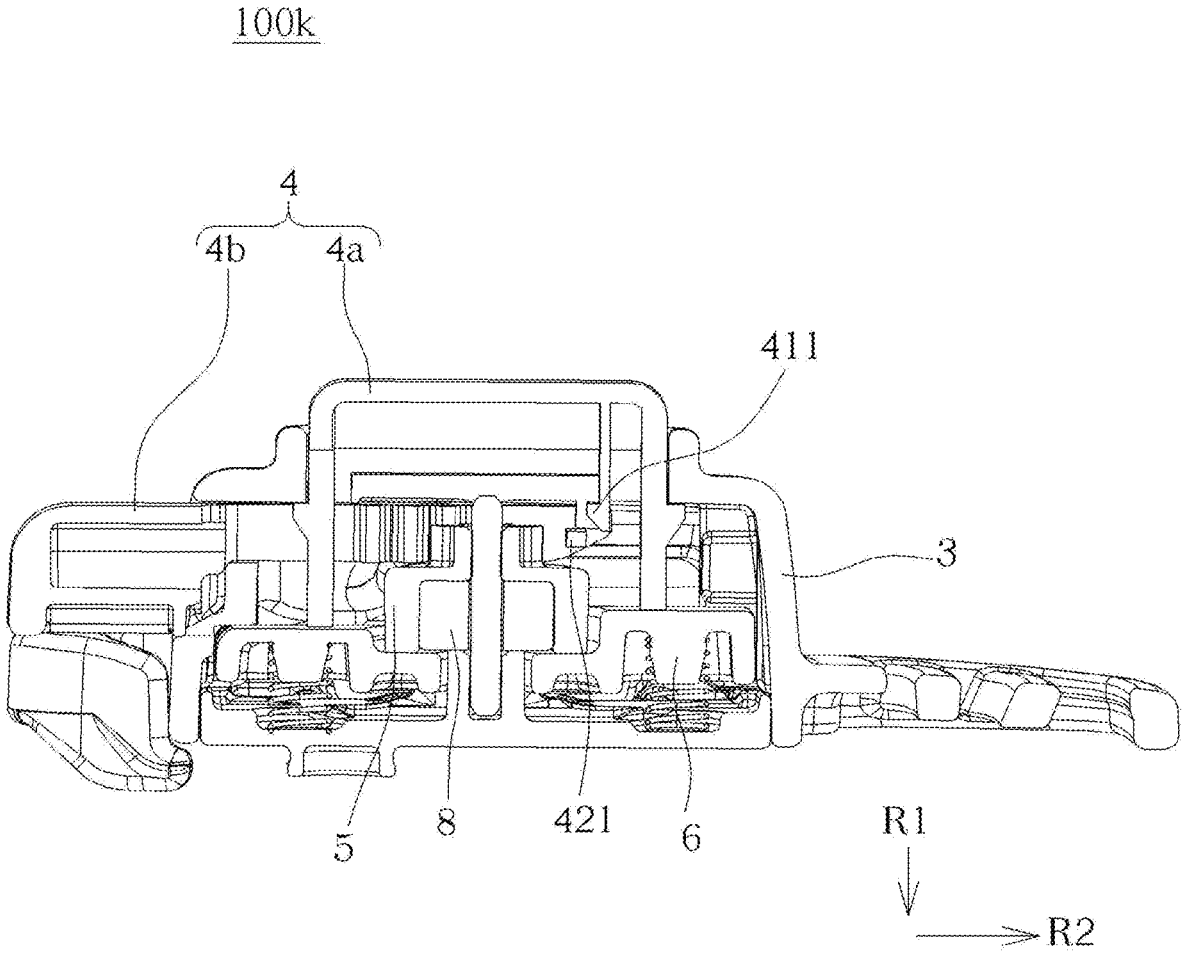
FIG. 79 and FIG. 80 are diagrams of the magnetic buckle assembly at different states according to some embodiments of the present disclosure.
Figure 80:
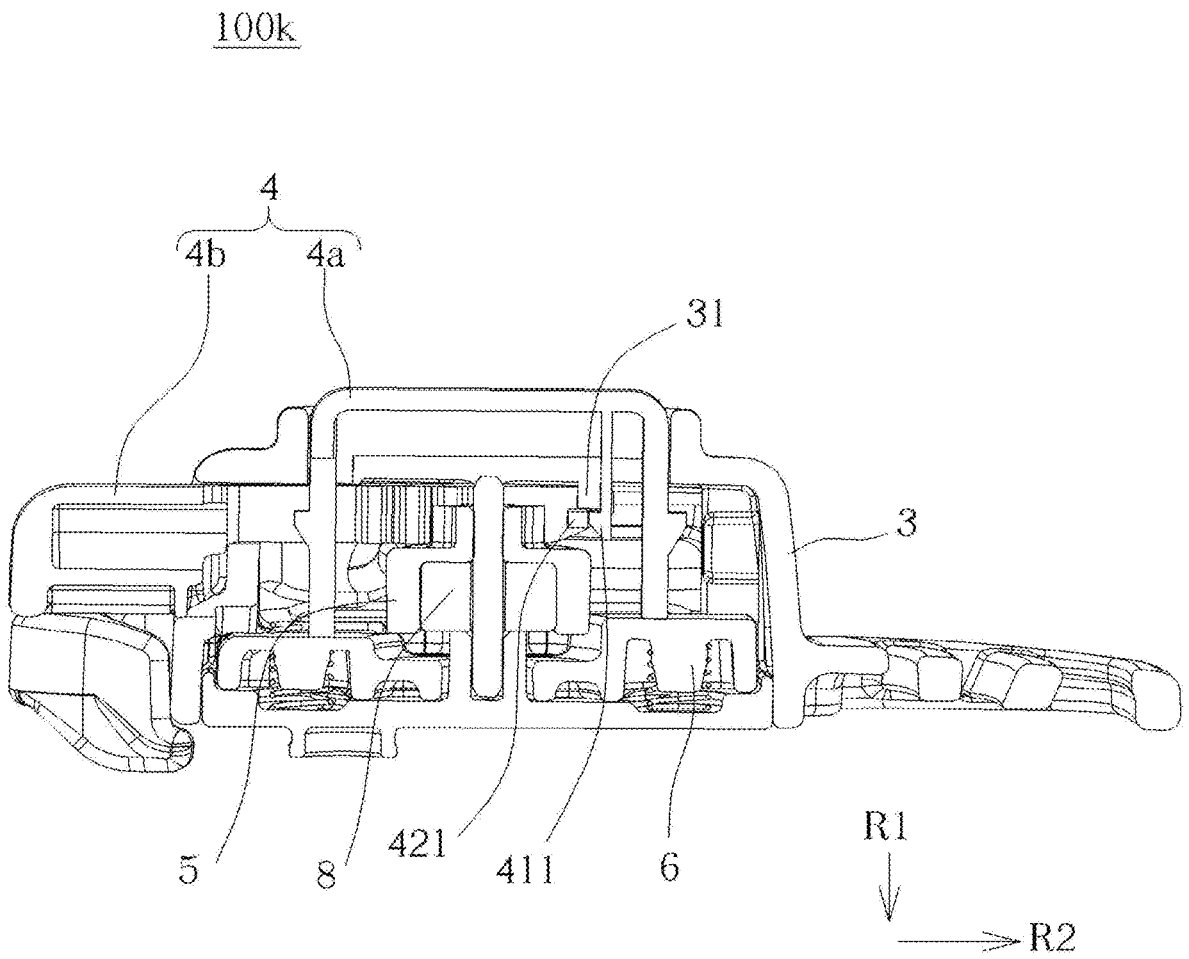

Please refer to FIG. 77 to FIG. 80. FIG. 77 is a schematic diagram of a magnetic buckle assembly 100*k* according to some embodiments of the present disclosure. FIG. 78 is an exploded diagram of the magnetic buckle assembly 100*k* according to some embodiments of the present disclosure. FIG. 79 and FIG. 80 are diagrams of the magnetic buckle assembly 100*k* at different states according to some embodiments of the present disclosure. As show in FIG. 77 to FIG. 80, in some embodiments, similar to the magnetic buckle assembly 100*g* of the aforementioned embodiments, each first buckle component 10 includes the shoulder strap buckle 1 and the waist strap buckle 2. The shoulder strap buckle 1 and the waist strap buckle 2 are combined with each other to form a one-piece male buckle. The second buckle component 3 is a crotch strap buckle. The two first magnetic components, which are not shown in the figures, are disposed on the two first buckle components 10. The second magnetic component 8 is disposed on the switch 5 inside the second buckle component 3. The third magnetic component is omitted. Different from the magnetic buckle assembly 100*g* of the aforementioned embodiments, the operating component 4 includes a first operating part 4*a* and a second operating part 4*b*. The first operating part 4*a* is for driving the latch 6 to disengage from the two first buckle component 10. The second operating part 4*b* is for driving the switch 5 to reverse the direction of the magnetic field of the second magnetic component 8.

Specifically, the first operating part 4*a* and the second operating part 4*b* are slidably disposed on the second buckle component 3 and can be operated to slide individually. In some embodiments, a sliding direction of the first operating part 4*a* can be parallel to the front-rear direction, and a sliding direction of the second operating part 4*b* can be perpendicular to the sliding direction of the first operating part 4*a*. The driving cooperating structure 141 is formed on the first operating part 4*a* of the operating component 4 for cooperating with the driven cooperating structure 151 formed on the latch 6. The driving structure 10*a* is formed on the second operating part 4*b* of the operating component 4 for cooperating with the driven structure 11*a* formed on the switch 5. A retaining structure 411 is formed on the first operating part 4*a* to engage with a retaining engaging portion 31 formed on the second buckle component 3. A releasing structure 421 is formed on the second operating part 4*b* to disengage the retaining structure 411 from the second buckle component 3.

When the first operating part 4*a* is operated to slide from a position as shown in FIG. 79 to a position as shown in FIG. 80 along a first operating direction R1 to disengage the latch 6 from the two first buckle components 10, the retaining structure 411 can engages with the retaining engaging portion 31 to retain the first operating part 4*a* at the position as shown in FIG. 80. After the first operating part 4*a* is retained by engagement of the retaining structure 411 and the retaining engaging portion 41, the first operating part 4*a* can be released, and then the second operating part 4*b* can be operated to slide. When the second operating part 4*b* is operated to slide along a second operating direction R2 perpendicular to the first operating direction R1 to drive the switch 5 to reverse the direction of the magnetic field of the second magnetic component 8, the releasing structure 421 can disengage the retaining structure 411 from the retaining engaging portion 31 on the second buckle component 3 to allow the first operating part 4*a* to be recovered upwardly, e.g., by an elastic component. In other words, the magnetic buckle assembly 100*k* offers a two-stage separation operation for preventing unintentional separation of the first buckle components 10 and the second buckle component 3, and the user can release the first operating part 4*a* after the first operating part 4*a* is operated to disengage the latch 6 from the two first buckle components 10, which brings convenience is use.

Figure 81:
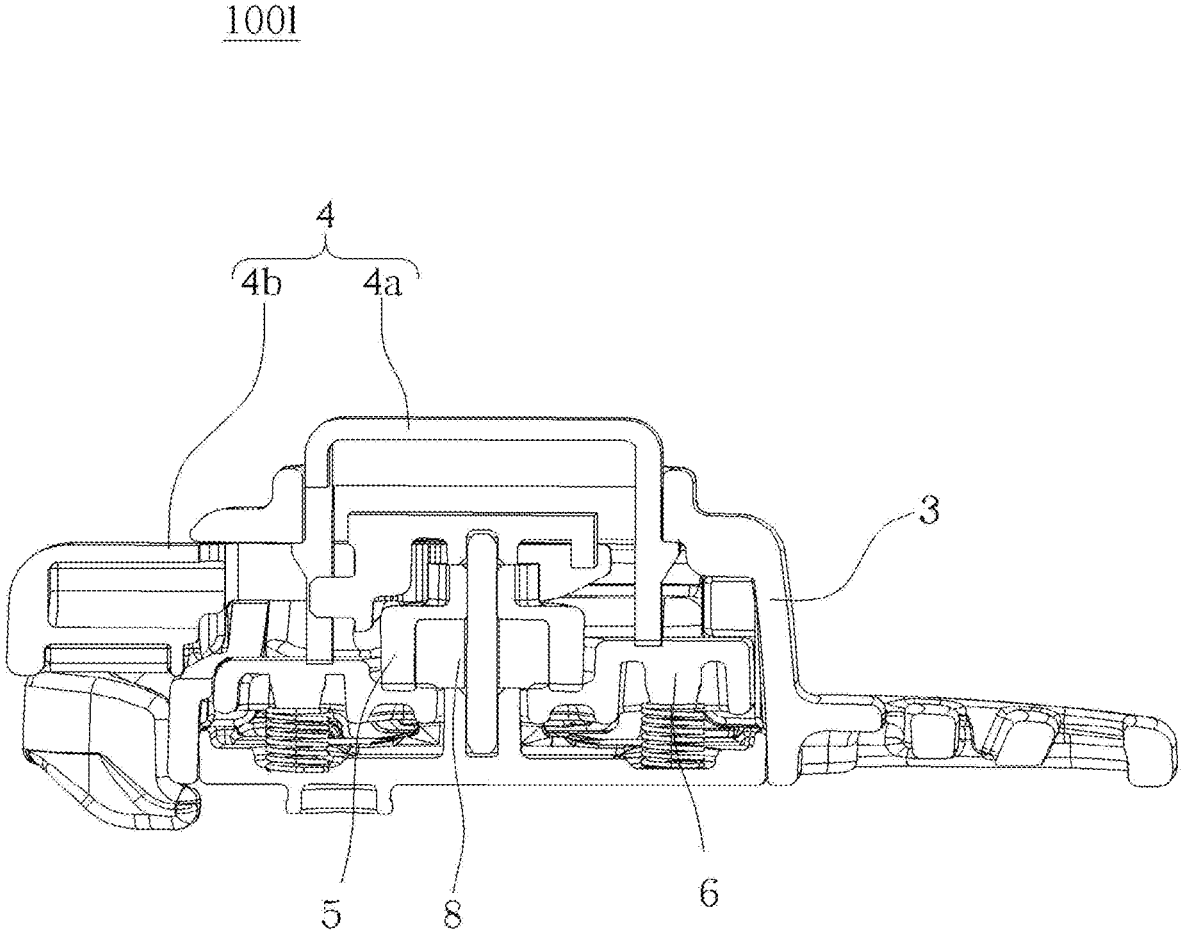
FIG. 81 and FIG. 82 are diagrams of a magnetic buckle assembly according to some embodiments of the present disclosure.
Figure 82:
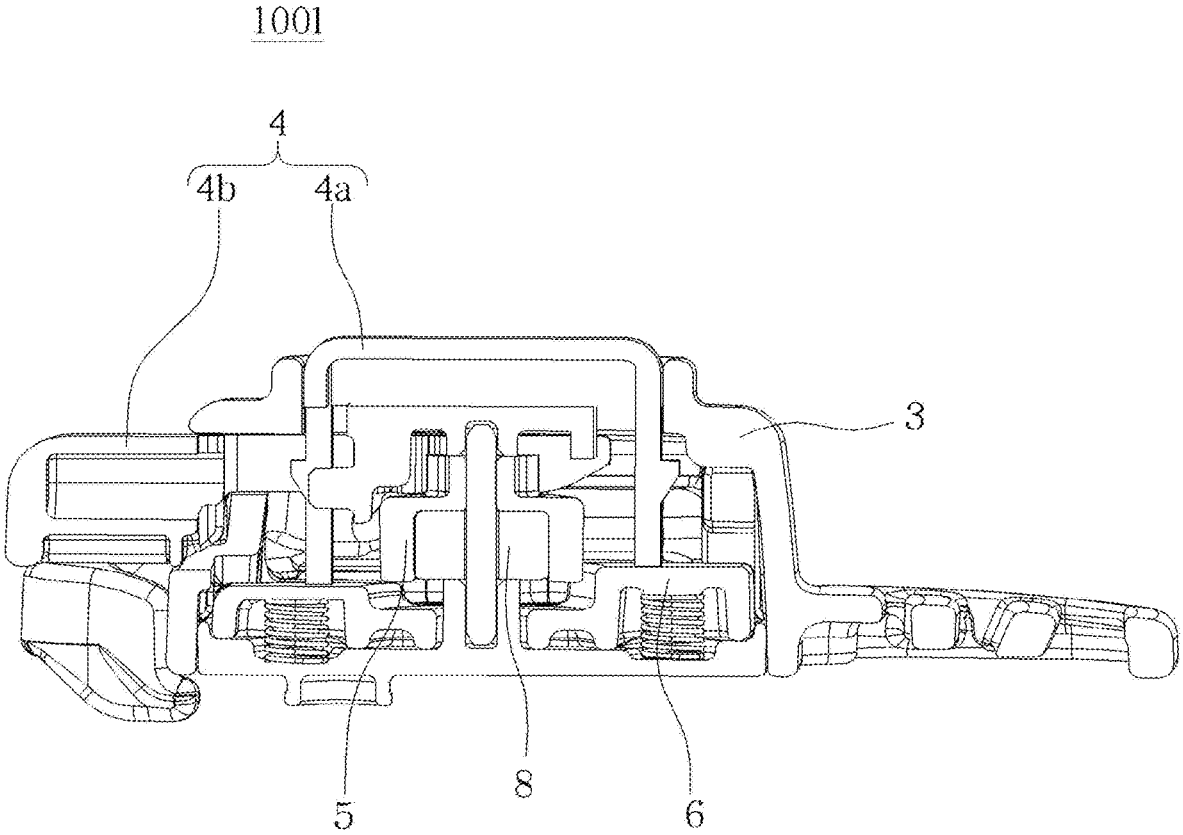

However, the present disclosure is not limited to aforementioned embodiments. For example, please refer to FIG. 81 and FIG. 82. FIG. 81 and FIG. 82 are diagrams of a magnetic buckle assembly 100*l* according to some embodiments of the present disclosure. As shown in FIG. 81 and FIG. 82, in some embodiments, there is no retaining structure formed on the first operating part 4*a*, so that the first operating part 4*a* cannot be retained when the first operating part 4*a* is operated to slide to disengage the latch 6 from the two first buckle components, which are not shown in the figures. In other words, in some embodiments, the user can use two hands or two fingers to operate the first operating part 4*a* and the second operating part 4*b* without releasing the first operating part 4*a* to achieve the separation of the two first buckle components 10 and the second buckle component 3.

Furthermore, understandably, the configuration of the first magnetic component and the second magnetic component of any one of the magnetic buckle assemblies 100*c* to 100*i* and 100*j* to 100*k* of the aforementioned embodiments is similar to the one shown in FIG. 12 to FIG. 14 and can be replaced by the one shown in FIG. 23 to FIG. 25 or FIG. 26 to FIG. 28.

In contrast to the prior art, the magnetic buckle assembly of the present disclosure utilizes cooperation of the operating component, the switch, the latch, the first magnetic component and the second magnetic component to change the direction of the magnetic force the second magnetic component acting on the first magnetic component by rotating the switch when the operating component is operated to disengage the latch from the first buckle component. Therefore, the first magnetic component and the second magnetic component can be configured to magnetically attract each other when the first buckle component is mated with the second buckle component. The first magnetic component and the second magnetic component can magnetically repel each other when the operating component is operated to disengage the latch from the first buckle component for allowing separation of the first buckle component and the second buckle component, which facilitates not only a mating operation of the magnetic buckle assembly but also a separating operation of the magnetic buckle assembly. Understandably, the first magnetic component and the second magnetic component also can be configured to magnetically repel each other when the first buckle component is mated with the second buckle component, and the first magnetic component and the second magnetic component can magnetically attract each other when the operating component is operated to disengage the latch from the first buckle component, which prevents an unintentional separation of first buckle component and the second buckle component.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A magnetic buckle assembly for a child carrier, the magnetic buckle assembly comprising:

a first buckle component;

a second buckle component for mating with the first buckle component;

a first magnetic component disposed on the first buckle component;

a second magnetic component disposed on the second buckle component for magnetically attracting or repelling the first magnetic component; and an operating component that is slidable relative to the second buckle component, wherein actuation of the operating component comprises:

a sliding movement of the operating component relative to the second buckle component that disengages the first buckle component from the second buckle component; and sliding the operating component in a first direction and movement of the second magnetic component in a second direction different than the first direction to force disengagement of the first buckle component from the second buckle component.

2. The magnetic buckle assembly of claim 1, wherein actuation of the operating component comprises a one-stage separation operation that disengages the first buckle component from the second buckle component.

3. The magnetic buckle assembly of claim 1, wherein the operating component sliding in a first direction comprises a linear translation of the operating component.

4. The magnetic buckle assembly of claim 1, wherein movement of the second magnetic component comprises rotation of the second magnetic component about an axis of rotation.

5. The magnetic buckle assembly of claim 1, wherein the operating component includes a driving structure configured to engage with a driven structure of a switch positioned within the second buckle component.

6. The magnetic buckle assembly of claim 5, wherein the driving structure is a gear rack, and the driven structure is a gear wheel.

7. The magnetic buckle assembly of claim 6, wherein actuation of the operation component comprises the gear rack engaging with the gear wheel to cause rotation of the switch about an axis of rotation of the switch.

8. The magnetic buckle assembly of claim 7, wherein the second magnetic component is coupled to a side surface of the switch.

9. The magnetic buckle assembly of claim 8, wherein the second magnetic component is configured to rotate about the axis of rotation of the switch.

10. The magnetic buckle assembly of claim 9, wherein rotation of the second magnetic component about the axis of rotation of the switch reverses a direction of a magnetic field of the second magnetic component to change a direction of a magnetic force of the second magnetic component acting on the first magnetic components.

11. The magnetic buckle assembly of claim 9, wherein rotation of the second magnetic component about the axis of rotation of the switch causes the second magnetic component to repel the first magnetic component.

12. The magnetic buckle assembly of claim 5, wherein the driven structure of the switch is positioned on an axial end face of the switch.

13. The magnetic buckle assembly of claim 5, wherein the driving structure of the operating component is positioned on an inner surface of the operating component extending in the first direction.

14. The magnetic buckle assembly of claim 5, wherein the operating component includes a body and two fingers extending from the body in the first direction, the two fingers being spaced in a direction perpendicular to the first direction such that a gap is included between the two fingers.

15. The magnetic buckle assembly of claim 14, wherein the switch is positioned within the gap.

* * * * *